US008421435B2

(12) United States Patent
Hirose et al.

(10) Patent No.: US 8,421,435 B2
(45) Date of Patent: Apr. 16, 2013

(54) POWER SUPPLY VOLTAGE CONTROLLING CIRCUIT FOR USE IN SUBTHRESHOLD DIGITAL CMOS CIRCUIT INCLUDING MINUTE CURRENT GENERATOR AND CONTROLLED OUTPUT VOLTAGE GENERATOR CIRCUIT

(75) Inventors: Tetsuya Hirose, Kobe (JP); Yuji Osaki, Kobe (JP); Kei Matsumoto, Kobe (JP)

(73) Assignee: Semiconductor Technology Academic Research Center, Kanagawa (JP)

( * ) Notice: Subject to any disclaimer, the term of this patent is extended or adjusted under 35 U.S.C. 154(b) by 544 days.

(21) Appl. No.: 12/713,372

(22) Filed: Feb. 26, 2010

(65) Prior Publication Data

US 2011/0025285 A1 Feb. 3, 2011

(30) Foreign Application Priority Data

Aug. 1, 2009 (JP) ..... 2009-180244
Feb. 25, 2010 (JP) ..... 2010-040630

(51) Int. Cl.
*G05F 3/16* (2006.01)

(52) U.S. Cl.
USPC ..... 323/315; 323/284

(58) Field of Classification Search ..... 323/284, 323/312, 315
See application file for complete search history.

(56) References Cited

U.S. PATENT DOCUMENTS 6,046,627 A * 4/2000 Itoh et al. ..... 327/546
6,097,113 A * 8/2000 Teraoka et al. ..... 307/125
7,714,601 B2 * 5/2010 Ito ..... 324/762.01

FOREIGN PATENT DOCUMENTS

JP 2007-36934 2/2007

* cited by examiner

*Primary Examiner* — Adolf Berhane
*Assistant Examiner* — Lakaisha Jackson
(74) *Attorney, Agent, or Firm* — Wenderoth, Lind & Ponack, L.L.P.

(57) ABSTRACT

In a circuit and method for correcting a delay variation of a subthreshold CMOS circuit operating in a subthreshold region, a power supply voltage controlling circuit is provided for supplying a controlled output voltage to a subthreshold digital CMOS circuit as a controlled power supply voltage. The subthreshold digital CMOS circuit includes CMOS circuits each having a pMOSFET and an nMOSFET and operating in a subthreshold region with a predetermined delay time, and further includes a minute current generator circuit generating a predetermined minute current based on a power supply voltage, and a controlled output voltage generator circuit generating a controlled output voltage for correcting a variation in the delay time based on a generated minute current and supplying the controlled output voltage to the subthreshold digital CMOS circuit as a controlled power supply voltage including a change in each threshold voltage of the pMOSFET and the nMOSFET.

27 Claims, 24 Drawing Sheets

Fig.22

| TEMPERATURE (°C) | | -20 | 27 | 60 | 100 |
|---|---|---|---|---|---|
| DELAY VARIATION UNCORRECTED | AVERAGE CONSUMPTION CURRENT (nA) OF 8-BIT RCA | 0.755 | 0.821 | 1.02 | 2.56 |
| DELAY VARIATION CORRECTED | AVERAGE CONSUMPTION CURRENT (nA) OF 8-BIT RCA | 0.621 | 0.536 | 0.639 | 1.80 |
| | AVERAGE CONSUMPTION CURRENT (nA) OF VOLTAGE BUFFER | 7.16 | 8.12 | 8.95 | 9.70 |
| | AVERAGE CONSUMPTION CURRENT (nA) OF MONITOR CIRCUIT | 60.7 | 69.1 | 76.8 | 83.7 |

VDD
GND
VDD
GND
101SN
101SP
Q301
Q302
Q303
Q304
Q305
Q306
Q307
Q308
93
Q309
Q310
Q21
Q22
Q23
Q24
Q25
Q26
Q27
Q28
Q29
Q30
MNR
51
Q401
Q402
Q403
Q404
Q405
Q406
Q407
Q408
94
Q409
Q410
Q31
Q32
Q33
Q34
Q35
Q36
Q37
Q38
Q39
Q40
MPR
52
Q41
Q42
In
Ip
53
Q44
Q45
Ir
Q43
Q11
IREF
21
Q12
MP1
VREF
20
10A
1A 21
20
1A
10A
53
51
52
101SN
101SPA
VDD
GND
VDD
GND
IREF
VREF
Q11
Q12
MP1
Q44
Q45
Q43
Q41
Q42
Q24
Q28
Q23
Q27
Q29
Q22
Q26
Q30
Q21
Q25
MNR
Q38
Q34
Q37
Q39
Q33
Q40
Q36
Q32
MPR
Q35
Q31
Q307
Q308
93
Q309
Q310
Q408
94
Q409
Q407
Q410
Q301
Q302
Q303
Q304
Q305
Q306

POWER SUPPLY VOLTAGE CONTROLLING CIRCUIT FOR USE IN SUBTHRESHOLD DIGITAL CMOS CIRCUIT INCLUDING MINUTE CURRENT GENERATOR AND CONTROLLED OUTPUT VOLTAGE GENERATOR CIRCUIT

BACKGROUND OF THE INVENTION

1. Field of the Invention

The present invention relates to a power supply voltage controlling circuit and controlling method for a subthreshold digital CMOS circuit. In particular, the present invention relates to a power supply voltage controlling circuit and controlling method for correcting an on-chip delay variation of a subthreshold digital CMOS circuit.

2. Description of the Related Art

Recently, it is required to remarkably reduce power consumption of LSIs due to emergence of numbers of microsystems such as medical implanted devices and sensor devices. Up to now, the power consumption of CMOS circuits has been reduced by miniaturization of devices and reduction in the power supply voltage. In particular, the reduction in the power supply voltage is regarded to be an extremely effective technique for low power consumption operation since an operating power is proportional to a square of the power supply voltage.

Namely, a subthreshold CMOS circuit, in which a power supply voltage of the CMOS circuit is set to a voltage equal to or smaller than a threshold voltage of a transistor (for example, the threshold value is 0.35 V, and changes depending on a manufacturing process), leads to low power, and is regarded to be useful in applications having severe power constraints. For example, in the case of a very low power smart sensor LSI as shown in FIG. 1, a circuit is configured to include a sensor and a mixed signal circuit of analog and digital circuit blocks. By operating this circuit block in a subthreshold region, it is possible to achieve a lower power. A patent document related to the present invention is as follows: Patent Document 1: Japanese patent laid-open publication No. JP-2007-036934-A.

However, in the CMOS circuit operating in the subthreshold region and including inverters each configured to include a pMOSFET and an nMOSFET, the threshold voltages of the MOSFETs fluctuate due to a temperature change and a manufacturing process variation. This leads to such a problem as significant fluctuations in a current-voltage characteristic. The fluctuation in the current-voltage characteristic exerts influences on the delay time, or an operating time of the CMOS circuit. In particular, the current in the subthreshold region fluctuates exponentially with respect to the threshold voltage, and therefore, the delay time also fluctuates following an exponential function. As a result, the subthreshold CMOS circuit has a delay variation larger than that of the CMOS circuit predicated on a strong inversion region, and this leads to such a problem that processings do not end within a preset delay constraint. As described above, in the subthreshold CMOS circuit, a transistor characteristic fluctuates due to the fluctuation in the threshold voltage, and this leads to fluctuation in the current and fluctuation in an operating characteristic of the subthreshold CMOS circuit.

As described above, the operating characteristic of the subthreshold CMOS circuit fluctuates due to the influences of the manufacturing process and a temperature change. However, according to the prior art, it is difficult to predict or guarantee the operating characteristic of the subthreshold CMOS circuit due to the fluctuation in the threshold voltage caused by the manufacturing process and the temperature change. Therefore, it is required to perform temperature compensation and process variation correction by circuit design architecture.

According to the prior art, there have been known techniques for reducing the influences of the fluctuation in the threshold voltage so as to secure stability of the circuit operation by a method for controlling the power supply voltage of the subthreshold CMOS circuit by using two types of constant voltages or by a method for changing a clock frequency. However, these techniques cannot be regarded to be essential improvements in the variation since the voltage and the clock used are not provided based on causes of the variation.

In addition, there have been known a technique in which the variation caused by the process variation is improved by short-circuiting input and output of the subthreshold CMOS circuit and changing a substrate bias of a transistor by using a signal (See the Patent Document 1, for example) of the circuit. However, it has been known that an effect of the improvement in the variation with respect to the substrate bias is small since a control range of the substrate voltage is narrow. In addition, there is such a problem that consumption current is increased by a leakage current due to a forward bias.

As described above, the subthreshold CMOS circuit can achieve low power consumption. On the other hand, there is such a problem that the delay time of the subthreshold CMOS circuit is largely influenced by the fluctuation in the threshold voltage of the MOSFET, which changes according to the temperature change and the manufacturing process.

SUMMARY OF THE INVENTION

An object of the present invention is to provide a power supply voltage controlling circuit and controlling method for a subthreshold digital CMOS circuit operating in the subthreshold region, which is capable of remarkably reducing the influence of the fluctuation in the threshold voltage of the MOSFET with respect to the delay time of the subthreshold digital CMOS circuit, the fluctuation changing according to the temperature change and the manufacturing process.

According to one aspect of the present invention, there is provided a power supply voltage controlling circuit for supplying a controlled output voltage to a subthreshold digital CMOS circuit as a controlled power supply voltage, and the subthreshold digital CMOS circuit includes a plurality of CMOS circuits each having a pMOSFET and an nMOSFET and operating in a subthreshold region with a predetermined delay time In the subthreshold digital CMOS circuit, an absolute value of a difference between a threshold voltage of a typical value of the pMOSFET and a threshold voltage of a typical value of the nMOSFET is set to a value equal to or larger than a predetermined value so that one of the following conditions is satisfied:

(A) a proportion w of the delay time of the CMOS circuit determined by a rise time of the pMOSFET becomes substantially one, and a proportion (1−w) of the delay time of the CMOS circuit determined by a fall time of the nMOSFET becomes substantially zero; and (B) the proportion w of the delay time of the CMOS circuit determined by the rise time of the pMOSFET becomes substantially zero, and the proportion (1−w) of the delay time of the CMOS circuit determined by the fall time of the nMOSFET becomes substantially one.

The power supply voltage controlling circuit includes a minute current generator circuit, and a controlled output voltage generator circuit. The minute current generator circuit generates a predetermined minute current based on a power supply voltage of a power supply unit. The controlled output voltage generator circuit generates a controlled output voltage for correcting a variation in the delay time based on a generated minute current, and supplies the controlled output voltage to the subthreshold digital CMOS circuit as a controlled power supply voltage, the controlled output voltage including a change in the threshold voltage of one of the pMOSFET and the nMOSFET.

In the above-mentioned power supply voltage controlling circuit, the subthreshold digital CMOS circuit is set so that the absolute value of the difference between the threshold voltage of the typical value of the pMOSFET and the threshold voltage of the typical value of the nMOSFET is equal to or larger than 0.1 V.

In addition, in the above-mentioned power supply voltage controlling circuit, the minute current generator circuit includes a current source circuit, and a current mirror circuit. The current source circuit generates the minute current based on the power supply voltage of the power supply unit by using a predetermined current source. The current mirror circuit generates a minute current, which corresponds to the minute current generated by the current source circuit and is substantially the same as the minute current generated by the current source circuit.

Further, in the above-mentioned power supply voltage controlling circuit, the current source circuit includes a first power supply circuit, which includes a current-generating nMOSFET and generates a first current having a temperature characteristic of an output current which depends on electron mobility.

Still further, in the above-mentioned power supply voltage controlling circuit, the current source circuit includes a second power supply circuit, which includes a current-generating pMOSFET and generates a second current having a temperature characteristic of an output current which depends on hole mobility.

In addition, in the above-mentioned power supply voltage controlling circuit, the current source circuit includes first and second power supply circuits, and a current subtraction circuit. The first power supply circuit includes a current-generating nMOSFET, and generates a first current having a temperature characteristic of an output current which depends on electron mobility. The second power supply circuit includes a current-generating pMOSFET, and generates a second current having a temperature characteristic of an output current which depends on hole mobility. The current subtraction circuit generates a reference current by subtracting the second current from the first current.

Further, in the above-mentioned power supply voltage controlling circuit, each of the first power supply circuit and the second power supply circuit further includes a startup circuit. The startup circuit includes a detector circuit, and a startup transistor circuit. The detector circuit detects non-operations of the first power supply circuit and the second power supply circuit. The startup transistor circuit starts up the first power supply circuit and the second power supply circuit by applying a predetermined current to the first power supply circuit and the second power supply circuit when the non-operations of the first power supply circuit and the second power supply circuit are detected by the detector circuit.

In this case, in the above-mentioned power supply voltage controlling circuit, each of the startup circuits of the first power supply circuit and the second power supply circuit further includes a current supply circuit for supplying a bias operating current to the detector circuit. The current supply circuit includes a minute current generator circuit, and a third current mirror circuit. The minute current generator circuit generates a predetermined minute current from a power supply voltage. The third current mirror circuit generates a minute current corresponding to a generated minute current as a bias operating current.

In addition, in the above-mentioned power supply voltage controlling circuit, the startup circuit of the first power supply circuit further includes a first current supply circuit for supplying a bias operating current to the detector circuit. The first current supply circuit includes a minute current generator circuit, and a third current mirror circuit. The minute current generator circuit generates a predetermined minute current from a power supply voltage. The third current mirror circuit generates a minute current corresponding to a generated minute current as a bias operating current. The startup circuit of the second power supply circuit further includes a second current supply circuit for supplying a bias operating current to the detector circuit. The second current supply circuit includes a fourth current mirror circuit for generating a current corresponding to an operating current after startup of the second power supply circuit as a bias operating current.

In the above-mentioned power supply voltage controlling circuit, when the threshold voltage of the typical value of the pMOSFET of the subthreshold digital CMOS circuit is higher than the threshold voltage of the typical value of the nMOSFET of the subthreshold digital CMOS circuit, the controlled output voltage generator circuit includes a pMOSFET having a grounded gate, a grounded drain, and a source connected to the minute current generator circuit.

In addition, in the above-mentioned power supply voltage controlling circuit, when the threshold voltage of the typical value of the nMOSFET of the subthreshold digital CMOS circuit is higher than the threshold voltage of the typical value of the pMOSFET of the subthreshold digital CMOS circuit, the controlled output voltage generator circuit includes an nMOSFET having a gate connected to the minute current generator circuit, a drain connected to the minute current generator circuit, and a grounded source.

Further, in the above-mentioned power supply voltage controlling circuit, when the pMOSFET of the subthreshold digital CMOS circuit is a p-type high threshold device, the controlled output voltage generator circuit includes a p-type high threshold device having a grounded gate, a grounded drain, and a source connected to the minute current generator circuit.

Still further, in the above-mentioned power supply voltage controlling circuit, when the nMOSFET of the subthreshold digital CMOS circuit is an n-type high threshold device, the controlled output voltage generator circuit includes an n-type high threshold device having a gate connected to the minute current generator circuit, a drain connected to the minute current generator circuit, and a grounded source.

In the above-mentioned power supply voltage controlling circuit, the power supply voltage controlling circuit further includes a voltage buffer circuit, which is inserted between the controlled output voltage generator circuit and the subthreshold digital CMOS circuit, generates a power supply voltage corresponding to the controlled output voltage based on the controlled output voltage, and supplies the power supply voltage to the subthreshold digital CMOS circuit.

Further, in the above-mentioned power supply voltage controlling circuit, the power supply voltage controlling circuit further includes a regulator circuit, which is inserted between the controlled output voltage generator circuit and the subthreshold digital CMOS circuit, generates a voltage corresponding to the controlled output voltage based on the controlled output voltage, regulates a generated voltage so as to generate a regulated power supply voltage, and supplies the regulated power supply voltage to the subthreshold digital CMOS circuit.

In the above-mentioned power supply voltage controlling circuit, the subthreshold digital CMOS circuit is set by a manufacturing process so that the absolute value of the difference between the threshold voltage of the typical value of the pMOSFET and the threshold voltage of the typical value of the nMOSFET is equal to or larger than 0.1 V.

In addition, in the above-mentioned power supply voltage controlling circuit, the subthreshold digital CMOS circuit is set by changing a substrate voltage so that the absolute value of the difference between the threshold voltage of the typical value of the pMOSFET and the threshold voltage of the typical value of the nMOSFET is equal to or larger than 0.1 V.

According to another aspect of the present invention, there is provided a power supply voltage controlling method of supplying a controlled output voltage to a subthreshold digital CMOS circuit as a controlled power supply voltage, and the subthreshold digital CMOS circuit includes a plurality of CMOS circuits each having a pMOSFET and an nMOSFET and operating in a subthreshold region with a predetermined delay time. In the subthreshold digital CMOS circuit, an absolute value of a difference between a threshold voltage of a typical value of the pMOSFET and a threshold voltage of a typical value of the nMOSFET is set to a value equal to or larger than a predetermined value so that one of the following conditions is satisfied:

(A) a proportion w of the delay time of the CMOS circuit determined by a rise time of the pMOSFET becomes substantially one, and a proportion (1−w) of the delay time of the CMOS circuit determined by a fall time of the nMOSFET becomes substantially zero; and (B) the proportion w of the delay time of the CMOS circuit determined by the rise time of the pMOSFET becomes substantially zero, and the proportion (1−w) of the delay time of the CMOS circuit determined by the fall time of the nMOSFET becomes substantially one.

The power supply voltage controlling method includes:

a step of generating a predetermined minute current based on a power supply voltage of a power supply unit; and a step of generating a controlled output voltage for correcting a variation in the delay time based on a generated minute current, and supplying the controlled output voltage to the subthreshold digital CMOS circuit as a controlled power supply voltage, where the controlled output voltage includes a change in the threshold voltage of one of the pMOSFET and the nMOSFET.

In the above-mentioned power supply voltage controlling method, the step of generating the minute current includes:

a step of generating the minute current based on the power supply voltage of the power supply unit by using a current source circuit; and a step of generating a minute current, which corresponds to the minute current generated by the current source circuit and is substantially the same as the minute current generated by the current source circuit, by using a current mirror circuit.

In addition, in the above-mentioned power supply voltage controlling method, when the threshold voltage of the typical value of the pMOSFET of the subthreshold digital CMOS circuit is higher than the threshold voltage of the typical value of the nMOSFET of the subthreshold digital CMOS circuit, the step of generating the controlled output voltage generates the controlled output voltage by using a pMOSFET having a grounded gate, a grounded drain, and a source connected to the minute current generator circuit.

Further, in the above-mentioned power supply voltage controlling method, when the threshold voltage of the typical value of the nMOSFET of the subthreshold digital CMOS circuit is higher than the threshold voltage of the typical value of the pMOSFET of the subthreshold digital CMOS circuit, the step of generating the controlled output voltage generates the controlled output voltage by using an nMOSFET having a gate connected to the minute current generator circuit, a drain connected to the minute current generator circuit, and a grounded source.

Still further, in the above-mentioned power supply voltage controlling method, when the pMOSFET of the subthreshold digital CMOS circuit is a p-type high threshold device, the step of generating the controlled output voltage generates the controlled output voltage by using a p-type high threshold device having a grounded gate, a grounded drain, and a source connected to the minute current generator circuit.

Still farther, in the above-mentioned power supply voltage controlling method, when the nMOSFET of the subthreshold digital CMOS circuit is an n-type high threshold device, the step of generating the controlled output voltage generates the controlled output voltage by using an n-type high threshold device having a gate connected to the minute current generator circuit, a drain connected to the minute current generator circuit, and a grounded source.

The above-mentioned power supply voltage controlling method may further include a step of, by using a voltage buffer circuit after the step of generating the controlled output voltage, generating a power supply voltage corresponding to the controlled output voltage based on the controlled output voltage and supplying the power supply voltage to the subthreshold digital CMOS circuit.

In addition, the above-mentioned power supply voltage controlling method may further includes a step of, by using a regulator circuit after the step of generating the controlled output voltage, generating a voltage corresponding to the controlled output voltage based on the controlled output voltage, regulating a generated voltage so as to generate a regulated power supply voltage, and supplying the regulated power supply voltage to the subthreshold digital CMOS circuit.

In the above-mentioned power supply voltage controlling method, the subthreshold digital CMOS circuit is set by a manufacturing process so that the absolute value of the difference between the threshold voltage of the typical value of the pMOSFET and the threshold voltage of the typical value of the nMOSFET is equal to or larger than 0.1 V.

In addition, in the above-mentioned power supply voltage controlling method, the subthreshold digital CMOS circuit is set by changing a substrate voltage so that the absolute value of the difference between the threshold voltage of the typical value of the pMOSFET and the threshold voltage of the typical value of the nMOSFET is equal to or larger than 0.1 V.

Advantageous Effects of Invention

According to the power supply voltage controlling circuit and method for the subthreshold digital CMOS circuit of the present invention, there is provided a minute current generator circuit for generating a minute current based on a power supply voltage of a power supply unit, and a controlled output voltage generator circuit for generating a controlled output voltage for correcting a variation in the delay time based on a generated minute current, and for supplying the controlled output voltage to the subthreshold digital CMOS circuit as a controlled power supply voltage, the controlled output voltage including a change in the threshold voltage of one of a pMOSFET and an nMOSFET. Therefore, by performing on-chip monitoring of the threshold voltage of a MOSFET and reflecting monitoring results on the power supply voltage of the CMOS circuit, it is possible to correct the delay variation of the subthreshold digital CMOS circuit operating in the subthreshold region, and it is possible to reduce the power consumption of the entire circuit. In addition, the present invention is not limited to the application to the subthreshold digital CMOS circuit, but the present invention can be also applied to a CMOS circuit of strong inversion operation with a power supply voltage in the neighborhood of the threshold voltage.

BRIEF DESCRIPTION OF THE DRAWINGS

FIG. 22 is a table showing simulation results of average consumption current of the 8-bit RCA when the delay variation is corrected and uncorrected in a second embodiment;

FIG. 24 is a circuit diagram showing a configuration of a ring oscillator 2A as one example of the subthreshold digital CMOS circuits of FIG. 23 and the like;

FIG. 27 is a circuit diagram showing a configuration of a delay variation correcting circuit according to a sixth embodiment, which is a modified embodiment of the delay variation correcting circuits of FIG. 5 and the like;

DETAILED DESCRIPTION OF THE PREFERRED EMBODIMENTS

One example of embodiments of the present invention is described below in detail with reference to the drawings. It is noted that the scope of the present invention is not limited to the following implemental examples and illustrative examples, and numbers of alterations and modifications can be provided.

First Embodiment

First of all, there will be described a delay variation (a delay time variation is referred to as the delay variation hereinafter) of a subthreshold CMOS circuit operating in a subthreshold region. A drain current I flowing through a MOSFET operating in the subthreshold region is expressed by the following equation:

$$I = KI_0\exp\left(\frac{V_{GS} - V_{TH}}{\eta V_T}\right), \tag{1}$$

where K (=W/L) is an aspect ratio between a channel length L and a channel width W. In addition, $I_0(=\mu C_{OX}(\eta-1)V_T^2)$ is a pre-coefficient of a subthreshold current. In this case, $\mu$ is a carrier mobility, and $C_{OX}$ $(=\in_{OX}/t_{OX})$ is an oxide film capacitance per unit area. In addition, $t_{OX}$ is an oxide film thickness, $\in_{OX}$ is a dielectric constant of an oxide film, $\eta$ is a subthreshold slope coefficient, $V_T$ $(=k_B T/q)$ is a thermal voltage, $k_B$ is a Boltzmann factor, T is an absolute temperature, q is an elementary electric charge, and $V_{TH}$ is a threshold voltage.

In addition, a propagation delay time $\tau$ of a CMOS inverter configured to include an nMOSFET and a pMOSFET is expressed by the following equation:

$$\tau = \frac{\tau_{HL} + \tau_{LH}}{2} = \frac{1}{2}\left(\frac{C_L V_{DD}}{I_N} + \frac{C_L V_{DD}}{I_P}\right), \tag{2}$$

where $\tau_{HL}$ and $\tau_{LH}$ are a rise time and a fall time, respectively, $C_L$ is a load capacitance, and $V_{DD}$ is a power supply voltage. In addition, $I_N$ and $I_P$ are on-state currents in the subthreshold regions of the nMOSFET and the pMOSFET, respectively. The load capacitance $C_L$ can be expressed as $\alpha LWC_{OX}$ ($\alpha$ is a constant), since load capacitance $C_L$ can be approximated by a gate capacitance of the next stage.

As described above, in the subthreshold CMOS circuit, the drain current flowing through the MOSFET fluctuates exponentially with respect to a process variation and a temperature change. Therefore, the delay variation of the subthreshold CMOS circuit follows a lognormal distribution.

Figure 1:
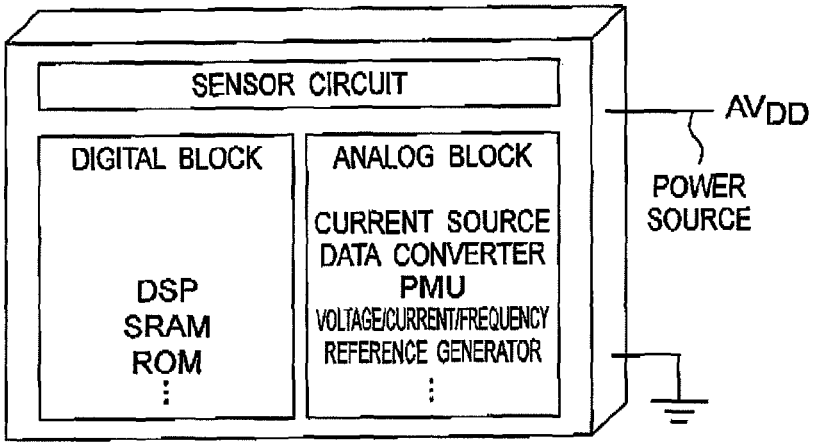
Fig.1 PRIOR ART
FIG. 1 is a block diagram of a very low power smart sensor LSI according to a prior art.
Figure 2A:
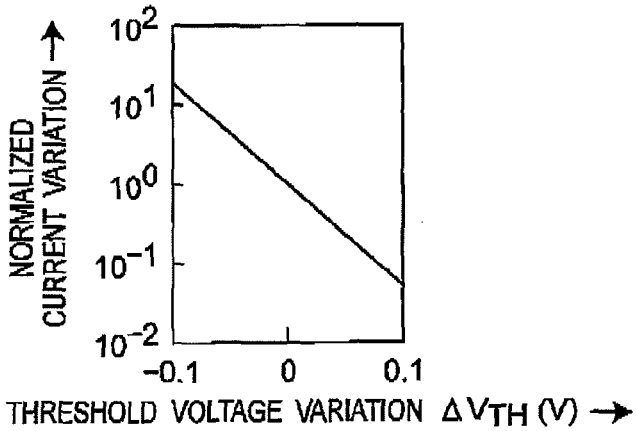
FIG. 2A is a graph for explaining problems of a subthreshold region operation of a subthreshold CMOS circuit, the graph showing a normalized current variation with respect to a threshold voltage variation $\Delta V_{TH}$.
Figure 2B:
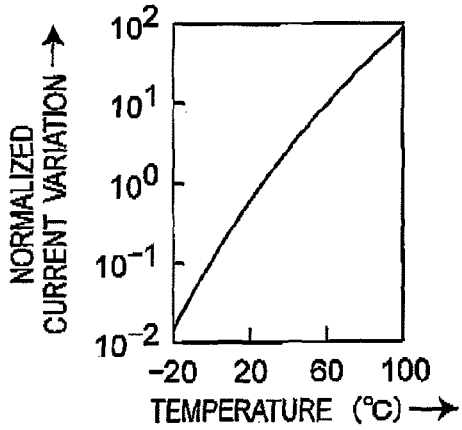
FIG. 2B is a graph for explaining problems of the subthreshold region operation of the subthreshold CMOS circuit, the graph showing the normalized current variation with respect to a temperature change.

FIGS. 2A and 2B are graphs for explaining problems of the subthreshold region operation of the subthreshold CMOS circuit. FIG. 2A is a graph showing one example of a normalized current variation with respect to a threshold voltage variation $\Delta V_{TH}$, and FIG. 2B is a graph showing one example of the normalized current variation with respect to a temperature change. As apparent from FIGS. 2A and 2B, it can be confirmed that the subthreshold current fluctuates exponentially with respect to the threshold voltage variation and the temperature change.

Figure 3:
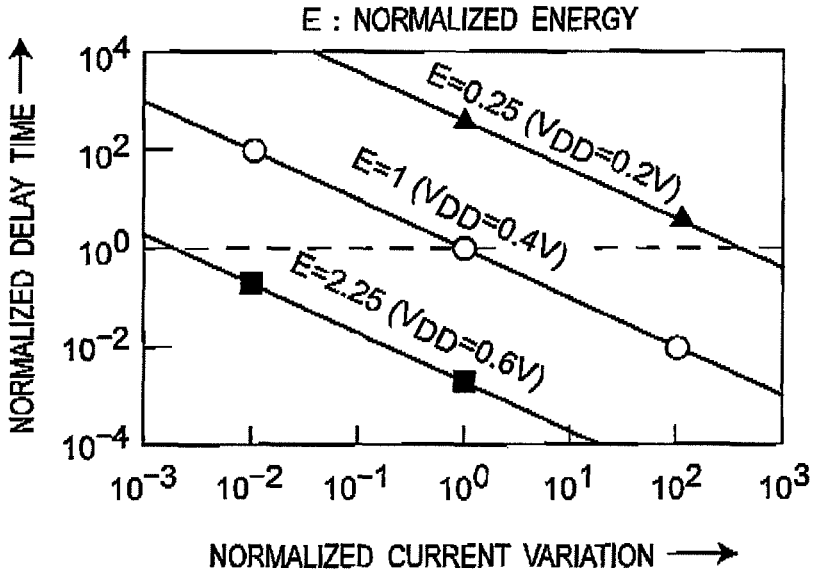
FIG. 3 is a graph showing a correlation between the normalized current variation and a normalized delay time in the subthreshold CMOS circuit.

FIG. 3 is a graph showing a correlation between the normalized current variation and a normalized delay time in the subthreshold CMOS circuit, and showing influences of the current and the delay variation at the same energy ($E=CV_{DD}^2$: C is a capacitance). As apparent from FIG. 3, if a certain delay time constraint (a dashed line) is assumed, it can be understood that the delay time constraint is almost satisfied because of a design conforming to a delay time at the worst amount of current ($10^{-3}$) in the case of a high energy line (E=2.25), but almost all of the entire energy is wasted in a state of a large amount of current, as compared with the case of a low energy line (E=0.25). Namely, it can be understood that it is required to control the current and the delay time in order to satisfy both of the delay time constraint and low power consumption (low energy).

Next, a delay variation correcting circuit according to the first embodiment of the present invention is described. Assuming variations in the respective parameters, a delay variation $\Delta\tau/\tau$ is expressed by the following equation according to the above Equation (1) and the Equation (2):

$$\begin{aligned}\frac{\Delta\tau}{\tau} &= \frac{1}{\tau}\sum_{\Delta P_i}\frac{\partial\tau}{\partial P_i}\Delta P_i \\ &= \frac{2\Delta L}{L} + \frac{\Delta V_{DD}}{V_{DD}} - \frac{\Delta V_{DD}}{\eta V_T} - \frac{I_P}{I_P + I_N}\left(\frac{\Delta\mu_N}{\mu_N} - \frac{\Delta V_{THN}}{\mu V_T}\right) - \\ &\quad \frac{I_N}{I_P + I_N}\left(\frac{\Delta\mu_P}{\mu_P} - \frac{\Delta V_{THP}}{\mu V_T}\right)\end{aligned} \tag{3}$$

where $\Delta P_i$ is a variation from a typical value of each parameter. It is assumed that a channel length variation ($\Delta L/L$) and a mobility variation ($\Delta\mu_N/\mu_N$, $\Delta\mu_p/\mu_p$) can be ignored since they are sufficiently smaller than the other parameters in the above equation. In this case, the typical value means a typical value (a representative value or an exemplar value) of each parameter estimated for a device manufactured by a predetermined semiconductor processes, and is approximately an average value of a maximum value and a minimum value.

By ignoring the channel length variation and the mobility variation, the Equation (3) can be approximated by the following equation:

$$\frac{\Delta\tau}{\tau} = \frac{\Delta V_{DD}}{V_{DD}} - \frac{\Delta V_{DD}}{\eta V_T} + \frac{w\Delta V_{THN} + (1-w)\Delta V_{THP}}{\eta V_T}, \tag{4}$$

where w in the equation is a weight coefficient expressed by the following equation:

$$w = \frac{I_P}{I_N + I_P} = \frac{1}{1 + \frac{K_N I_{0N}}{K_P I_{0P}} \exp\left(\frac{V_{THP} - V_{THN}}{\eta V_T}\right)}. \quad (5)$$

According to the above Equation (3) and the Equation (4), it can be understood that the delay variation ($\Delta\tau/\tau$) depends on a power supply voltage variation, the threshold voltage variation ($\Delta V_{THN}$, $\Delta V_{THP}$), and the weight coefficient w determined by a threshold voltage difference ($V_{THP}-N_{THN}$) of typical values.

In order to correct the delay variation of the subthreshold CMOS circuit, a power supply voltage controlling method is used. According to the Equation (4), it can be understood that the delay variation becomes zero, i.e., $\Delta\tau/\tau=0$ by controlling the power supply voltage to change by $\Delta V_{DD}$ of the following Equation (6):

$$\Delta V_{DD} = \frac{V_{DD}}{V_{DD} - \eta V_T}\{w\Delta V_{THN} + (1 - w)\Delta V_{THP}\}. \quad (6)$$

In addition, $V_{DD}/(V_{DD}-\eta V_T)$ can be regarded to be nearly one since $\eta V_T \ll V_{DD}$, and therefore, the Equation (6) can be approximated by the following equation:

$$\Delta V_{DD} = w\Delta V_{THN} + (1-w)\Delta V_{THP} \quad (7).$$

The Equation (7) indicates that the delay variation can be corrected by reflecting the threshold voltage variations of the nMOSFET and the pMOSFET weighted by w and (1−w) onto the power supply voltage.

According to the Equation (5), it can be understood that the weight coefficient w depends on the threshold voltage difference between the typical value of the pMOSFET and the typical value of the nMOSFET. Namely, the weight coefficient w can be controlled by the typical values of the threshold voltages.

A subthreshold digital CMOS circuit 2 is constituted by, for example, a plurality of CMOS inverter circuits connected in cascade, and the CMOS inverter circuits are also called a digital gate circuits. A delay time of the CMOS inverter circuit is determined by charge and discharge currents of an nMOSFET and a pMOSFET of the components constituting the CMOS inverter. An electrical charge of an output is discharged by a current of the nMOSFET, and a fall time is determined. An electrical charge of an output is charged by a current of the pMOSFET, and a rise time is determined. A delay time per stage of the digital gate circuits is determined by an average of the rise time and the fall time. In this case, the weight coefficient w of Equation (5), which determines the delay time, indicates a proportion of the delay time of the digital gate circuit determined by the rise time of the pMOSFET. In addition, the weight coefficient 1−w indicates a proportion of the delay time determined by the fall time of the nMOSFET. The fact that the weight coefficient w becomes zero means that the delay time of the gate circuit is determined only by the pMOSFET. On the other hand, the fact that the weight coefficient w becomes one means that the delay time of the gate circuit is determined only by the nMOSFET.

Figure 4:
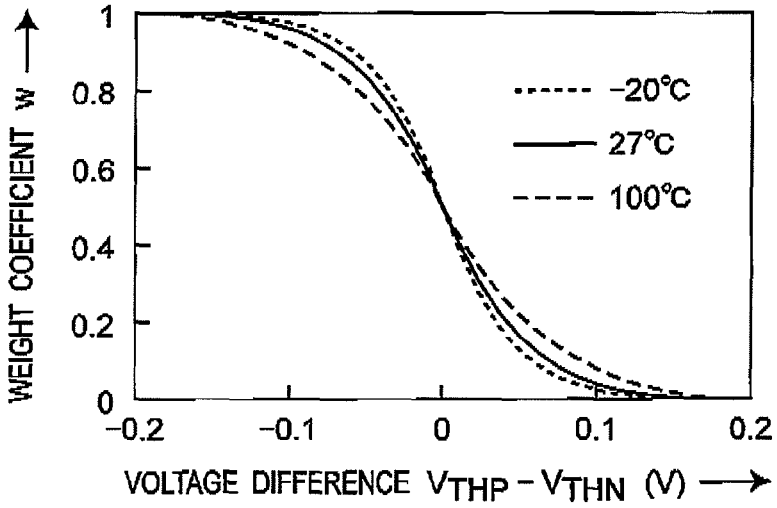
FIG. 4 is a graph showing calculated values of a weight coefficient w with respect to a threshold voltage difference ($V_{THP}-V_{THN}$) in the subthreshold CMOS circuit.

FIG. 4 is a graph showing calculated values of the weight coefficient w with respect to the threshold voltage difference ($V_{THP}-V_{THN}$) when $K_n I_{0n}=K_P I_{0P}$. According to FIG. 4, the weight coefficient w approaches zero when the threshold voltage difference between the pMOSFET and the nMOSFET is larger than 0.1 V ($V_{THP}-V_{THN}>0.1$ V). On the other hand, the weight coefficient w approaches one when the threshold voltage difference between the pMOSFET and the nMOSFET is smaller than −0.1 V ($V_{THP}-V_{THN}<-0.1$ V). Namely, when an absolute value $|V_{THP}-V_{THN}|$ of the difference between $V_{THP}$ and $V_{THN}$ of the typical values is equal to or larger than 0.1 V, only a MOSFET having the higher threshold voltage can determine the delay time and the delay variation. It is noted that, when the threshold voltage $V_{TH}$ is, for example, 0.5 V, it is preferable that 0.5 V>$V_{THP}-V_{THN}>0.1$ V in the former case, and −0.5 V<$V_{THP}-V_{THN}<-0.1$ V in the latter case.

For the above reasons, the Equation (7) can be expressed by the following equations. Therefore, it can be understood that the delay variation can be corrected by monitoring only the threshold voltage variation of the MOSFET having the higher threshold voltage of the typical value and by reflecting a monitoring signal including monitoring results on the power supply voltage of the subthreshold CMOS circuit.

$$\Delta V_{DD} = \Delta V_{THP}, \ (V_{THP} - V_{THN} > 0.1\,V) \quad (8), \text{ and}$$

$$\Delta V_{DD} = \Delta V_{THN}, \ (V_{THP} - V_{THN} < -0.1\,V) \quad (9).$$

However, there also exists such a process in which the threshold voltage values of the nMOSFET and the pMOSFET of the typical values are nearly equal to (i.e., substantially the same as) each other. In such a case, a high-threshold voltage (HVT) device (having a threshold voltage higher than that of an ordinary MOSFET) and a low-threshold voltage (LVT) device (having a threshold voltage lower than that of the ordinary MOSFET) are employed. For example, the LVT device is used as the nMOSFET, and the HVT device is used as the pMOSFET. With this arrangement, only a threshold voltage variation of the pMOSFET of the HVT device having the high threshold voltage is monitored. In this case, the subthreshold CMOS digital circuit is constituted by using the LVT device as the nMOSFET and using the HVT device as the pMOSFET. Otherwise, the HVT device is used as the nMOSFET, and the LVT device is used as the pMOSFET. With this arrangement, only the threshold voltage variation of the nMOSFET of the HVT device having the high threshold voltage is monitored. In this case, the subthreshold CMOS digital circuit is constituted by using the HVT device as the nMOSFET and using the LVT device as the pMOSFET. In the following descriptions, a p-type high threshold voltage will be referred to as a p-HVT device, an n-type high threshold voltage will be referred to as an n-HVT device, a p-type low threshold voltage will be referred to as a p-LVT device, and an n-type low threshold voltage will be referred to as an n-LVT device.

In addition, it is acceptable to perform a control so as to control a substrate voltage of one of the nMOSFET and the pMOSFET by substrate bias control so that the threshold voltages of the typical values have a difference voltage of equal to or larger than 0.1 V previously.

Figure 5:
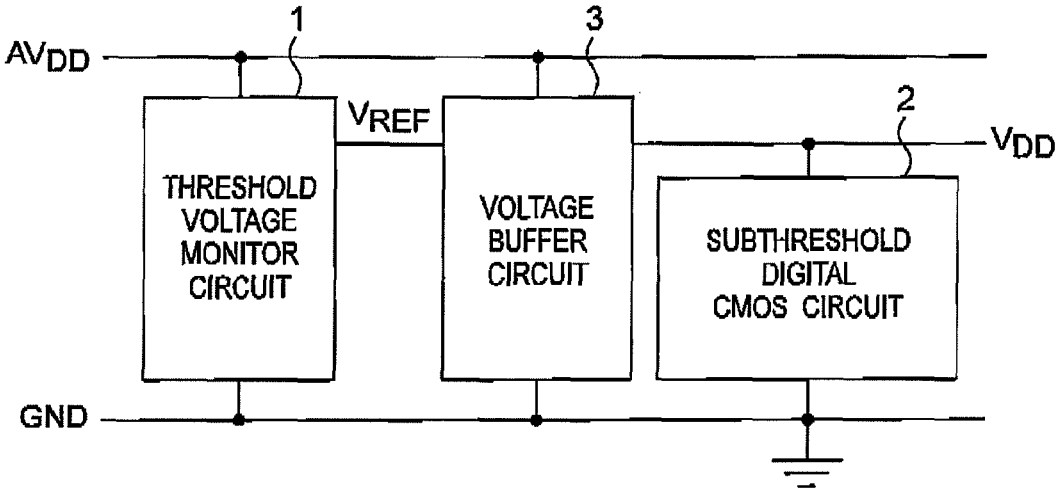
FIG. 5 is a block diagram showing a configuration of a delay variation correcting circuit for a subthreshold digital CMOS circuit according to a first embodiment of the present invention.

Next, FIG. 5 shows a circuit architecture of the delay variation correcting circuit of the subthreshold CMOS circuit according to the first embodiment of the present invention. The delay variation correcting circuit is configured to include a threshold voltage monitor circuit 1, a voltage buffer circuit 3, and the subthreshold digital CMOS circuit 2. The threshold voltage monitor circuit 1 can correct the delay variation by monitoring on-chip the threshold voltage $V_{TH}$ of the MOSFET based on a power supply voltage $AV_{DD}$ of a power supply unit, and by reflecting its controlled output voltage $V_{REF}$ on a power supply voltage $V_{DD}$ of the subthreshold CMOS circuit 2 via the voltage buffer circuit 3. In the delay variation correcting circuit of FIG. 5, it is possible to supply the power supply voltage $V_{DD}$, which is a power supply voltage substantially the same as the controlled output voltage $V_{REF}$ and has a drive current capacity larger than that of the controlled output voltage $V_{REF}$, to the subthreshold digital CMOS circuit 2 by the voltage buffer circuit 3, when the drive current capacity of the controlled output voltage $V_{REF}$ from the threshold voltage monitor circuit 1 is small.

A circuit architecture of the threshold voltage monitor circuit, which is the delay variation correcting circuit of the subthreshold CMOS circuit according to the present invention, is described hereinafter by showing several implemental examples.

First Implemental Example

Figure 6:
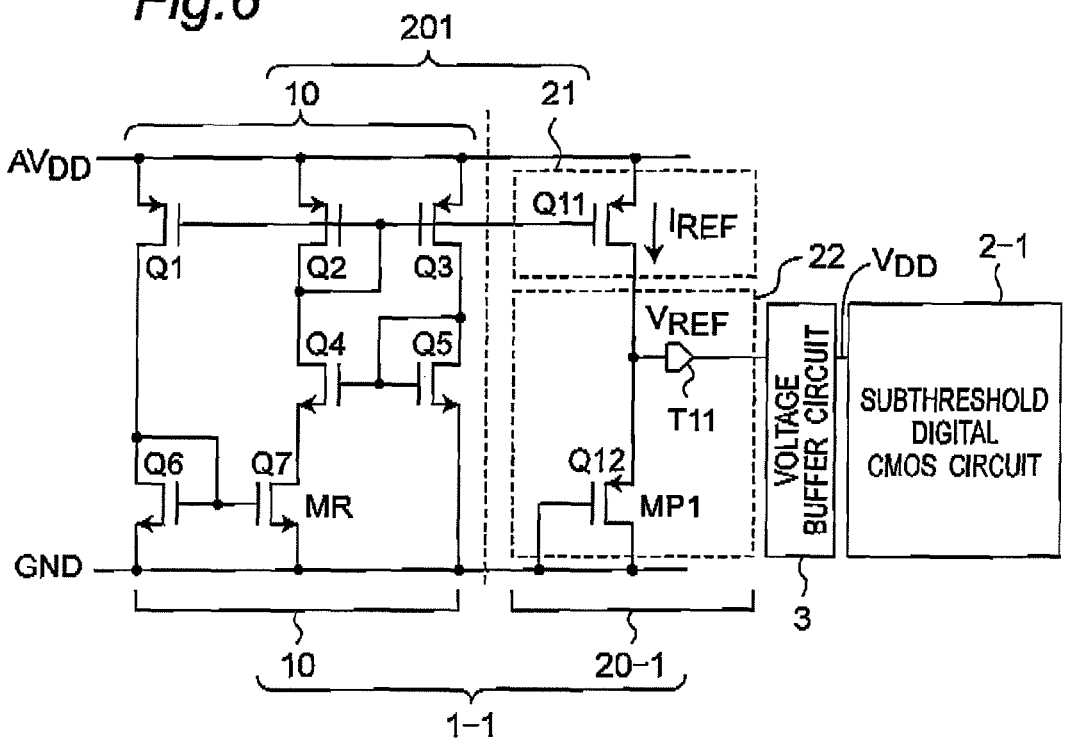
FIG. 6 is a circuit diagram showing a configuration of a first example of the delay variation correcting circuit of FIG. 5.

First of all, in the first implemental example, there is described a threshold voltage monitor circuit applied to a case where the threshold voltage of the typical value of the pMOSFET is higher than that of the nMOSFET (satisfying, for example, the condition: $V_{THP}-V_{THN}>0.1$ V of the Equation (8)) in a MOSFET characteristic of a subthreshold digital CMOS circuit 2-1 to be corrected, i.e., a case where the pMOSFET has a higher threshold voltage of the typical value. FIG. 6 is a circuit diagram showing a configuration of a first example of the delay variation correcting circuit of FIG. 5. It is noted that a startup circuit is omitted in FIG. 6.

As apparent from the circuit block diagram of FIG. 6, a threshold voltage monitor circuit 1-1, i.e., the delay variation correcting circuit for the subthreshold digital CMOS circuit 2-1 supplies a minute current generated from an analog circuit block to a pMOSFET (MP1) Q12 via a current mirror part 21.

The threshold voltage monitor circuit 1-1 of FIG. 6 is configured to include a current source circuit part 10, the current mirror part 21, and a threshold voltage monitor part 22 configured to include the pMOSFET (MP1) Q12. In this case, a threshold voltage monitor circuit part 20-1 is configured to include the current mirror part 21 and the threshold voltage monitor part 22. In this case, the current source circuit part 10 is configured to include pMOSFETs Q1 to Q3 and nMOSFETs Q4 to Q6, each of which operates in the subthreshold region, and a linear MOS resistor (MR) Q7, which operates in a strong inversion linear region and is characterized by generating a substantially constant minute current without depending on the power supply voltage $AV_{DD}$ of the power supply unit. In addition, the current mirror part 21 is configured to include a pMOSFET Q11 and supplies a minute current, which corresponds to a minute current (having a voltage smaller than a threshold voltage $V_{THP,P1}$ and equal to or larger than 0 V) generated by the current source circuit part 10 and is substantially the same as the minute current generated by the current source circuit part 10, to the pMOSFET (MP1) Q12 of the threshold voltage monitor part 22. Therefore, a minute current generator circuit is configured to include the current source circuit part 10 and the current mirror circuit part 21, and a configuration similar to this configuration can be applied to each of FIGS. 7, 8A and 9A. Then, the threshold voltage monitor part 22 is constituted by connecting a gate electrode and a drain electrode of the pMOSFET (MP1) Q12 to the ground, connecting a source electrode of the pMOSFET (MP1) Q12 to a current output terminal of the current mirror part 21, and setting the source electrode of the pMOSFET (MP1) Q12 to a controlled output voltage ($V_{REF}$) terminal.

In this case, a variety of known minute current sources can be utilized to generate a minute current $I_{REF}$. For example, as shown in FIG. 6, when the minute current source is configured to include the MOSFETs Q1 to Q6, each of which operates in the subthreshold region, and the linear MOS resistor (MR) Q7, which operates in the strong inversion linear region, the minute current $I_{REF}$ is expressed as $I_{REF}=n^2\mu C_{OX}K_R V_T^2 K_{eff}$. In this case, n represents a correction term ($n=\beta_{lin}/\beta_{sat}$) in a low drain voltage region, $K_R$ represents an aspect ratio of a transistor, and $K_{eff}$ represents a coefficient determined by an aspect ratio of a MOSFET which constitutes the CMOS circuit.

In this case, the minute current $I_{REF}$ does not include any term of the threshold voltage, and therefore, the minute current $I_{REF}$ has a tolerance to the threshold voltage variation. In the threshold voltage monitor circuit 1-1 configured to include the pMOSFET Q12 (MP1 of FIG. 6) Q12, the controlled output voltage $V_{REF}$, which is a gate-source voltage $V_{GS,P1}$ of the pMOSFET (MP1 of FIG. 6) Q12, is to be generated by applying the minute current $I_{REF}$ via the current mirror part 21. The controlled output voltage $V_{REF}$ is expressed by the following equation:

$$V_{REF} = V_{GS,P1} = V_{THP,P1} + \eta V_T \ln\left(\frac{I_{REF}}{K_{P1} I_0}\right). \tag{10}$$

According to the Equation (10), it can be understood that the controlled output voltage $V_{REF}$ is expressed by a sum of the threshold voltage $V_{THP,P1}$ (the first term) of the pMOSFET (MP1) Q12 and the thermal voltage adjusted by a logarithmic function (the second term). Since the minute current $I_{REF}$ generated from the minute current source has a tolerance to the threshold voltage variation, the second term of the right side of the Equation (10) becomes stable against the process variation. In addition, it is possible to suppress a random variation in the threshold voltage of the pMOSFET (MP1) Q12 by enlarging the size of the MOSFET. For the above reasons, since the controlled output voltage $V_{REF}$ of the threshold voltage monitor circuit part 20-1 includes the term of the threshold voltage and changes according to the temperature, it is possible to monitor the state of the threshold voltage of the pMOSFET (MP1) Q12 by using the threshold voltage monitor circuit 1-1.

Further, the power supply voltage $V_{DD}$ is expressed by the following equation (11) according to the Equation (10) in the circuit of FIGS. 5 and 6:

$$V_{DD}=V_{REF}=V_{THP,P1}+\Delta V_{THP,P1} \tag{11}.$$

Namely, by monitoring the state of the threshold voltage $V_{THP,P1}$ of the pMOSFET (MP1) Q12 and controlling the controlled output voltage $V_{REF}$ corresponding to the power supply voltage $V_{DD}$ so that the controlled output voltage $V_{REF}$ changes in correspondence with a fluctuation amount $\Delta V_{THP,P1}$ of the threshold voltage $V_{THP,P1}$, the correction is achieved so that the delay time approaches the typical value and the delay variation becomes substantially zero. Therefore, the threshold voltage monitor circuit 1-1 constitutes a power supply voltage controlling circuit since the threshold voltage monitor circuit 1-1 generates the controlled output voltage $V_{REF}$ by controlling the power supply voltage $V_{DD}$ so that the delay time approaches the typical value and the delay variation becomes substantially zero.

Second Implemental Example

The threshold voltage monitor circuit 1-1 for the subthreshold digital CMOS circuit 2-1 of the first implemental example described above is a circuit to be applied to a case where the threshold voltage of the typical value of the pMOSFET is higher than that of the nMOSFET (satisfying, for example, the condition: $V_{THP}-V_{THN}>0.1$ V of the Equation (8)) in the MOSFET characteristic of the subthreshold digital CMOS circuit 2-1 to be corrected, i.e., a case where the pMOSFET has the higher threshold voltage of the typical value.

Figure 7:
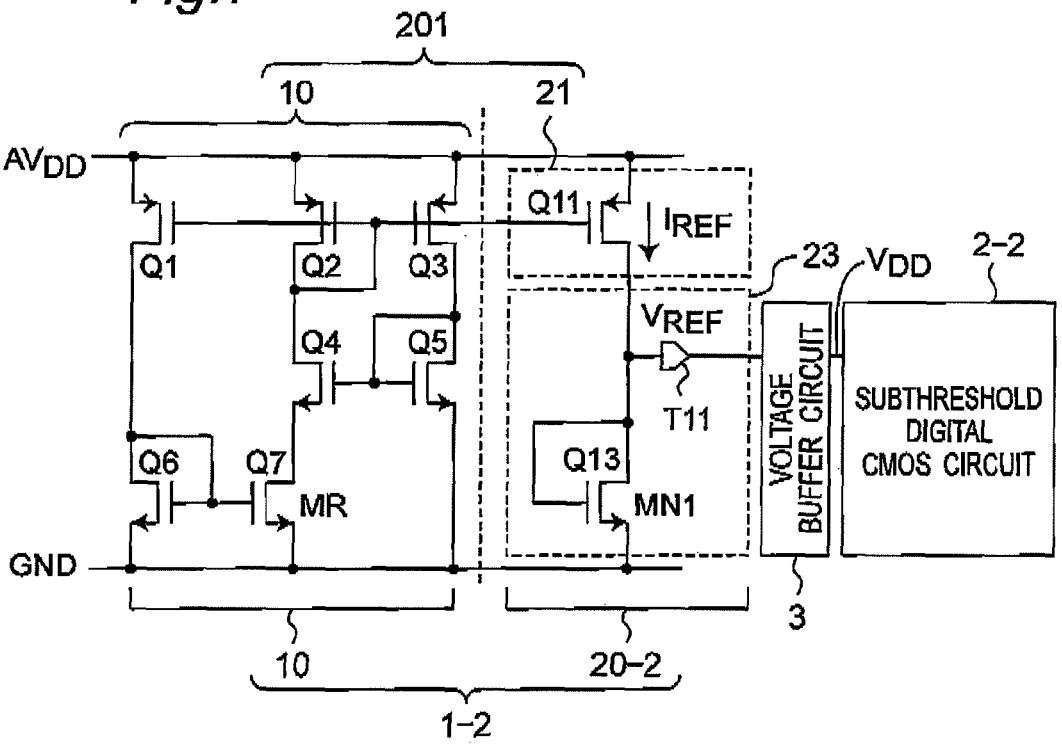
FIG. 7 is a circuit diagram showing a configuration of a second example of the delay variation correcting circuit of FIG. 5.

In contrast to this, a threshold voltage monitor circuit 1-2 becomes a circuit as shown in FIG. 7 when the threshold voltage of the typical value of the nMOSFET is higher than that of the pMOSFET (satisfying, for example, the condition: $V_{THP}-V_{THN}<-0.1$ V of the Equation (9)) in the MOSFET characteristic of a subthreshold digital CMOS circuit 2-2 to be corrected, i.e., a case where the nMOSFET has the higher threshold voltage of the typical value.

The threshold voltage monitor circuit 1-2 of the second implemental example shown in FIG. 7 is configured to include the current source circuit part 10, the current mirror part 21, and a threshold voltage monitor part 23 configured to include an nMOSFET (MN1 of FIG. 7) Q13. In this case, a threshold voltage monitor circuit part 20-2 is configured to include the current mirror part 21 and the threshold voltage monitor part 23. In this case, the current source circuit part 10 is configured in a manner similar to that of FIG. 6. In addition, the current mirror circuit part 21 is configured to include the pMOSFET Q11 in a manner similar to that of FIG. 6. Then, the threshold voltage monitor part 23 is constituted by connecting a source electrode of the nMOSFET (MN1) Q13 of the threshold voltage monitor part 23 to the ground, connecting a gate electrode and a drain electrode of the nMOSFET (MN1) Q13 to the current output terminal of the current mirror part 21, and setting the gate electrode and the drain electrode of the nMOSFET (MN1) Q13 to the controlled output voltage ($V_{REF}$) terminal.

In the second implemental example configured as described above, by monitoring the state of a threshold voltage $V_{THP,N1}$ of the nMOSFET (MN1) Q13 and controlling the controlled output voltage $V_{REF}$ corresponding to the power supply voltage $V_{DD}$ so that the controlled output voltage $V_{REF}$ changes in correspondence with a fluctuation amount $\Delta V_{THP,N1}$ of the threshold voltage $V_{THP,N1}$, the correction is achieved so that the delay time approaches the typical value and the delay variation becomes substantially zero. Therefore, the threshold voltage monitor circuit 1-2 constitutes a power supply voltage controlling circuit since the threshold voltage monitor circuit 1-2 generates the controlled output voltage $V_{REF}$ by controlling the power supply voltage $V_{DD}$ so that the delay time approaches the typical value and the delay variation becomes substantially zero.

Third Implemental Example

Next, in the threshold voltage monitor circuit of the subthreshold CMOS circuit, there is described a circuit for correcting a delay variation of a circuit, which employs a high threshold voltage device (an HVT device) and a low threshold voltage device (an LVT device) in the case of a process, in which the threshold voltage of the nMOSFET and the threshold voltage of the pMOSFET are nearly equal to each other.

Figure 8A:
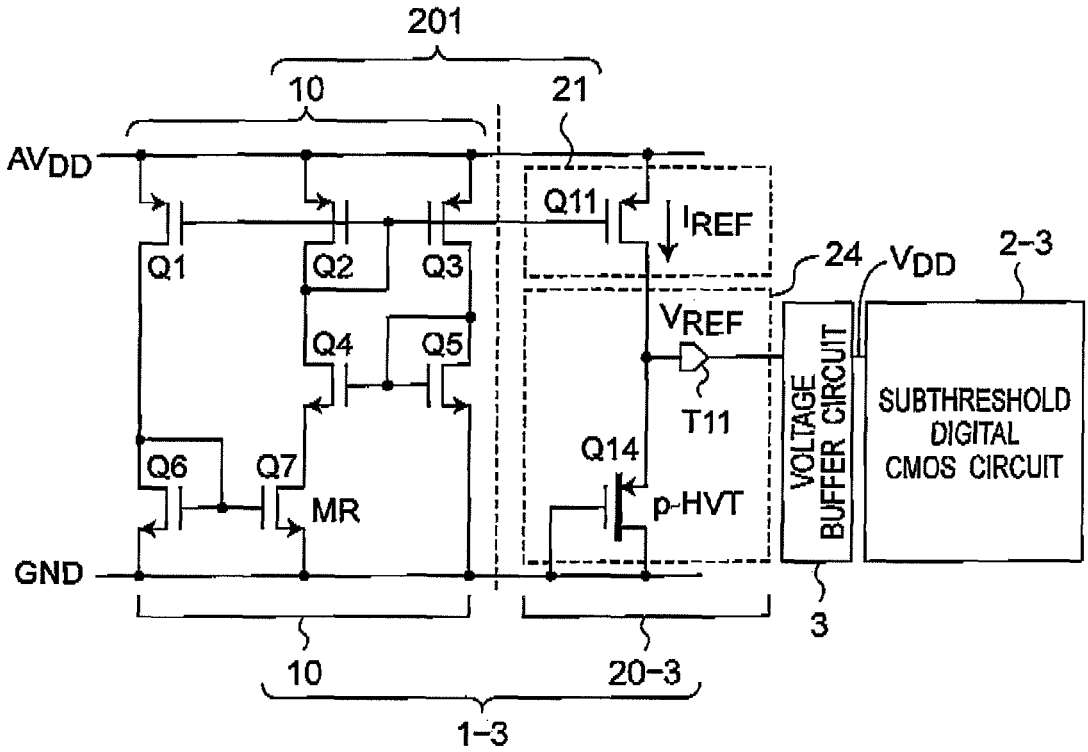
FIG. 8A is a circuit diagram showing a configuration of a third example of the delay variation correcting circuit of FIG. 5.

A threshold voltage monitor circuit 1-3 of the third implemental example shown in FIG. 8A is a circuit applied to a case where the threshold voltage of the typical value of the pMOSFET is higher than that of the nMOSFET (satisfying, for example, the condition: $V_{THP}-V_{THN}>0.1$ V of the Equation (8)) in a subthreshold digital CMOS circuit 2-3, i.e., a case where the pMOSFET has the higher threshold voltage of the typical value.

The threshold voltage monitor circuit of the third implemental example shown in FIG. 8A is configured to include the current source circuit part 10, the current mirror part 21, and a threshold voltage monitor part 24 configured to include a pMOSFET of the HVT device (p-HVT of FIG. 8A) Q14. In this case, a threshold voltage monitor circuit part 20-3 is configured to include the current mirror part 21 and the threshold voltage monitor part 24. In this case, the current source circuit part 10 is configured in a manner similar to that of each of the FIGS. 6 and 7. In addition, the current mirror part 21 is configured to include the pMOSFET Q11 in a manner similar to that of each of the FIGS. 6 and 7. Then, the threshold voltage monitor part 24 is constituted by connecting a source electrode of the pMOSFET (p-HVT) Q 14 of the threshold voltage monitor part 24 to the current output terminal of the current mirror part 21, connecting a gate electrode and a drain electrode of the pMOSFET (p-HVT) Q14 to the ground, and setting the source electrode of the pMOSFET (p-HVT) Q14 to the controlled output voltage ($V_{REF}$) terminal.

Figure 8B:
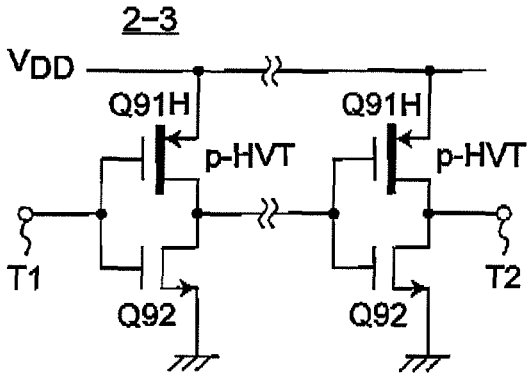
FIG. 8B is a circuit diagram showing one example of a subthreshold digital CMOS circuit 2-3 of FIG. 8A.

FIG. 8B is a circuit diagram showing one example of the subthreshold digital CMOS circuit 2-3 of FIG. 8A. The one example of the circuit 2-3 shows one example when the threshold voltage of the typical value of the pMOSFET is higher than that of the nMOSFET (satisfying, for example, the condition: $V_{THP}-V_{THN}>0.1$ V of the Equation (8)) in the case of the process, in which the threshold voltage of the nMOSFET and the threshold voltage of the pMOSFET are nearly equal to each other. A plurality of inverters, each of which is configured to include a pMOSFET Q91H of a p-HVT device and an nMOSFET Q92, are connected in cascade between a terminal T1 and a terminal T2. In this case, the nMOSFET Q92 may be an ordinary nMOSFET or an n-LVT device.

In the third implemental example configured as described above, by monitoring a state of a threshold voltage $V_{THP,P1}$ of the pMOSFET (p-HVT of FIG. 8A) Q14 and controlling the controlled output voltage $V_{REF}$ corresponding to the power supply voltage $V_{DD}$ so that the controlled output voltage $V_{REF}$ changes in correspondence with the fluctuation amount $\Delta V_{THP,P1}$ of the threshold voltage $V_{THP,P1}$, the correction is achieved so that the delay time approaches the typical value and the delay variation becomes substantially zero. Therefore, the threshold voltage monitor circuit 1-3 constitutes a power supply voltage controlling circuit since the threshold voltage monitor circuit 1-3 generates the controlled output voltage $V_{REF}$ by controlling the power supply voltage $V_{DD}$ so that the delay time approaches the typical value and the delay variation becomes substantially zero.

Fourth Implemental Example

According to the fourth implemental example, in a manner similar to that of the above-described third implemental example, in a threshold voltage monitor circuit 1-4 of a subthreshold CMOS circuit 2-4, there is described a circuit for correcting a delay variation of a circuit, which employs a high threshold voltage device (an HVT device) and a low threshold voltage device (an LVT device) in the case of the process; in which the threshold voltage of the nMOSFET and the threshold voltage of the pMOSFET are nearly equal to each other.

Figure 9A:
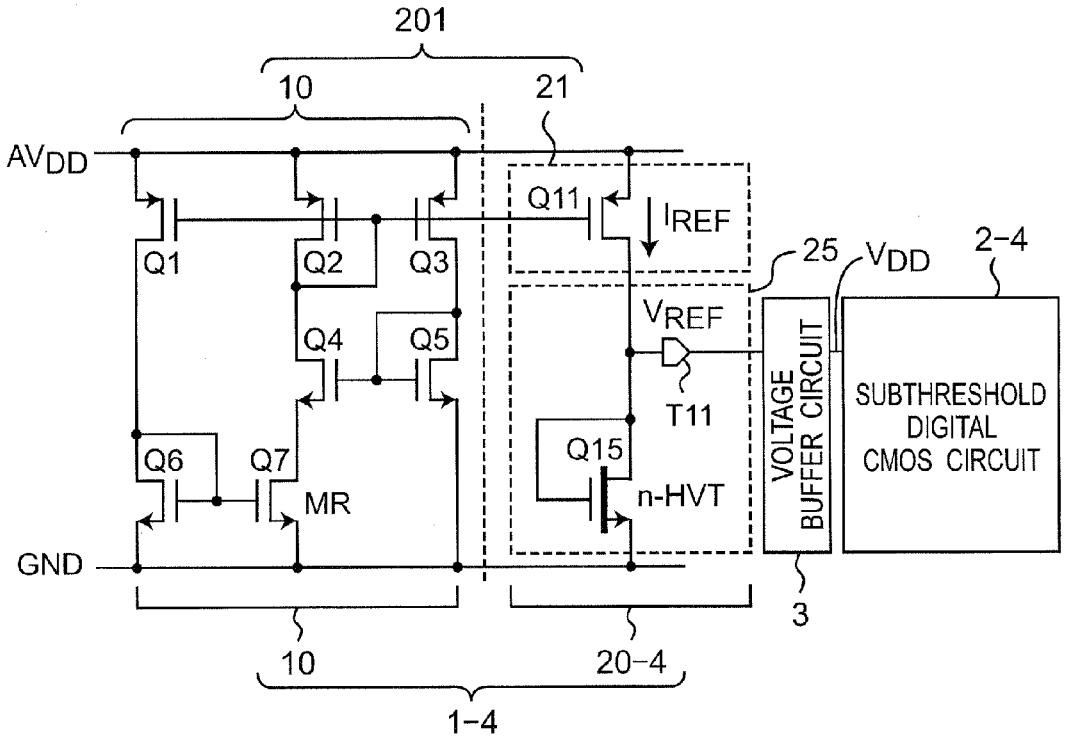
FIG. 9A is a circuit diagram showing a configuration of a fourth example of the delay variation correcting circuit of FIG. 5.

The threshold voltage monitor circuit 1-1 of the fourth implemental example shown in FIG. 9A is a circuit applied to a case where the threshold voltage of the typical value of the nMOSFET is higher than that of the pMOSFET (satisfying, for example, the condition: $V_{THP}-V_{THN}<-0.1$ V of the Equation (9)) in the subthreshold digital CMOS circuit 2-4, i.e., a case where the nMOSFET has the higher threshold voltage of the typical value.

The threshold voltage monitor circuit of the fourth implemental example shown in FIG. 9A is configured to include the current source circuit part 10, the current mirror part 21, and an nMOSFET of the HVT device (n-HVT of FIG. 9A). Then, a threshold voltage monitor part 25 is constituted by connecting a source electrode of the nMOSFET (n-HVT) to the ground, connecting a gate electrode and a drain electrode of the nMOSFET (n-HVT) to the current output terminal of the current mirror part 21, and setting the gate electrode and the drain electrode of the nMOSFET (n-HVT) to the controlled output voltage ($V_{REF}$) terminal.

Figure 9B:
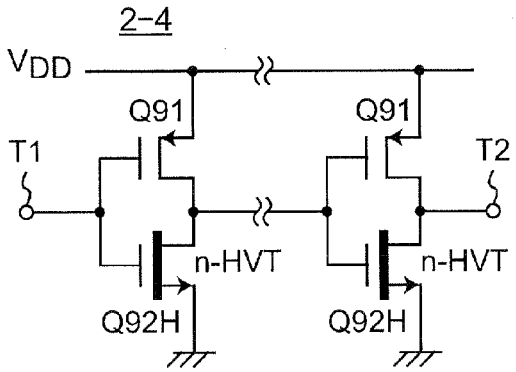
FIG. 9B is a circuit diagram showing one example of a subthreshold digital CMOS circuit 2-4 of FIG. 9A.

FIG. 9B is a circuit diagram showing one example of the subthreshold digital CMOS circuit 2-4 of FIG. 9A. The one example of the circuit 2-4 shows one example when the threshold voltage of the typical value of the nMOSFET is higher than that of the pMOSFET in the case of the process, in which the threshold voltage of the nMOSFET and the threshold voltage of the pMOSFET are nearly equal to each other. A plurality of inverters, each of which is configured to include a pMOSFET Q91 and an nMOSFET Q92H of an n-HVT device, are connected in cascade between the terminal T1 and the terminal T2. In this case, the pMOSFET Q91 may be an ordinary pMOSFET or a p-LVT device.

The threshold voltage monitor circuit 1-4 of the fourth embodiment constitutes a power supply voltage controlling circuit since the threshold voltage monitor circuit 1-4 generates the controlled output voltage $V_{REF}$ by controlling the power supply voltage $V_{DD}$ so that the delay time approaches the typical value and the delay variation becomes substantially zero in a manner similar to that of each of the threshold voltage monitor circuits 1-1 to 1-3.

Fifth Implemental Example (Simulation Evaluation of Delay Variation Correcting Circuit)

Next, there are described results of conducting evaluation of performance of the delay variation correcting circuit of the present invention by using simulations. The simulations were conducted using Spectre of Cadence Design Systems, Inc. In addition, used standard CMOS parameters were 0.35-μm. CMOS2P4M process. In addition, used SPICE model of the MOSFET was BSIM3v3 Level53. The threshold voltage of the typical value of the nMOSFET and the threshold voltage of the typical value of the pMOSFET are 0.46 (V) and 0.68 (V), respectively. In addition, the power supply voltage for the analog circuit was set to 3.3 (V).

In this case, since the CMOS process is such that the threshold voltage of the pMOSFET is higher than the threshold voltage of the nMOSFET by 0.1 V or more, it is proper to monitor only the threshold voltage variation of the pMOSFET based on the foregoing discussion. Then, in order to evaluate the influence on the process variation, Monte Carlo simulations were carried out considering a global variation (uniform distribution: $-0.1\ (V) < \Delta V_{TH} < 0.1\ (V)$) and a random variation $$\left(\text{Gaussian distribution: } \sigma_{VTH} = \frac{A_{VTH}}{\sqrt{LW}}\right). \tag{12}$$

Figure 10:
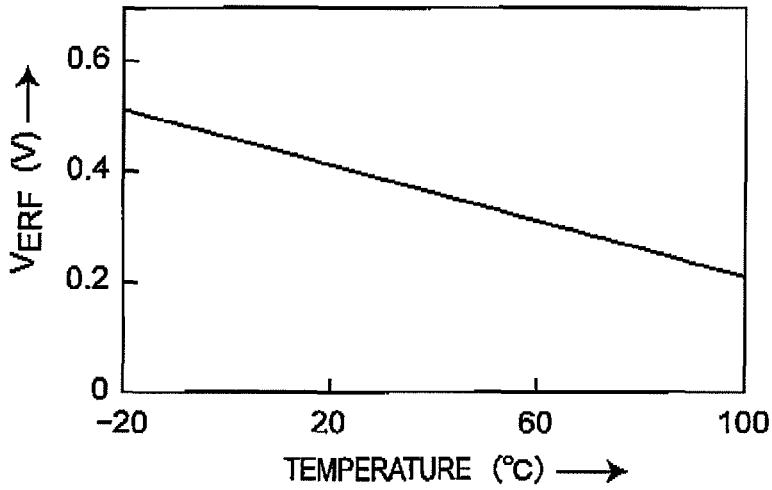
FIG. 10 is a graph showing a correlation of a controlled output voltage $V_{REF}$ to a temperature in the delay variation correcting circuit of FIG. 5.

FIG. 10 shows the controlled output voltage $V_{REF}$ with respect to the temperature of −20 to 100° C. As indicated in the Equation (10), the controlled output voltage $V_{REF}$ includes the terms of the threshold voltage of the pMOSFET and the thermal voltage, and therefore, the output voltage $V_{REF}$ fluctuates according to the temperature. Namely, it can be understood that the controlled output voltage $V_{REF}$ can monitor the variation due to the temperature.

Figure 11A:
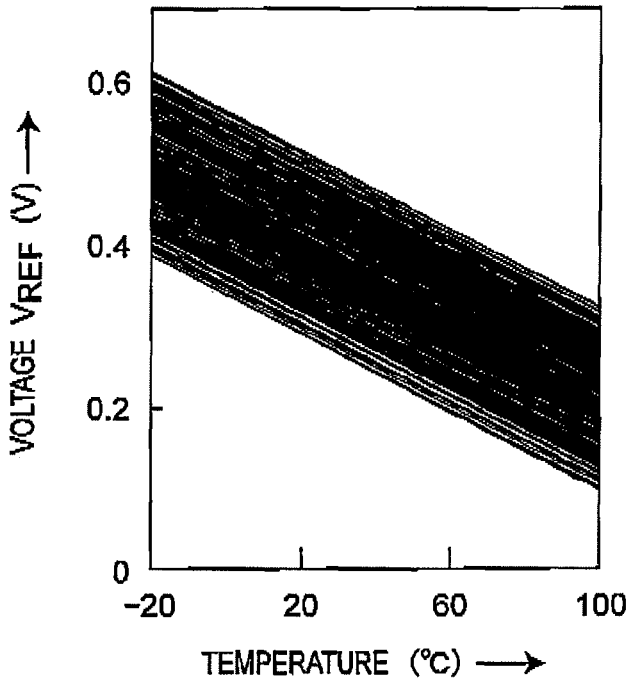
FIG. 11A is a graph showing evaluation results by a Monte Carlo simulation of the delay variation correcting circuit of FIG. 5, where the controlled output voltage $V_{REF}$ is shown with respect to a temperature.
Figure 11B:
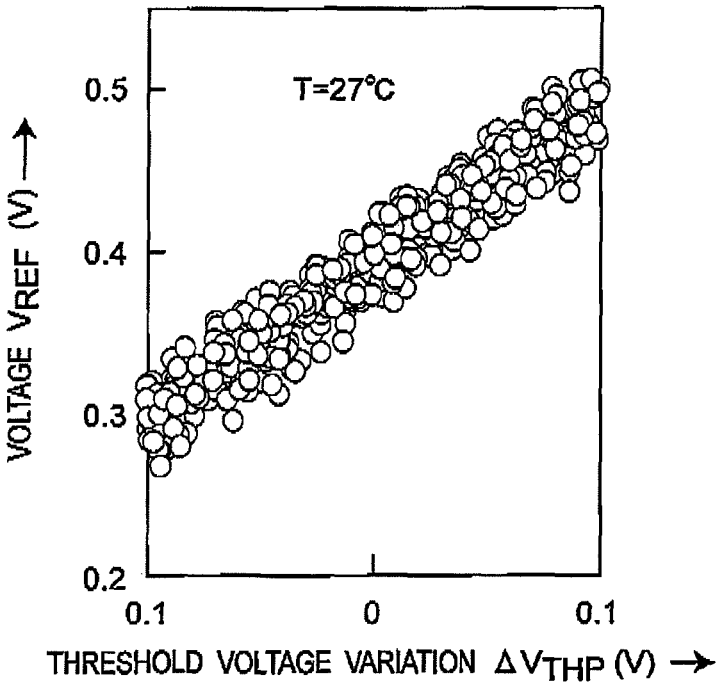
FIG. 11B is a graph showing evaluation results by the Monte Carlo simulation of the delay variation correcting circuit of FIG. 5, where the controlled output voltage $V_{REF}$ is shown with respect to a global variation $\Delta V_{THP}$ in a threshold voltage of a pMOSFET at a room temperature.

FIGS. 11A and 11B show the controlled output voltage $V_{REF}$ when the Monte Carlo simulation was carried out 500 times. FIG. 11A shows the output voltage with respect to the temperature, and each line indicates the results of one of the Monte Carlo simulations. These results are produced by the global variation in the threshold voltage of the pMOSFET and the temperature change. Namely, it can be understood that, since the threshold voltage fluctuates by ±0.1 (V) because of the global variation, the output voltage fluctuates by ±0.1 (V) at a certain temperature.

In addition, it has been known that a temperature coefficient κ of the MOSFET is a parameter stable against the process variation, and it can be confirmed that slopes of the controlled output voltages $V_{REF}$ with respect to the temperature are almost the same as each other in all of the results. FIG. 11B shows a scatter diagram of the output voltage with respect to a global variation $\Delta V_{TH}$ in the threshold voltage of the pMOSFET at a room temperature. Each circle indicates one of the results of the Monte Carlo simulations. The controlled output voltage $V_{REF}$ refers to the threshold voltage of the pMOSFET in the chip according to the Equation (10), and therefore, it can be confirmed that the controlled output voltage $V_{REF}$ fluctuates linearly with respect to the threshold voltage of the pMOSFET. Therefore, the threshold voltage monitor circuit can monitor the state of the pMOSFET with respect to the temperature change in the chip and the process fluctuation.

In order to evaluate the performance of the delay variation correcting circuit shown in FIG. 5, there are described the results of performing the variation correction of an oscillation frequency of a ring oscillator of a five-stage CMOS inverter as an example of the subthreshold CMOS circuit. The oscillation frequency at the typical value was adjusted to be 10 (kHz) at the room temperature, and comparison with an uncorrected case of a fixed power supply voltage $V_{DD}$=400 (mV) was performed.

Figure 12:
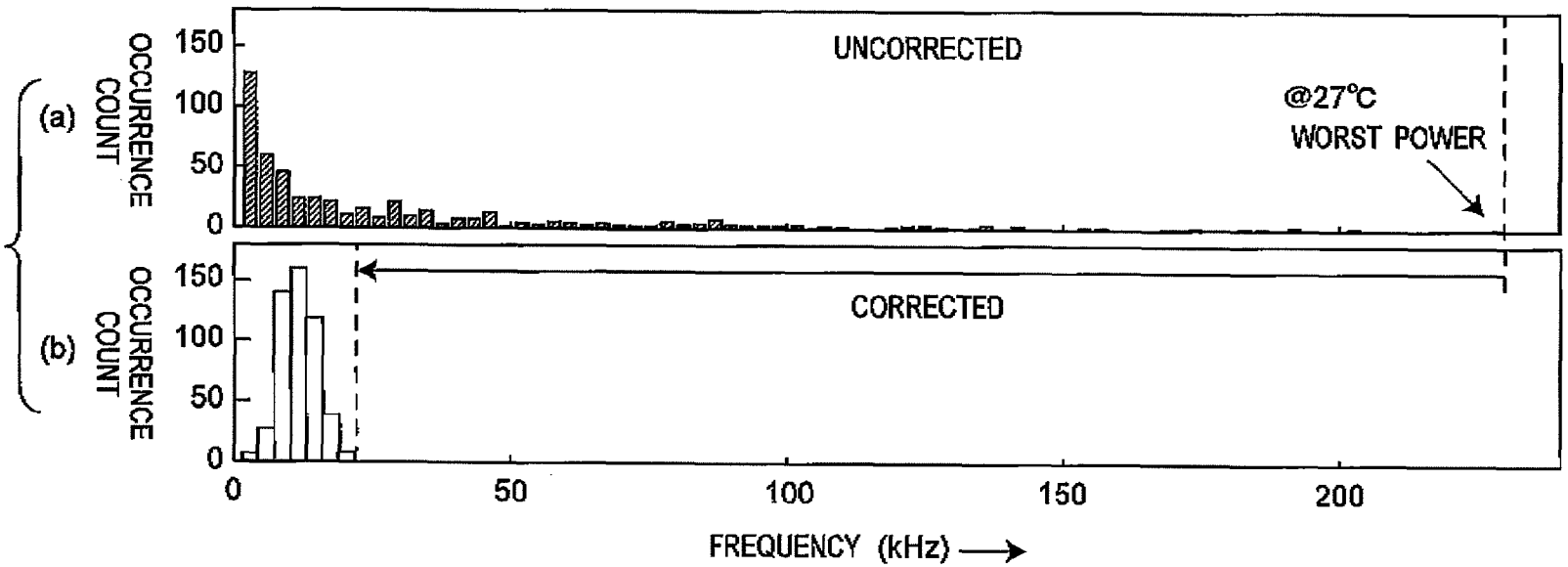
FIG. 12 is a graph showing evaluation results of Monte Carlo simulations with and without correction when the subthreshold digital CMOS circuit is a ring oscillator in the delay variation correcting circuit of FIG. 5, where histograms of an oscillation frequency of the ring oscillator is shown therein.

FIG. 12 shows histograms ((a) uncorrected and (b) corrected) of the oscillation frequency when the Monte Carlo simulation was carried out 500 times at the room temperature. In the uncorrected case (FIG. 12(*a*)), it can be understood that the oscillation frequency varies following the lognormal distribution since a propagation delay of the CMOS inverter follows the lognormal distribution. The oscillation frequency largely fluctuates from 0.357 to 228 (kHz). On the other hand, in the corrected case (FIG. 12(*b*)), the delay variation is remarkably improved, and the oscillation frequency varies following the normal distribution. The oscillation frequency falls within a range of 1.81 to 19.9 (kHz). In the corrected case (FIG. 12(*b*)), a variation coefficient ($\sigma_f/\mu_f$) of the oscillation frequency was 31%. In this case, $\mu_f$ and $\sigma_f$ are an average value and a standard deviation of the oscillation frequency, respectively.

Figure 13:
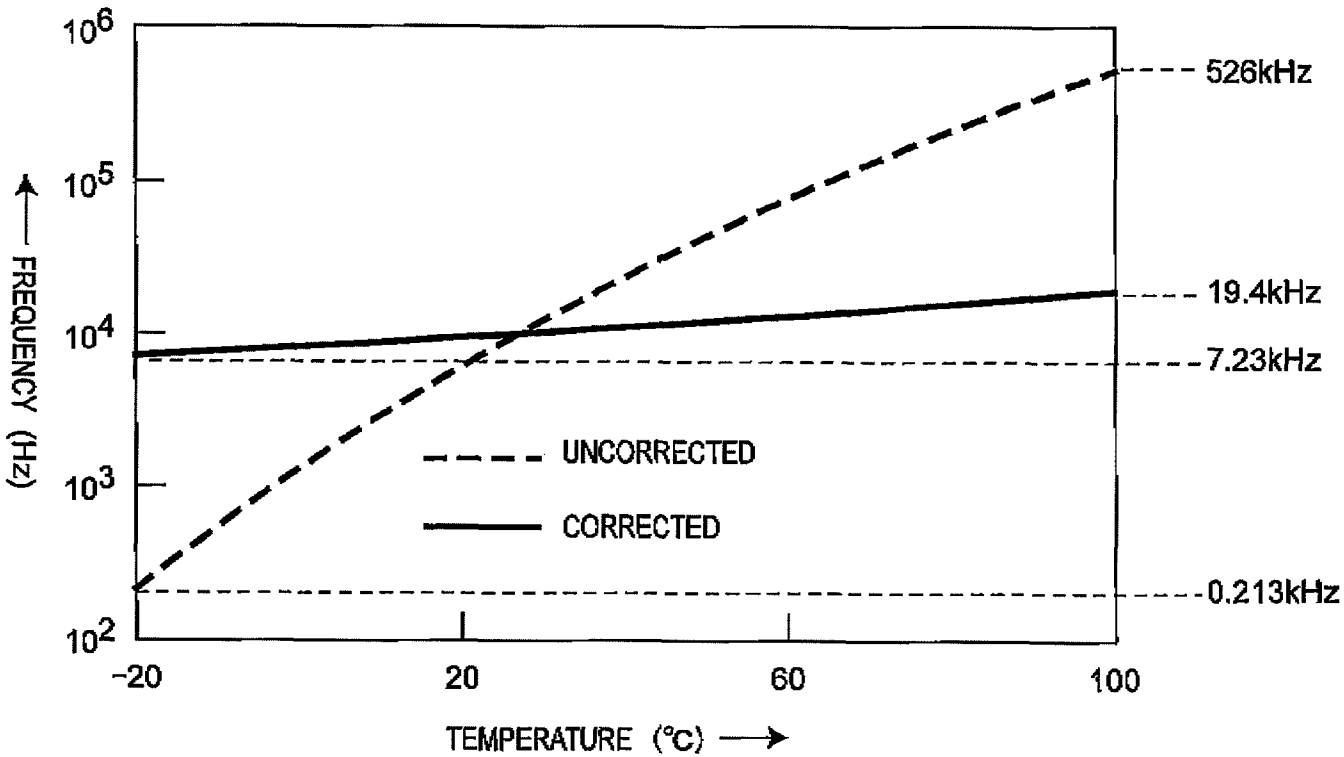
FIG. 13 is a graph showing evaluation results of simulations with and without correction when the subthreshold digital CMOS circuit is the ring oscillator in the delay variation correcting circuit of FIG. 5, where the oscillation frequency of the ring oscillator is shown therein with respect to a temperature.

FIG. 13 shows the oscillation frequencies in the uncorrected case and the corrected case with respect to a temperature of −20 to 100° C. In the uncorrected case, the oscillation frequency largely changes from 0.213 to 526 (kHz). In the corrected case, the fluctuation of the oscillation frequency is remarkably suppressed, and falls within a range of 7.23 to 19.4 (kHz).

Next, in order to evaluate delay variation correction effect and power consumption reduction effect of the CMOS circuit, delay variation correction of an 8-bit ripple carry adder (RCA) was performed. A setting processing time was set to 500 μs and designing was performed so as to satisfy the delay constraint. The uncorrected fixed power supply voltage is 665 (mV). The evaluation was performed by an operation of (00000001)+(11111111), with which a calculation time becomes the worst value.

Figure 14:
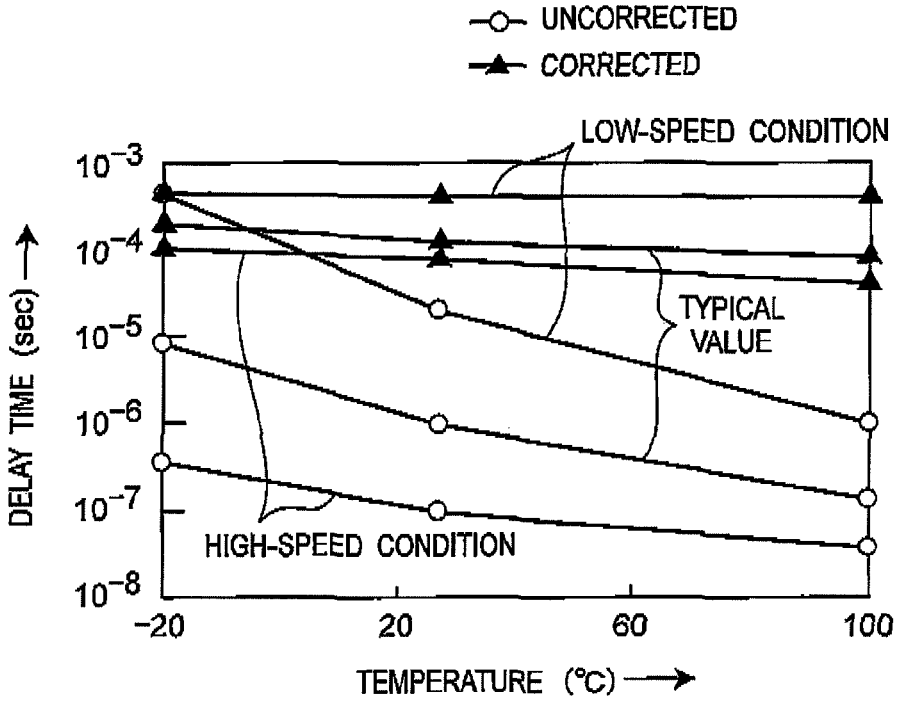
FIG. 14 is a graph showing evaluation results of the Monte Carlo simulations with and without correction when the subthreshold digital CMOS circuit is an 8-bit ripple carry adder (RCA) in the delay variation correcting circuit of FIG. 5, where a delay time of the 8-bit RCA is shown therein with respect to a temperature.

FIG. 14 shows a delay time of the adder when the Monte Carlo simulation was carried out 500 times at the temperatures of −20° C., 27° C. and 100° C. There are shown the delay times of the typical values, the earliest delay times, and the latest delay times obtained by the Monte Carlo simulations in each of the uncorrected case and the corrected case. As shown in FIG. 14, the delay time in the uncorrected case changes from 36.6 (ns) to 432 (μs). On the other hand, the delay time in the corrected case is suppressed within a range of 41.2 (μs) to 443 (μs). The delay constraint is satisfied in all of the results of the uncorrected and corrected cases, however, it can be confirmed that the delay time varies largely in the uncorrected case.

Next, current consumptions in the delay variation corrected case and the delay variation uncorrected case are compared with each other. The current consumptions in the delay variation corrected case and the delay variation uncorrected case are shown in the Table 1 below.

TABLE 1

| | Current Consumption of 8-bit RCA (nA) | |
|---|---|---|
| Temperature (° C.) | Delay Variation Uncorrected | Delay Variation Corrected |
| −20 | 0.755 | 0.626 |
| 27 | 0.821 | 0.557 |
| 100 | 2.49 | 1.79 |

Based on Table 1, it can be understood that the current consumption of the subthreshold CMOS circuit can be reduced by performing the delay variation correction as compared with the uncorrected case, since it is possible to set the power supply voltage to the minimum power supply voltage which satisfies the delay constraint.

The above contents show that it is possible to correct the delay variation by utilizing the threshold voltage difference between the threshold voltage of the typical value of the pMOSFET and the threshold voltage of the typical value of the nMOSFET, monitoring only one threshold voltage, utilizing the output voltage as the power supply voltage of the subthreshold CMOS circuit for correcting the delay variation, and varying the power supply voltage according to the state of the threshold voltage due to the process variation and the temperature change.

In addition, as shown by the results of the simulation evaluation described above, by applying the delay variation correcting circuit of the present invention to the subthreshold CMOS circuit, it is possible to remarkably suppress the delay variation which was following to the lognormal distribution and to suppress the lognormal distribution to the normal distribution. In addition, by applying the delay variation correcting circuit of the present invention to the subthreshold CMOS circuit, the power supply voltage is controlled according to the state of the threshold voltage. This allows the minimum power supply voltage satisfying the delay constraint to be supplied, and this leads to a further reduced power consumption of the subthreshold CMOS circuit as compared with the fixed power supply voltage.

Summary of First Embodiment

The subthreshold CMOS circuit of the first aspect of the present invention has the following circuit structure. The absolute value difference between the threshold voltage of the typical value of the pMOSFET and the threshold voltage of the typical value of the nMOSFET is set to be equal to or larger than 0.1 V. There is provided the threshold voltage monitor circuit for setting the controlled output voltage to the threshold voltage of the MOSFET having the higher threshold voltage of the typical value, and the controlled output voltage of the threshold voltage monitor circuit is supplied to a power line of the subthreshold CMOS circuit. With the above configuration, it is possible to correct the delay variation by reflecting the variations in the threshold voltages of the nMOSFET and the pMOSFET on the power supply voltage of the main body of the subthreshold CMOS circuit. Concretely speaking, only the threshold voltage variation of the MOSFET having the higher threshold voltage of the typical value is monitored, and a monitoring signal including monitoring results is reflected on the power supply voltage of the subthreshold CMOS circuit. For example, when the threshold voltage of the pMOSFET is higher than the threshold voltage of the nMOSFET, only the threshold voltage of the pMOSFET is monitored and the delay variation is corrected.

In this case, it is a necessary condition for monitoring only the threshold voltage of the MOSFET having the higher threshold voltage of the typical value to set the absolute value difference between the threshold voltage of the typical value of the pMOSFET and the threshold voltage of the typical value of the nMOSFET to be equal to or larger than 0.1 V.

In addition, when the consumption current of the digital circuit is low and it is possible to supply the consumption current of the digital circuit by the current of the threshold voltage monitor circuit in a case where the output voltage of the threshold voltage monitor circuit is supplied to the power line of the subthreshold CMOS circuit, the buffer circuit is not necessary.

Preferably, the output voltage of the threshold voltage monitor circuit is supplied to the power line of the subthreshold CMOS circuit via the buffer circuit. This is because the threshold voltage monitor circuit generates the minute current, and therefore, it is possible that the output voltage changes according to the consumption current of the digital circuit when the output voltage is supplied directly to the power line.

In addition, the subthreshold CMOS circuit of the second aspect of the present invention has the following circuit structure. The absolute value difference between the threshold voltage of the typical value of the pMOSFET and the threshold voltage of the typical value of the nMOSFET is set to be smaller than 0.1 V. There is provided the threshold voltage monitor circuit which employs the high threshold voltage device (the HVT device) and the low threshold voltage device (the LVT device) whose threshold voltages have an absolute value difference of equal to or larger than 0.1 V, and sets the controlled output voltage to the threshold voltage of the MOSFET constituting the device having the higher threshold voltage. The controlled output voltage of the threshold voltage monitor circuit is supplied to the power line of the subthreshold CMOS circuit. With the above configuration, it is possible to correct the delay variation by employing the high threshold voltage device (the HVT device) and the low threshold voltage device (the LVT device) in the case of the process in which the threshold voltages of the nMOSFET and the pMOSFET are nearly equal to each other. In this case, in a manner similar to above, only the threshold voltage variation the MOSFET of the HVT device having the higher threshold voltage of the typical value is monitored, and a monitoring signal including monitoring results is reflected on the power supply voltage of the subthreshold CMOS circuit.

When the pMOSFET has the higher threshold voltage of the typical value, a concrete structural embodiment of the threshold voltage monitor circuit of the subthreshold CMOS circuit of the first aspect has the following structure. The threshold voltage monitor circuit includes the current source circuit part, the current mirror part, and the pMOSFET. The source electrode of the pMOSFET is connected to the current output terminal of the current mirror part, the gate electrode and the drain electrode of the pMOSFET are connected to the ground, and the source electrode of the pMOSFET is set to the controlled output voltage ($V_{REF}$) terminal.

In addition, when the nMOSFET has the higher threshold voltage of the typical value, another concrete structural embodiment of the threshold voltage monitor circuit of the subthreshold CMOS circuit of the first aspect has the following structure. The threshold voltage monitor circuit includes the current source circuit part, the current mirror part, and the nMOSFET. The source electrode of the nMOSFET is connected to the ground, the gate electrode and the drain electrode of the nMOSFET are connected to the current output terminal of the current mirror part, and the gate and drain electrodes of the nMOSFET are set to the controlled output voltage ($V_{REF}$) terminal.

In addition, when the pMOSFET has the higher threshold voltage of the typical value in the HVT device, a concrete structural embodiment of the threshold voltage monitor circuit of the subthreshold CMOS circuit of the second aspect has the following structure. The threshold voltage monitor circuit includes the current source circuit part, the current mirror part, and the pMOSFET of the HVT device. The source electrode of the pMOSFET is connected to the current output terminal of the current mirror part, the gate electrode and the drain electrode of the pMOSFET are connected to the ground, and the source electrode of the pMOSFET is set to the controlled output voltage ($V_{REF}$) terminal.

In addition, when the nMOSFET has the higher threshold voltage of the typical value in the HVT device, another concrete structural embodiment of the threshold voltage monitor circuit of the subthreshold CMOS circuit of the second aspect has the following structure. The threshold voltage monitor circuit includes the current source circuit part, the current mirror part, and the nMOSFET of the HVT device. The source electrode of the nMOSFET is connected to the ground, the gate electrode and the drain electrode of the nMOSFET are connected to the current output terminal of the current mirror part, and the gate electrode and the drain electrode of the nMOSFET are set to the controlled output voltage ($V_{REF}$) terminals.

In this case, for example, the current source circuit part can be a circuit configured to include a MOSFET operating in the subthreshold region and a linear MOS resistor (MR) operating in the strong inversion linear region, however, the current source circuit part is not limited to this. In addition, the current mirror part supplies the minute current generated in the current source circuit to the MOSFET for monitoring the threshold voltage.

Next, the delay variation correcting circuit of the subthreshold CMOS circuit of the present invention is a circuit attached to the subthreshold CMOS circuit, in which the absolute value difference between the threshold voltage of the typical value of the pMOSFET and the threshold voltage of the typical value of the nMOSFET is equal to or larger than 0.1 V. When the threshold voltage of the typical value of the pMOSFET is higher than the threshold voltage of the typical value of the nMOSFET, the circuit is configured to include the current source circuit part, the current mirror part, and the MOSFET having the higher threshold voltage of the typical value, i.e., the pMOSFET. The source electrode of the pMOSFET is connected to the current output terminal of the current mirror part, the gate electrode and the drain electrode of the pMOSFET are connected to the ground, and the source electrode of the pMOSFET is set to the controlled output voltage ($V_{REF}$) terminal. According to the delay variation correcting circuit having this configuration, the delay variation of the subthreshold CMOS circuit is corrected by monitoring only the threshold voltage of the pMOSFET.

In addition, the delay variation correcting circuit of the subthreshold CMOS circuit of the present invention is a circuit attached to the subthreshold CMOS circuit, in which the absolute value difference between the threshold voltage of the typical value of the pMOSFET and the threshold voltage of the typical value of the nMOSFET is equal to or larger than 0.1 V. When the threshold voltage of the typical value of the nMOSFET is higher than the threshold voltage of the typical value of the pMOSFET, the circuit is configured to include the current source circuit part, the current mirror part, and the MOSFET having the higher threshold voltage of the typical value, i.e., the nMOSFET. The source electrode of the nMOSFET is connected to the ground, the gate electrode and the drain electrode of the nMOSFET are connected the current output terminal of the current mirror part, and the gate electrode and the drain electrode of the nMOSFET are set to the controlled output voltage ($V_{REF}$) terminal. According to the delay variation correcting circuit having this configuration, the delay variation of the subthreshold CMOS circuit is corrected by monitoring only the threshold voltage of the nMOSFET. In addition, according to the above configuration, the delay variation can be corrected by reflecting the threshold voltage variations of the nMOSFET and the pMOSFET on the power supply voltage of the main body of the subthreshold CMOS circuit. The delay variation is corrected by monitoring only the threshold voltage variation of the MOSFET having the higher threshold voltage of the typical value, and reflecting the monitoring signal including monitoring results on the power supply voltage of the subthreshold CMOS circuit. The reason why the absolute value difference between the threshold voltage of the typical value of the pMOSFET and the threshold voltage of the typical value of the nMOSFET is set to be equal to or larger than 0.1 V is that it is the necessary condition to monitor only the threshold voltage of the MOSFET having the higher threshold voltage of the typical value.

In addition, the delay variation correcting circuit of the subthreshold CMOS circuit of the present invention is a circuit attached to the subthreshold CMOS circuit, in which the absolute value difference between the threshold voltage of the typical value of the pMOSFET and the threshold voltage of the typical value of the nMOSFET is set to be smaller than 0.1 V. The delay variation correcting circuit employs the high threshold voltage device (the HVT device) and the low threshold voltage device (the LVT device) whose threshold voltages have an absolute value difference of equal to or larger than 0.1 V.

The circuit includes the current source circuit part, the current mirror part, and the MOSFET having the higher threshold voltage of the typical value, i.e., the pMOSFET of the HVT device. The source electrode of the pMOSFET is connected to the current output terminal of the current mirror part, the gate electrode and the drain electrode of the pMOSFET are connected to the ground, and the source electrode of the pMOSFET is set to the controlled output voltage ($V_{REF}$) terminal. The delay variation correcting circuit having this configuration is used when the threshold voltage of the pMOSFET is higher than the threshold voltage of the nMOSFET.

In addition, the delay variation correcting circuit of the subthreshold CMOS circuit of the present invention is a circuit attached to the subthreshold CMOS circuit, in which the absolute value difference between the threshold voltage of the typical value of the pMOSFET and the threshold voltage of the typical value of the nMOSFET is smaller than 0.1 V. The delay variation correcting circuit employs the high threshold voltage device (the HVT device) and the low threshold voltage device (the LVT device) whose threshold voltages have an absolute value difference of equal to or larger than 0.1 V. The circuit includes the current source circuit part, the current mirror part, and the MOSFET having the higher threshold voltage of the typical value, i.e., the nMOSFET of the HVT device. The source electrode of the nMOSFET is connected to the ground, the gate electrode and the drain electrode of the nMOSFET are connected to the current output terminal of the current mirror part, and the gate electrode and the drain electrode of the nMOSFET are set to the controlled output voltage ($V_{REF}$) terminal. The delay variation correcting circuit having this configuration is used when the threshold voltage of the nMOSFET is higher than the threshold voltage of the pMOSFET. In addition, according to the above configuration, by employing the high threshold voltage device (the HVT device) and the low threshold voltage device (the LVT device) in the case of the process in which the threshold voltages of the nMOSFET and the pMOSFET are nearly equal to each other, the delay variation can be corrected by monitoring only the threshold voltage variation of the MOSFET of the HVT device having the higher threshold voltage of the typical value, and reflecting a monitoring signal including monitoring results on the power supply voltage of the subthreshold CMOS circuit.

Next, according to the delay variation correcting method of the subthreshold CMOS circuit of the present invention, the absolute value difference between the threshold voltage of the typical value of the pMOSFET and the threshold voltage of the typical value of the nMOSFET is set to be equal to or larger than 0.1 V, the controlled output voltage is set to the threshold voltage of the MOSFET having the higher threshold voltage of the typical value, and the controlled output voltage is supplied to the power line of the subthreshold CMOS circuit via the buffer circuit. According to the method, the delay variation can be corrected by monitoring only the threshold voltage variation of the MOSFET having the higher threshold voltage of the typical value regarding the threshold voltage variations of the nMOSFET and the pMOSFET, and reflecting a monitoring signal including monitoring results on the power supply voltage of the subthreshold CMOS circuit.

Second Embodiment

In the first embodiment, there has been described the delay variation correcting circuit taking the influences exerted by the manufacturing process variation in the subthreshold digital CMOS circuit into consideration. In the second and subsequent embodiments, there is described a delay variation correcting circuit which further takes the influences exerted by the temperature change into consideration.

Figure 15:
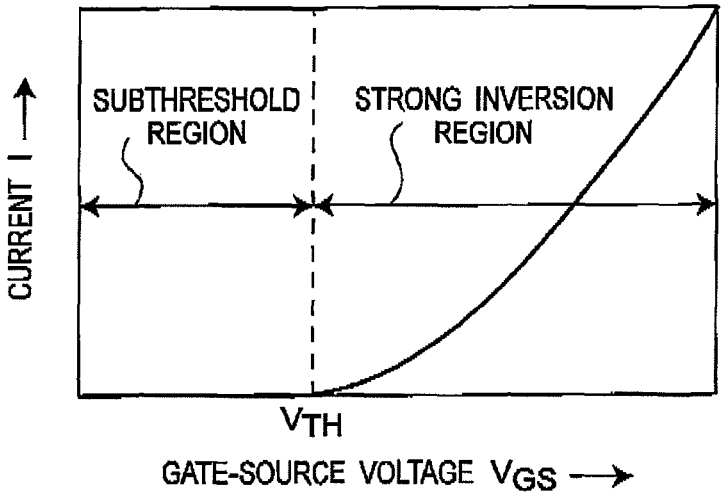
FIG. 15 is a graph showing a subthreshold region and a strong inversion region of a MOSFET, where a relation of a current I with respect to a gate-source voltage $V_{GS}$ is shown therein.
Figure 16:
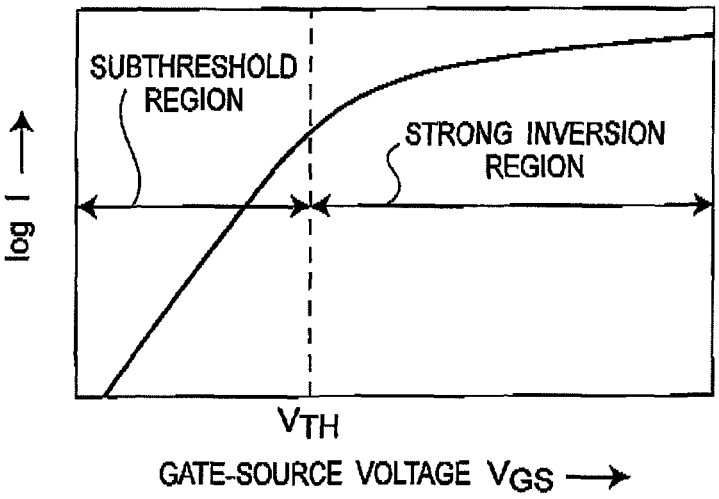
FIG. 16 is a graph showing the subthreshold region and the strong inversion region of the MOSFET, where a relation of log I with respect to the gate-source voltage $V_{GS}$ is shown therein.

First of all, a current-voltage characteristic of the MOSFET is described below. A relation between a gate-source voltage $V_{GS}$ and a drain current I of a MOSFET is shown in FIGS. 15 and 16. Referring to FIGS. 15 and 16, a region in which the gate-source voltage $V_{GS}$ is higher than the threshold voltage $V_{TH}$ is referred to as a strong inversion region, and a region in which the gate-source voltage $V_{GS}$ is lower than the threshold voltage $V_{TH}$ is referred to as a subthreshold region (a weak inversion region). According to FIG. 15, the current I increases depending on a voltage difference ($V_{GS}-V_{TH}$) in the strong inversion region, and the current I seems not flowing in the subthreshold region. However, it can be understood that the current in the subthreshold region is not zero and a minute current is flowing when the drain current I is expressed on the logarithmic scale as shown in FIG. 16.

Figure 17:
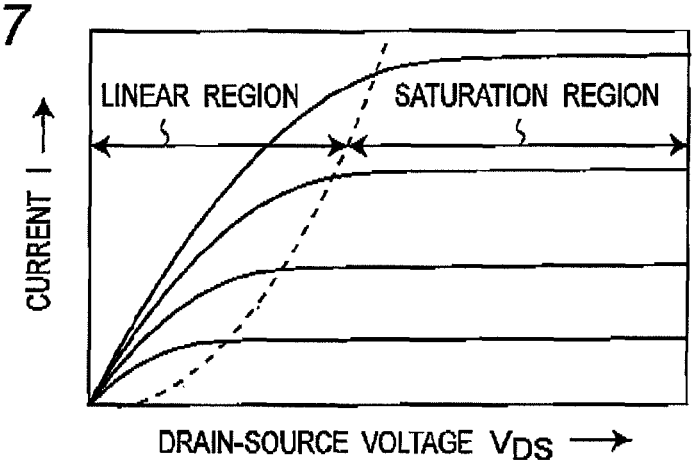
FIG. 17 is a graph showing a relation of the current I with respect to a drain-source voltage $V_{DS}$ of the MOSFET in the strong inversion region.
Figure 18:
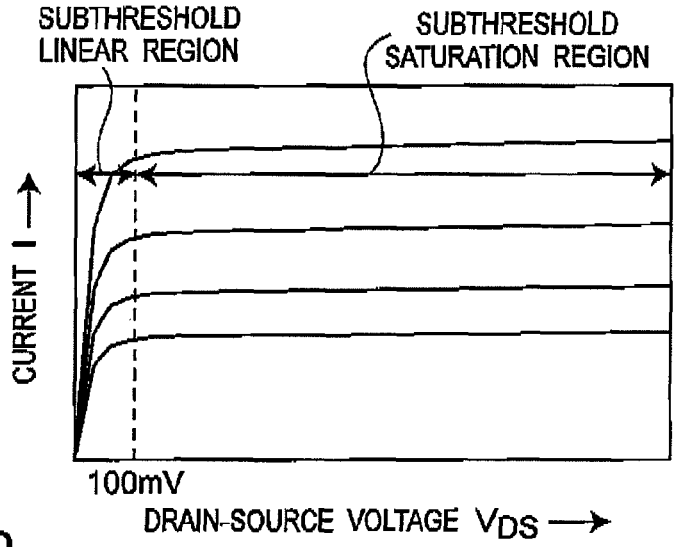
FIG. 18 is a graph showing a relation of the current I with respect to the drain-source voltage $V_{DS}$ of the MOSFET in the subthreshold region.
Figure 19:
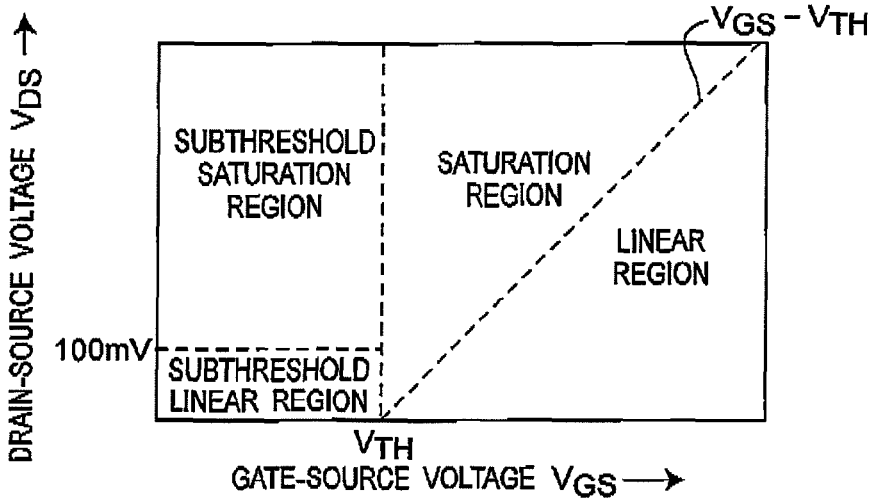
FIG. 19 is a graph showing operation regions defined by the gate-source voltage $V_{GS}$ and the drain-source voltage $V_{DS}$ of the MOSFET.

A relation between a drain-source voltage $V_{DS}$ and the drain current I in the strong inversion region of the MOSFET is shown in FIG. 17. Referring to FIG. 17, a region on the left-hand side of a dashed line ($V_{DS}<V_{GS}-V_{TH}$) in which the current I depends on the drain-source voltage $V_{DS}$, is referred to as a linear region (a triode region). A region on the right-hand side of the dashed line ($V_{DS}<V_{GS}-V_{TH}$), in which the drain current I scarcely depends on the drain-source voltage $V_{DS}$, is referred to as a saturation region. A relation between the drain-source voltage $V_{DS}$ and the drain current I in the subthreshold region is shown in FIG. 18. In a manner similar to that of the strong inversion region, the subthreshold region can be also divided into a region in which the drain current I depends on the drain-source voltage $V_{DS}$ and a region in which the current scarcely depends on the voltage. The region in which the drain current I depends on the drain-source voltage $V_{DS}$ ($V_{DS}>$ about 100 mV) in the subthreshold region is referred to as a subthreshold saturation region, and the region in which the drain current I scarcely depends on the drain-source voltage $V_{DS}$ ($V_{DS}<$ about 100 mV) in the subthreshold region is referred to as a subthreshold linear region. Namely, there can be divided four regions as shown in FIG. 19 depending on a relation between the gate-source voltage $V_{GS}$ and the drain-source voltage $V_{DS}$. Characteristics in the respective regions are described below.

First of all, the linear region is described below. An inversion layer charge density is increased by applying a bias of equal to or higher than the threshold voltage to the gate-source voltage $V_{GS}$ of the MOSFET, and a drift current flows due to an inversion layer formed beneath a gate electrode. In this case, the drain current I flowing through the MOSFET is expressed by the following equation:

$$I = \mu C_{OX} K\left[(V_{GS} - V_{TH})V_{DS} - \frac{1}{2}V_{DS}^2\right], \tag{13}$$

where μ is a mobility, $C_{OX}$ ($=\in_{OX}/t_{OX}$) is an oxide film capacitance per unit area, $t_{OX}$ is an oxide film thickness, $\in_{OX}$ is a dielectric constant of the oxide film, and K (=W/L) is an aspect ratio between a channel length L and a channel width W. When the drain-source voltage $V_{DS}$ is sufficiently low, the Equation (13) can be approximated by the following equation:

$$I=\mu C_{OX}K(V_{GS}-V_{TH})-V_{DS} \tag{14}$$

According to the Equation (14), the drain current in the linear region has a characteristic of increasing linearly with $V_{DS}$. Therefore, the MOSFET in the linear region is modulated by the gate-source voltage $V_{GS}$, and behaves like a resistance R expressed by the following equation:

$$R=1/\mu C_{OX}K(V_{GS}-V_{TH}) \tag{15}$$

Next, the saturation region is described below. The linearity of the MOSFET in the linear region indicated in the Equation (14) holds only when the drain-source voltage $V_{DS}$ is sufficiently small, and the quadratic term becomes unignorable as the drain-source voltage $V_{DS}$ increases. Therefore, when the drain-source voltage $V_{DS}$ increases, the current increases parabolically until it reaches the maximum or a saturation value. This is caused by such a fact that the inversion layer charge density at a drain end decreases while the drain current I increases when the drain-source voltage $V_{DS}$ increases. When the drain-source voltage $V_{DS}$ is the voltage difference ($V_{GS}-V_{TH}$), the inversion layer charge density at the drain end becomes zero, and the drain current is saturated. This is called pinch-off, and the drain current I is expressed by the following equation:

$$I = \frac{1}{2}\mu C_{OX} K(V_{GS} - V_{TH}). \tag{16}$$

When the drain-source voltage $V_{DS}$ increases exceeding the saturation point, the pinch-off point shifts to the source side, however, the drain current scarcely changes.

Next, the subthreshold linear region is described below. When a bias is applied to the gate-source voltage $V_{GS}$ of the MOSFET below the threshold value $V_{TH}$, a diffusion current flows through the MOSFET according to a Boltzmann distribution. In this case, the drain current I is expressed by the following equation:

$$I = KI_0\exp\left(\frac{V_{GS} - V_{TH}}{\eta V_T}\right)\left(1 - \exp\left(-\frac{V_{DS}}{V_T}\right)\right). \tag{17}$$

In this case, $I_0$ ($=\mu C_{OX}(f-1)V_T^2$) is a pre-coefficient of a subthreshold current, $V_T$ ($=k_BT/q$) is a thermal voltage, $k_B$ is a Boltzmann constant, T is an absolute temperature, and q is the elementary electric charge. When the drain voltage is sufficiently low, the Equation (17) can be approximated by the following equation:

$$I = KI_0\exp\left(\frac{V_{GS} - V_{TH}}{\eta V_T}\right)\left(\frac{V_{DS}}{V_T}\right). \tag{18}$$

Namely, the MOSFET in the subthreshold linear region behaves like a resistance R expressed by the following equation:

$$R = \frac{V_T}{KI_0\exp\left(\frac{V_{GS} - V_{TH}}{\eta V_T}\right)}. \tag{19}$$

Figure 20:
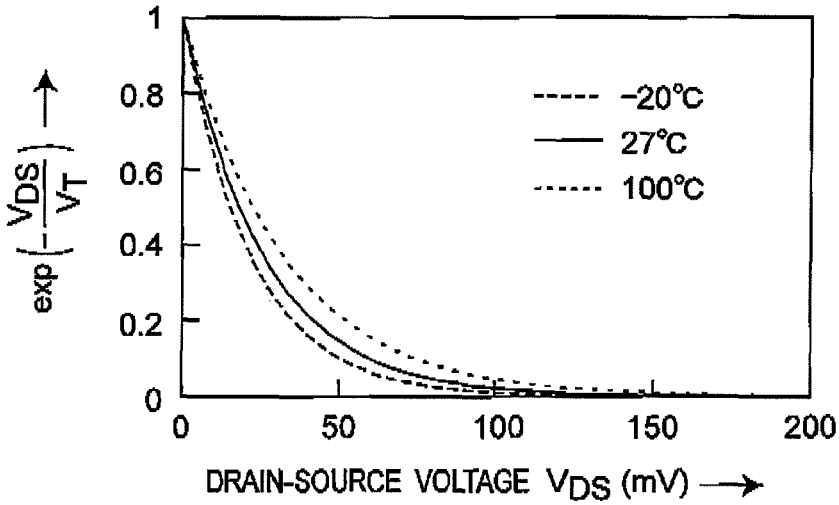
FIG. 20 is a graph showing a drain-source voltage $V_{DS}$ dependence of an $\exp(-V_{DS}/V_T)$ of the MOSFET in the subthreshold region.

Next, the subthreshold saturation region is described below. FIG. 20 shows numerical calculation results of a drain-source voltage $V_{DS}$ dependence of an $$\exp\left(-\frac{V_{DS}}{V_T}\right) \tag{20}$$

in the Equation (17) at the temperatures of −20° C., 27° C. and 100° C. According to FIG. 20, it can be understood that a convergence to approximately zero occurs when the drain-source voltage $V_{DS}$ exceeds about 100 mV. Namely, when the drain-source voltage $V_{DS}$ is equal to or higher than 100 mV, the Equation (17) can be approximated by the following equation:

$$I = KI_0\exp\left(\frac{V_{GS} - V_{TH}}{\eta V_T}\right). \tag{21}$$

As apparent from the Equation (21), the drain current I scarcely depends on the drain-source voltage $V_{DS}$. Generally speaking, the MOSFET in the subthreshold circuit operates in the subthreshold saturation region, and the MOSFET in the subthreshold digital CMOS circuit also operates in the subthreshold saturation region. Unless specifically noted, the subthreshold region means the subthreshold saturation region, and the subthreshold current means the drain current in the subthreshold saturation region hereinafter.

Further, the process and temperature variations of the subthreshold current are described below. Influences exerted by the manufacturing process variation and temperature change on the subthreshold current are described below.

First of all, the process dependence is described below. According to the Equation (21), the process dependence of the subthreshold current I is expressed by the following equation (22) assuming the variation $\Delta P_i$ of each parameter $P_i$:

$$\begin{aligned}\frac{\Delta I}{I} &= \frac{1}{I}\sum_{\Delta P_i}\frac{\partial I}{\partial P_i}\Delta P_i \\ &= \frac{\Delta W}{W} - \frac{\Delta L}{L} + \frac{\Delta\mu}{\mu} - \frac{\Delta t_{ox}}{t_{ox}} + \frac{\Delta V_{GS}}{\eta V_T} - \frac{\Delta V_{TH}}{\eta V_T}\end{aligned} \tag{22}$$

In this case, since the parameters ($\Delta L$, $\Delta W$, $\Delta t_{OX}$) attributed to the shape of the transistor and the mobility variation ($\Delta\mu$) are sufficiently small as compared with the remaining terms, the Equation (22) can be approximated by the following equation:

$$\frac{\Delta I}{I} = \frac{\Delta V_{GS}}{\eta V_T} - \frac{\Delta V_{TH}}{\eta V_T}, \tag{23}$$

where assuming that the gate-source voltage $V_{GS}$ is a constant voltage, then only the second term of the right side remains. Namely, it can be understood that the influence exerted by the threshold voltage variation $\Delta V_{TH}$ is the largest.

Next, the temperature dependence is described below. The carrier mobility $\mu$ and the threshold voltage $V_{TH}$ of the MOSFET depend on the temperature T, and are expressed by the following equations, respectively:

$$\mu = \mu_0\left(\frac{T}{T_0}\right)^{-m}, \text{ and} \tag{24}$$

$$V_{TH} = T_{TH0} - \kappa T, \tag{25}$$

where $\mu_0$ is the mobility at a room temperature $T_0$, m is the temperature coefficient of the mobility, $V_{TH0}$ is the threshold voltage at absolute zero temperature, and $\kappa$ is the temperature coefficient of the threshold voltage. According to the Equation (21), the Equation (24) and the Equation (25), the temperature characteristic of the subthreshold current is expressed by the following equation:

$$\frac{1}{I}\frac{\partial I}{\partial T} = \frac{2-m}{T} + \frac{1}{\eta V_T}\left(-\frac{V_{GS}}{T} + \frac{\partial V_{GS}}{\partial T} + \frac{V_{TH0}}{T}\right). \quad (26)$$

where the first term of the right side of the Equation (26) is sufficiently small as compared with the remaining terms, and therefore, the Equation (26) can be approximated by the following equation:

$$\frac{1}{I}\frac{\partial I}{\partial T} = \frac{1}{\eta V_T}\left(-\frac{V_{GS}}{T} + \frac{\partial V_{GS}}{\partial T} + \frac{V_{TH0}}{T}\right). \quad (27)$$

In a manner similar to above, assuming that the gate-source voltage $V_{GS}$ is a constant voltage, then it can be understood that the first term and the third term in the parentheses of the right side of the Equation (27) exert influences on the temperature characteristic. It can be understood that, when the gate-source voltage $V_{GS}$ is a constant voltage smaller than the threshold voltage $V_{TH}$, the right side of the Equation (27) has a positive value, and an amount of the current increases according to the temperature. In addition, it can be understood that the temperature dependence becomes larger when the gate-source voltage $V_{GS}$ becomes a lower voltage.

Next, the variation in the subthreshold current is described below. As indicated in the Equation (23) and the Equation (27), the subthreshold current sensitively fluctuates with respect to the process variation and temperature change. FIGS. 2A and 2B show numerical calculation results of the process and temperature variation dependencies of the subthreshold current. They are normalized by a current value of a typical value free of variation (a current when $\Delta V_{TH}=0$ in FIG. 2A, and a current when T=27° C. in FIG. 2B). It can be confirmed that the subthreshold current fluctuates exponentially on the order of triple to quadruple digits depending on the threshold value variations due to the manufacturing process variation ($\Delta V_{TH}$) and the temperature change (T).

Further, the subthreshold digital CMOS circuit is described below. In this case, the low power consumption technique of the CMOS digital circuit is summarized. Then, there is described characteristics of the subthreshold digital CMOS circuit, in which the power supply voltage is equal to or lower than the threshold voltage of the MOSFET.

A power $P_{total}$ consumed by the CMOS digital circuit is expressed by the following equation:

$$P_{total}=P_{dyn}+P_{sc}+P_{leak} \quad (28).$$

The first term $P_{dyn}$ of the Equation (28) represents the operating power, and is expressed by the following equation:

$$P_{dyn}=p_t f C_L V_{DD} \quad (29),$$

where $p_t$ is a switching probability, f is an operating frequency of a clock, $C_L$ is a load capacitance, and $V_{DD}$ is a power supply voltage. The operating power $P_{dyn}$ is consumed by the charge and discharge of the load capacitance $C_L$, when the output of the CMOS digital circuit is switched from zero to one or from one to zero, i.e., when the transistor operates, and is a power generated every switching. In addition, the second term $P_{sc}$ of the Equation (28) represents a pass-though power and is expressed by the following equation:

$$P_{sc}=p_t f I_{sc} t_{sc} V_{DD} \quad (30),$$

where $I_{sc}$ is a pass-through current, and $t_{sc}$ is the time for which the pass-through current flows. The switch power $P_{sc}$ is the power consumed by the pass-through current which flows from the power source to the GND for a period for which both of the pMOSFET and the nMOSFET are in an on-state in the transition process of the output of the digital circuit. Then, the third term $P_{leak}$ of the Equation (28) represents a leakage power, and is expressed by the following equation:

$$P_{leak} = KI_0\exp\left(-\frac{V_{TH}}{\eta V_T}\right)V_{DD}. \quad (31)$$

The leakage power $P_{leak}$ is a power consumed by a leakage current which flows through the transistor regardless of the circuit operation.

Next, the power consumption reduction and problems thereof are described below. The power consumption reduction of the CMOS digital circuit has been achieved so far by the miniaturization of the device element and a reduction in the power supply voltage according to it. This coincides with such a fact that the power consumption of the CMOS digital circuit depends on the power supply voltage as indicated by the Equation (28) to the Equation (31). In particular, since the operating power is proportional to the square of the power supply voltage, the reduction in the power supply voltage is an extremely effective technique for the power consumption reduction of the CMOS digital circuit. However, on the other hand, a gate propagation delay $t_{pd}$ of the digital circuit can be approximated by the following equation:

$$t_{pd} = \frac{kC_L V_{DD}}{(V_{DD}-V_{TH})^{\alpha}}, \quad (\alpha \approx 1.3). \quad (32)$$

Therefore, an increase in the gate propagation delay is caused if the power supply voltage $V_{DD}$ is merely lowered. In this case, k is a constant. It is required to lower the threshold voltage $V_{TH}$ simultaneously with the power supply voltage $V_{DD}$ in order to maintain a velocity, however, the reduction in the threshold voltage $V_{TH}$ causes an increase in the leakage power as indicated in the Equation (31). Namely, both are in a trade-off relation. As described above, the reductions in the power supply voltage and the threshold voltage according to the process miniaturization cause a serious increase in the leakage power, and this results in a factor in disturbing the LSI power consumption reduction.

As described above, the reduction in the power supply voltage is efficient means for the power consumption reduction of the CMOS digital circuit, however, the delay time increases when the power supply voltage is reduced without lowering the threshold voltage. However, the reduction in the power supply voltage is very efficient means for low-speed lower-power applications which require no high-speed operation, such as body implanted type devices and sensors LSIs. Namely, the subthreshold digital CMOS circuit, in which the power supply voltage is set to be equal to or lower than the threshold voltage of MOSFET, can achieve super-low power consumption.

Subthreshold digital circuits attract much attention as means for achieving a super-low power consumption as shown in cases where sensor LSIs and FFT (Fast Fourier Transform) arithmetic circuit employing subthreshold digital CMOS circuits are proposed. However, as described above, the MOSFET operating in the subthreshold region has the problem that the current-voltage characteristic largely fluctuates due to the process variation and the temperature change, and the variation in the current is on the order of triple to quadruple digits. Therefore, first of all, the influences that the manufacturing process variation and the temperature change exert on the subthreshold digital CMOS circuit are analyzed below.

Figure 21:
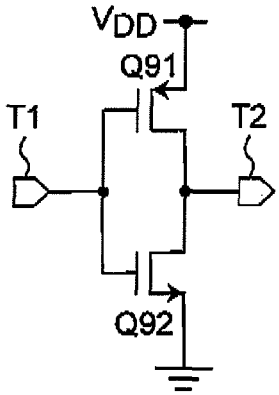
FIG. 21 is a circuit diagram showing a configuration of a CMOS inverter configured to include a pMOSFET Q91 and an nMOSFET Q92.

First of all, when the process and temperature variations of the delay time are considered, a propagation delay $\tau$ of the CMOS inverter of FIG. 21 is expressed by the following equation:

$$\tau \propto \tau_{HL} + \tau_{LH} = \frac{C_L V_{DD}}{I_N} + \frac{C_L V_{DD}}{I_P}, \tag{33}$$

where $\tau_{HL}$ and $\tau_{LH}$ are the rise time and the fall time, respectively, and $I_N$ and $I_P$ are the on-state currents ($V_{GS}=V_{DD}$) in the subthreshold regions of the nMOSFET and the pMOSFET, respectively. Since the load capacitance $C_L$ can be approximated by the gate capacitance of the next stage, there can be expressed as: $C_L=\alpha LWC_{OX}$. In this case, $\alpha$ is a constant.

According to the Equation (33), a delay variation $\Delta\tau/\tau$ due to the process variation is expressed by the following equations:

$$\frac{\Delta\tau}{\tau} = \frac{\Delta C_L}{C_L} + \frac{\Delta V_{DD}}{V_{DD}} - w\frac{\Delta I_N}{I_N} - (1-w)\frac{\Delta I_P}{I_P}, \text{ and} \tag{34}$$

$$w = \frac{I_P}{I_N + I_P} = \frac{1}{1 + \frac{K_N I_{0N}}{K_P I_{0P}} \exp\left(\frac{V_{THP} - V_{THN}}{\eta V_T}\right)}, \tag{35}$$

where w is a weight coefficient determined by the difference ($V_{THP}-V_{THN}$) between the threshold voltages of the typical values. The following equation is obtained by using the Equation (23) under such a condition as $V_{DD}>>\eta V_T$:

$$\frac{\Delta\tau}{\tau} = -\frac{1}{\eta V_T}\{\Delta V_{DD} - w\Delta V_{THN} - (1-w)\Delta V_{THP}\}. \tag{36}$$

Namely, the delay variation ($\Delta\tau/\tau$) due to the process variation depends on the fluctuation ($\Delta V_{DD}$) in the power supply voltage, the threshold voltage variations ($\Delta V_{THN}$, $\Delta V_{THP}$) and the weight coefficient w.

Next, the delay variation due to the temperature change is described below. According to the Equation (34), the temperature characteristic:

$$\frac{1}{\tau}\frac{\partial\tau}{\partial T} \tag{37}$$

of the delay time $\tau$ is expressed by the following equation:

$$\frac{1}{\tau}\frac{\partial\tau}{\partial T} = \frac{1}{V_{DD}}\frac{\partial V_{DD}}{\partial T} - w\frac{1}{I_N}\frac{\partial I_N}{\partial T} - (1-w)\frac{1}{I_P}\frac{\partial I_P}{\partial T}. \tag{38}$$

The following equation is obtained by using the Equation (27) under such a condition as $V_{DD}>>\eta V_T$:

$$\frac{1}{\tau}\frac{\partial\tau}{\partial T} = -\frac{1}{\eta V_T}\left(\frac{\partial V_{DD}}{\partial T} - \frac{V_{DD} - wV_{THN0} - (1-w)V_{THP0}}{T}\right). \tag{39}$$

According to the Equation (39), the temperature characteristic of the delay time depends on the power supply voltage $V_{DD}$, the temperature dependence of the power supply voltage, the threshold voltage at the absolute zero temperature, and the weight coefficient w.

Further, the variation in the delay time is considered. As shown in FIGS. 2A and 2B, the current flowing through the MOSFET fluctuates exponentially with respect to the process variation and the temperature change in the subthreshold digital CMOS circuit. For this reason, the delay time largely varies according to the Equation (36) and the Equation (38). The variation in the delay time follows the lognormal distribution. FIG. 3 shows the influence exerted by the current variation on the delay variation. FIG. 3 is plotted using the power supply voltage, i.e., energy ($E=CV_{DD}^2$) as a parameter. It can be confirmed that the delay time also varies exponentially due to the current varying exponentially. In this case, if a certain delay time constraint (a dashed line) is assumed, it can be understood that the delay time constraint is satisfied even when the current is the smallest in the case of a high energy line (E=2.25), but the energy is wasted in a state of large current. On the other hand, it is possible to perform arithmetic operations with the lowest energy in the case of a low energy line (E=0.25), however, the delay constraint cannot be satisfied. Namely, in order to satisfy both of the delay constraint and low energy, a technique to control the variation is required.

Next, a delay variation correcting technique of the present embodiment is described below.

First of all, delay variation correction by power supply voltage control is described below. There can be considered two methods of a substrate voltage control method and a power control method as a method for correcting the delay variation. In the present embodiment, as a result of considering the following reasons, the power control method was adopted.

(i) the substrate voltage control method has such a problem that the size of the correcting circuit becomes large since both of the nMOSFET and the pMOSFET must be corrected.

(ii) The control range of the threshold voltage by the substrate voltage is small.

(iii) Power consumption in the case of a forward bias increases.

According to the Equation (36), in order to correct the delay variation with respect to the process variation ($\Delta\tau/\tau=0$), it is proper to control the output voltage $V_{DD}$ according to the following equation:

$$\Delta V_{DD} = w\Delta V_{THN} + (1-w)\Delta V_{THP} \tag{40}$$

In addition, in order to correct the delay variation with respect to the temperature change by using the Equation (40), i.e., in order to make zero the temperature characteristic of the delay time as shown in the following equation:

$$\frac{1}{\tau}\frac{\partial\tau}{\partial T} = 0, \tag{41}$$

it can be understood that, by solving the differential equation of the Equation (39), it is proper to perform control according to the power supply voltage $V_{DD}$ as shown in the following equation:

$$V_{DD}=wV_{THN0}+(1-w)V_{THP0}-CT \quad (42),$$

where C is an arbitrary integral constant. Therefore, in order to correct the delay variation with respect to both of the process variation and the temperature change according to the Equation (40) and the Equation (42), it is proper to control the power supply voltage according to the following equation;

$$V_{DD}+\Delta V_{DD}=w(V_{THN0}+\Delta V_{THN})+(1-w)(V_{THP0}+\Delta V_{THP})-CT \quad (43).$$

According to the Equation (43), the delay variation is reflected on the power supply voltage by weighting the variations in the threshold voltages due to the process variation of the nMOSFET and the pMOSFET and the threshold voltages at the absolute zero temperature by coefficients w and 1−w. Further, it is indicated that the correction is possible by controlling the power supply voltage conforming to the temperature according to the arbitrary coefficient C.

Next, simplified delay variation correction using the characteristic of the weight coefficient w is described below. As described above, it is possible to correct the delay variation by generating a voltage expressed by the Equation (43), and reflecting the same voltage on the power supply voltage. However, a complicated circuit structure is required to generate accurately the weight coefficient w indicated in the Equation (35), and increases in the circuit size and the power consumption are caused, it is not realistic. Therefore, a simplified model for achieving the Equation (43) was examined.

According to the Equation (35), the weight coefficient w depends on the threshold voltage difference between the threshold voltage of the typical value of the pMOSFET and the threshold voltage of the typical value of the nMOSFET. Namely, it means that the weight coefficient w is determined by the typical values of the threshold voltages. FIG. 4 shows the calculation results of the weight coefficient w with respect to the threshold voltage difference $V_{THP}-V_{THN}$ when $K_N I_{0N}=K_P I_{0P}$. According to FIG. 4, when the threshold voltage difference between the pMOSFET and the nMOSFET is larger than 0.1 V ($V_{THP}-V_{THN}>0.1$ V), the weight coefficient w approaches zero. Conversely, when the threshold voltage difference between the pMOSFET and the nMOSFET is smaller than −0.1 V ($V_{THP}-V_{THN}<-0.1$ V), the weight coefficient w approaches one. Namely, it can be understood that only the MOSFET having the higher threshold voltage determines the weight coefficient w when the threshold voltage difference (an absolute value) of the typical value is large. According to the above discussion, it can be understood that the Equation (43) can be simplified in two ways of the following equations:

$$V_{DD}=V_{THP0}+\Delta V_{THP}-C_1T,\ (w=0,\ V_{THP}-V_{THN}>0.1V) \quad (44), \text{ and}$$

$$V_{DD}=V_{THN0}+\Delta V_{THN}-C_2T,\ (w=1,\ V_{THP}-V_{THN}<-0.1V) \quad (45).$$

Therefore, in order to correct the delay variation due to the process variation and the temperature change, it is proper to monitor the threshold voltage of the MOSFET having the higher threshold voltage of the typical value and to reflect a monitored voltage on the power supply voltage of the subthreshold digital CMOS circuit. In the process used by the inventors, the threshold voltage of the pMOSFET is higher than the threshold voltage of the nMOSFET by about 0.2 V, and therefore, the weight coefficient w of the Equation (30) is approximately zero. Therefore, according to the Equation (44), the delay variation correction can be achieved by generating a power supply voltage having an arbitrary temperature coefficient from the threshold voltage of the pMOSFET at the absolute zero temperature, monitoring the threshold voltage variation of the pMOSFET, and reflecting a monitored voltage on the power supply voltage.

However, there also exists such a process in which the threshold voltage values of the nMOSFET and the pMOSFET of the typical values are nearly equal to each other. In such a case, the delay variation correction can be achieved by employing both of the high-threshold voltage (HVT) device and the low-threshold voltage (LVT) device (for example, by employing the LVT device for the nMOSFET and employing the HVT device for the pMOSFET, or by employing the HVT device for the nMOSFET and using the LVT device for the pMOSFET). In addition, the delay variation correction can be also achieved by previously controlling the threshold voltage of the typical value by substrate bias control.

FIG. 5 shows a fundamental structure of a proposed delay variation correcting circuit, and FIGS. 6, 7, 8A and 9A show detailed structures. These circuit structures are similar to those of the first embodiment, and no detailed description is provided for them. For example, referring to FIG. 6, the minute current generated by the current source circuit part 10 is supplied to the threshold voltage monitor circuit part 20-1 via the current mirror circuit part 21. A prior art current source of Oguey et al. is used for the generation of the minute current $I_{REF}$. The current $I_{REF}$ flowing through the minute current source does not include any term of the threshold voltage explicitly, and therefore, the current $I_{REF}$ has a tolerance to the threshold voltage variation. In the threshold voltage monitor circuit part 20-1, the output voltage $V_{REF}$, which is the gate-source voltage $V_{GS}$ of the pMOSFET (MP1) Q12, is generated by biasing the current to the pMOSFET (MP1) Q12 via the current mirror circuit part 21. In this case, the output voltage $V_{REF}$ is expressed by the following equation:

$$\begin{aligned} V_{REF} &= V_{GS,P1} = V_{THP,P1} + \eta V_T \ln\left(\frac{I_{REF}}{K_{P1} I_0}\right) \\ &= V_{THP0,P1} - \left(\kappa - \eta \frac{k_B}{q} \ln\left(\frac{I_{REF}}{K_{P1} I_0}\right)\right) T \end{aligned} \quad (46)$$

According to the Equation (46), it can be understood that the output voltage $V_{REF}$ is expressed by a sum of the threshold voltage $V_{THP,P1}$ of the pMOSFET (MP1) Q12 at the absolute zero temperature, and a term which depends on the temperature and adjusted arbitrarily by the temperature coefficient of the threshold voltage $V_{THP,P1}$ of the pMOSFET (MP1) Q12 and a logarithmic function. Since the minute current $I_{REF}$ generated from the minute current source has a tolerance to the threshold voltage variation, the second term of the right side of the Equation (46) is stable against the process variation. In addition, it is possible to suppress a random variation in the threshold voltage of the pMOSFET (MP1) Q12 by enlarging the size of the transistor. For the above reasons, since the output voltage $V_{REF}$ of the monitor circuit part 20-1 includes the term of the threshold voltage $V_{THP,P1}$ and changes according to the temperature, it is possible to monitor the manufacturing process state and operating temperature state of the threshold voltage of the pMOSFET (MP1) Q12 by using the threshold voltage monitor circuit 1-1.

It is noted that the threshold voltage monitor circuit 1-1 may be the threshold voltage monitor circuits 1-2 to 1-4 of FIGS. 7, 8A and 9A as shown in the first embodiment.

Further, the proposed delay variation correcting circuit is evaluated by a simulation and examined. In order to evaluate the characteristics of the proposed delay variation correcting circuit, a circuit simulation by SPICE (Simulation Program with Integrated Circuit Emphasis) was carried out. The process used is a 0.35-μm standard CMOS process, in which the threshold voltage of the typical value of the nMOSFET and the threshold voltage of the typical value of the pMOSFET are 0.46 V and 0.68 V, respectively. In addition, the power supply voltage for the analog circuit is set to 2.5 V. When evaluating the influences on the process variation, the Monte Carlo simulation were carried out considering the global variation (uniform distribution: for example, $-0.1\ V<\Delta V_{TH}<0.1\ V$) and the random variation $$\left(\text{Gaussian distribution: } \sigma_{VTH} = \frac{A_{VTH}}{\sqrt{LW}}\right). \tag{47}$$

First of all, regarding the temperature dependence, FIG. 10 shows the change in the output voltage $V_{REF}$ when the temperature of the threshold voltage monitor circuit 1-1 is changed from −20° C. to 100° C. As apparent from FIG. 10, it can be understood that the output voltage of the threshold voltage monitor circuit 1-1 decreases linearly with the increase in the temperature. This is because the output voltage includes the terms of the threshold voltage of the pMOSFET and the thermal voltage as indicated in the Equation (46). Namely, the output voltage $V_{REF}$ can monitor the threshold voltage variation due to the temperature.

Next, the dependence of the process variation is described below. FIGS. 11A and 11B show the output voltage $V_{REF}$ when the Monte Carlo simulation is carried out 500 times. Each line (point) represents the result of one of the Monte Carlo simulations. FIG. 11A is the results of the output voltage with respect to the temperature change from −20° C. to 100° C. It can be understood that the output voltage fluctuates by ±0.1 V at a certain temperature since the threshold voltage fluctuates by ±0.1 V due to the global variation. In addition, it can be confirmed that slopes of the controlled output voltages $V_{REF}$ with respect to the temperature are almost the same as each other in all of the results since the temperature coefficient κ of the MOSFET is a parameter stable against the process variation. FIG. 11B is the results of the output voltage $V_{REF}$ with respect to the global variation amount ($\Delta V_{THF}$) of the threshold voltage at a room temperature of 27° C. The output voltage fluctuates linearly with respect to the threshold voltage variation amount of the pMOSFET, since the output voltage refers to the threshold voltage of the pMOSFET in the chip according to the Equation (46). It can be confirmed that the evaluation results also indicate a correlation of approximately one, and operation conforming to the analysis is observed. In addition, the reason why the output voltage $V_{REF}$ exhibits correlation results having dispersion to the threshold voltage variation amount of the pMOSFET is presumably ascribed to a variation in the bias current and the random variation of the monitor transistor (MP1) Q12.

For the above reasons, the threshold voltage monitor circuit 1-1 can monitor the state of the threshold voltage of the pMOSFET with respect to the temperature change in the chip and the process variation.

Further, results and examination concerning the oscillation frequency correction of the ring oscillator are described below. In this case, for the characteristic evaluation of the delay variation correction architecture, evaluations are performed for an uncorrected case and a corrected case of the oscillation frequency variation of the 51-stage ring oscillator of the CMOS inverter, and the evaluations are examined. The oscillation frequency at the room temperature and the typical value was 3.1 kHz.

First of all, regarding the correction of the process variation, FIG. 12 shows histograms of the oscillation frequency when the Monte Carlo simulation was carried out 500 limes at the room temperature. FIG. 12(*a*) shows results of fixed power supply voltage ($V_{DD}$=460 mV) operation in the uncorrected case, and FIG. 12(*b*) shows results obtained by using a correcting circuit. It can be understood that the oscillation frequency of the ring oscillator varies largely following the lognormal distribution in the uncorrected case (FIG. 12(*a*)). This is because the variation in the delay time follows the lognormal distribution since the subthreshold current flowing through the MOSFET and the delay time of the inverter varies exponentially with respect to the variation in the threshold voltage. The oscillation frequency is broadly distributed from 0.158 kHz to 63.1 kHz. On the other hand, in the corrected case (FIG. 12(*b*)), the variation in the oscillation frequency is remarkably improved, and the variation distribution almost follows the normal distribution. This is because the output voltage of the threshold voltage monitor circuit fluctuates according to the fluctuations in the threshold voltage due to the process variation, and the delay variation is suppressed by controlling the power supply voltage of the ring oscillator as indicated in the Equation (44) according to the monitoring signal. It can be considered that the reason why the oscillation frequency has dispersion is influences of the variation in the output voltage of the threshold voltage monitor circuit and the random variations of the MOSFETs that constitute the ring oscillator as described above. The oscillation frequency is distributed between 0.673 kHz to 7.79 kHz. In the corrected case, the fluctuation coefficient ($\mu_f/\sigma_f$) of the oscillation frequency was 36.8%. In this case, $\mu_f$ and $\sigma_f$ are the average value and the standard deviation of the oscillation frequency, respectively.

Next, FIG. 13 shows the oscillation frequencies in the uncorrected case and the corrected case when the temperature is changed from −20° C. to 100° C. In the uncorrected case, the oscillation frequency largely changes from 0.0987 kHz to 107 kHz. This is because the subthreshold current flowing through the MOSFET and the delay time of the inverter vary exponentially by the fluctuation in the threshold voltage due to the temperature change. In the corrected case, it can be confirmed that the fluctuation in the oscillation frequency is remarkably suppressed, and distributed between 2.03 kHz and 5.44 kHz. In the corrected case, the oscillation frequency slightly rises according to the temperature rises. This is because the threshold voltage of the MOSFET and the output voltage of the monitor circuit decrease according to the temperature rises, and the power supply voltage of the ring oscillator also decreases according to the temperature rises, and this leads to the reduction in the oscillation frequency according to the Equation (33). In addition, it is ascribed to the fact that the minute current supplied from the reference current source circuit has a positive temperature coefficient.

For the above reasons, it is possible to correct the variation in the delay time due to the process variation and the temperature change by using the proposed delay variation correcting circuit.

Further, the results and examination of the delay variation correction of the adder are described below. In this case, in order to evaluate the delay variation correction effect and the power consumption reduction effect of the digital circuit system, evaluation of delay variation correction of the 8-bit ripple carry adder (RCA) is performed, and the evaluation is examined. A setting time is set to 500 μs, and designing is performed so as to satisfy the delay constraint. The uncorrected fixed power supply voltage $V_{DD}$ is 665 mV. The evaluation was performed by an operation of (00000001)+(11111111), with which a calculation time becomes the worst value, and the delay time is determined when the arithmetic processing of the last bit is completed.

First of all, regarding the delay variation correction with respect to the process variation and the temperature change, FIG. 14 shows the delay time of the adder when the Monte Carlo simulation is carried out 500 times with the temperature change from −20° C. to 100° C. In each of the uncorrected and corrected cases, the delay time (the typical value) of the typical value, the earliest delay time (a high-speed condition) and the latest delay time (a low-speed condition) are extracted and shown. As apparent from FIG. 14, the delay time changes from 38.1 ns to 212 μs in the uncorrected case. This is ascribed to the fact that the threshold voltage of the MOSFET that constitutes the adder fluctuates due to the process variation and the temperature change. On the other hand, in the corrected case, the delay time is suppressed between 29.7 μs to 494 μs. This is because the delay variation is suppressed by using the correction architecture, and reflecting the variation in the threshold voltage due to the process variation and the temperature change on the power supply voltage. Namely, it can be confirmed that the uncorrected case exhibits a significant variation in the delay time although the delay constraint is satisfied in all of the results in the uncorrected case and the corrected case.

Next, evaluation of the consumption current is described below. FIG. 22 shows average consumption currents in the uncorrected and corrected cases of the delay variation when the Monte Carlo simulation is carried out 500 times depending on the temperature change from −20° C. to 100° C. A buffer circuit and a threshold voltage monitor circuit are newly added to perform the delay variation correction, and the whole consumption current is increased. However, since it is possible to set the minimum power supply voltage satisfying the delay constraint by performing the delay variation correction, it can be confirmed that the consumption current of the subthreshold digital CMOS circuit can be reduced as compared with the uncorrected case.

For the above reasons, the variation in the delay time due to the process variation and the temperature change can be corrected by employing the proposed delay variation correcting circuit, and it is possible to reduce the consumption current of the subthreshold digital CMOS circuit.

Third Embodiment

Figure 23:
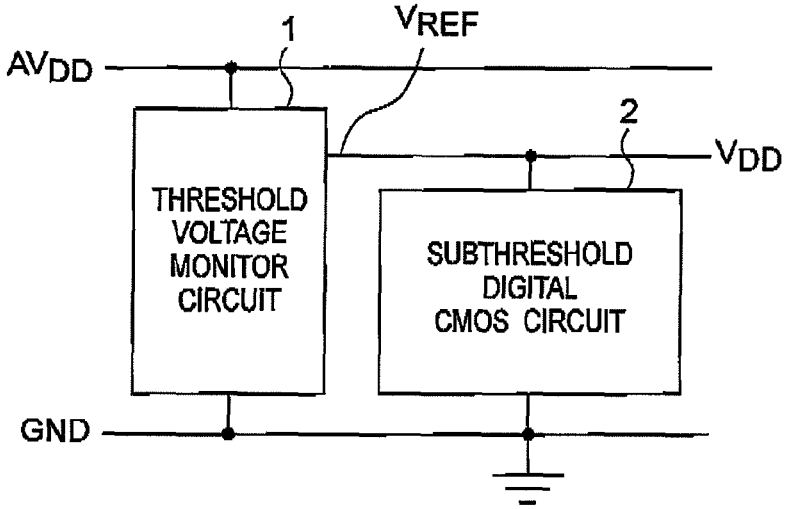
FIG. 23 is a block diagram showing a configuration of a delay variation correcting circuit for a subthreshold digital CMOS circuit according to a third embodiment of the present invention.
Figure 24:
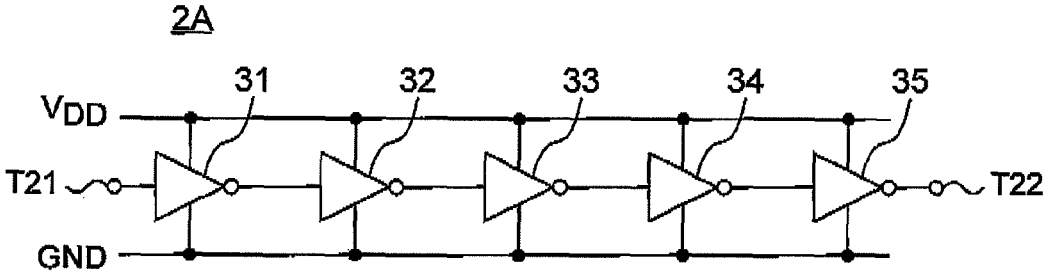

FIG. 23 is a block diagram showing a configuration of a delay variation correcting circuit for a subthreshold digital CMOS circuit according to the third embodiment of the present invention. FIG. 24 is a circuit diagram showing a configuration of a ring oscillator 2A, which is one example of the subthreshold digital CMOS circuit of FIG. 23 (and is applicable to the other embodiments without being limited to the third embodiment).

Referring to FIG. 23, as compared with the delay variation correcting circuit of FIG. 5, the delay variation correcting circuit of the third embodiment does not include the voltage buffer circuit 3, and supplies the output voltage $V_{REF}$ from the threshold voltage monitor circuit 1 to the subthreshold digital CMOS circuit 2 as it is as the power supply voltage $V_{DD}$. In the present embodiment, when the threshold voltage monitor circuit 1 has a large current supply ability and can support the operating current of the subthreshold digital CMOS circuit 2 sufficiently, a structure as shown in FIG. 23 may be provided.

Referring to FIG. 24, the ring oscillator 2A, which is one example of the subthreshold digital CMOS circuit is configured to include five inverters 31 to 35, each of which is configured to include a pMOSFET and an nMOSFET (for example, FIG. 21), connected in cascade between terminals T21 and T22.

Fourth Embodiment

Figure 25:
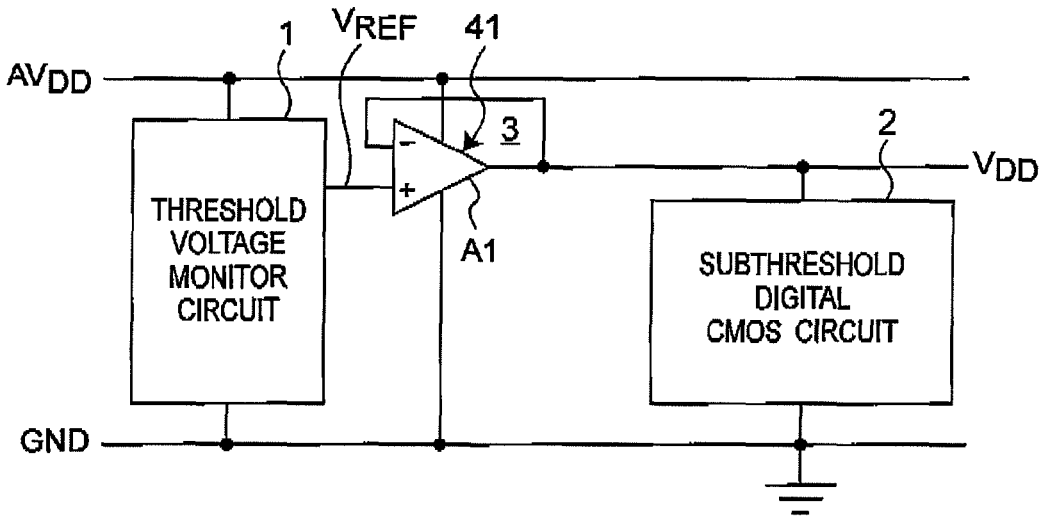
FIG. 25 is a block diagram showing a configuration of a delay variation correcting circuit for a subthreshold digital CMOS circuit according to a fourth embodiment of the present invention.

FIG. 25 is a block diagram showing a configuration of a delay variation correcting circuit for a subthreshold digital CMOS circuit according to the fourth embodiment of the present invention. Referring to FIG. 25, the voltage buffer circuit 3 is configured to include a voltage follower circuit 41, in which an inverted input terminal of an operational amplifier A1 is connected to an output terminal of the operational amplifier A1. The output voltage $V_{REF}$ the threshold voltage monitor circuit 1 is inputted to a non-inverted input terminal of the operational amplifier A1. The power supply voltage $V_{DD}$, which corresponds to the output voltage $V_{REF}$ and is substantially the same as the output voltage $V_{REF}$, is generated from the output terminal of the operational amplifier A1, and supplied to the subthreshold digital CMOS circuit 2. In the present embodiment, the power supply voltage $V_{DD}$ can be supplied by increasing a supply current by the voltage follower circuit 41.

Fifth Embodiment

Figure 26:
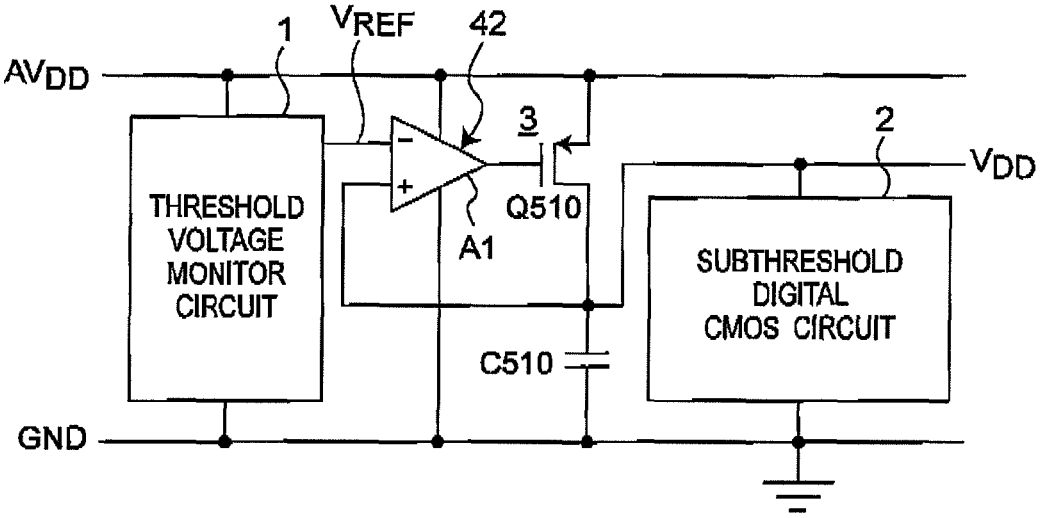
FIG. 26 is a block diagram showing a configuration of a delay variation correcting circuit for a subthreshold digital CMOS circuit according to a fifth embodiment of the present invention.

FIG. 26 is a block diagram showing a configuration of a delay variation correcting circuit for a subthreshold digital CMOS circuit according to the fifth embodiment of the present invention. Referring to FIG. 26, the voltage buffer circuit 3 is configured to include the operational amplifier A1, a pMOSFET Q510, and a capacitor C510. The output terminal of the operational amplifier A1 is connected to a gate of the pMOSFET Q510, a drain of the pMOSFET Q510 is connected to the non-inverted input terminal of the operational amplifier A1 and one end of the capacitor Q510, and the other end of the capacitor Q510 is grounded. The output voltage $V_{REF}$ from the threshold voltage monitor circuit 1 is inputted to the non-inverted input terminal of the operational amplifier A1. A voltage that corresponds to the output voltage $V_{REF}$ and is substantially the same as the output voltage $V_{REF}$ is generated from the output terminal of the operational amplifier A1, and thereafter, generated as the power supply voltage $V_{DD}$ via the pMOSFET Q510, and supplied to the subthreshold digital CMOS circuit 2. In the present embodiment, it is possible to supply the power supply voltage $V_{DD}$ by increasing the supply current by a regulator circuit 42.

Sixth Embodiment

Figure 27:
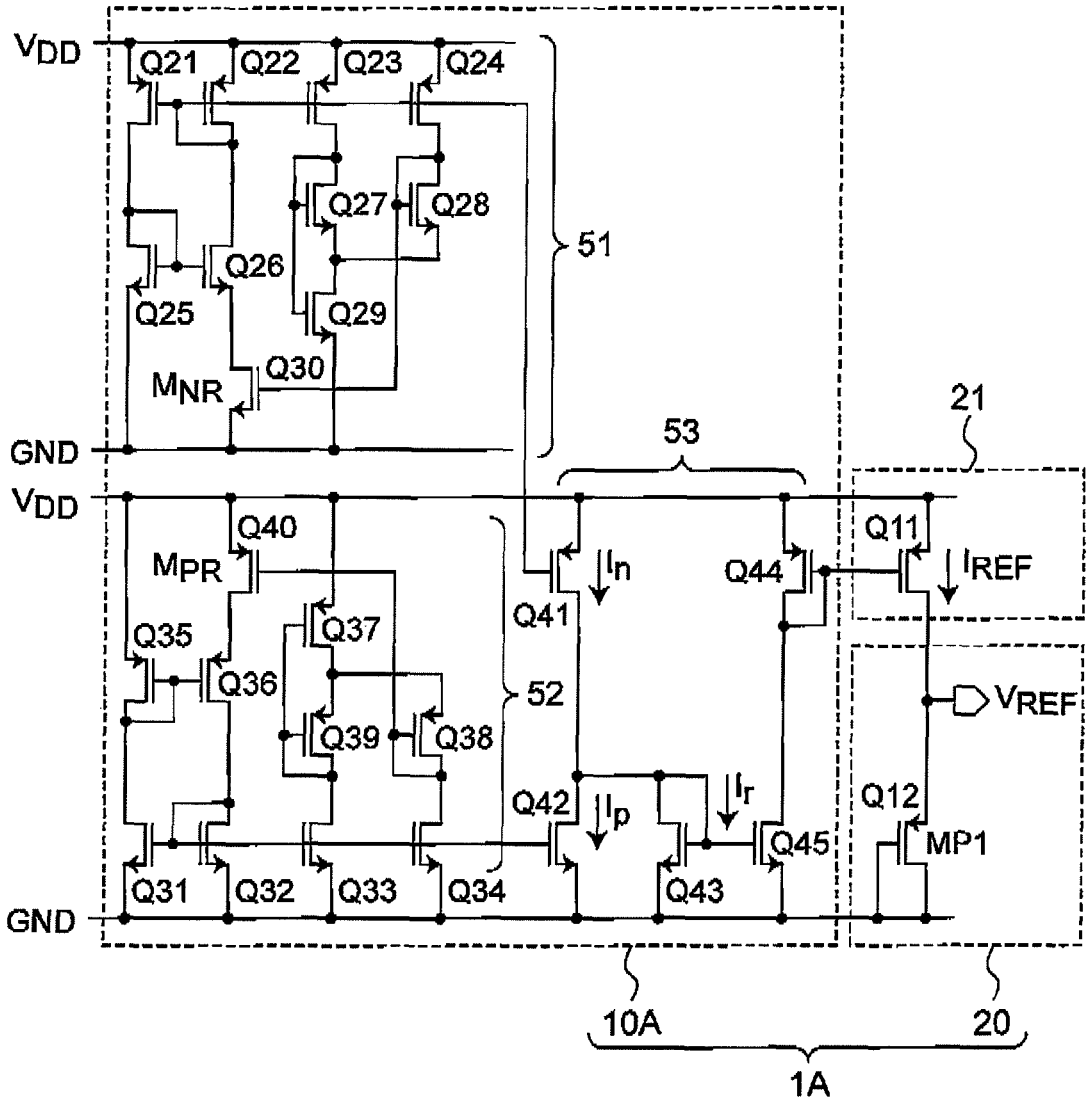

FIG. 27 is a circuit diagram showing a configuration of a delay variation correcting circuit according to the sixth embodiment, which is a modified embodiment of the delay variation correcting circuit of FIG. 5 and the like. The delay variation correcting circuit of the sixth embodiment is characterized in that the current source circuit part 10 is configured to include a reference current source circuit 10A. Referring to FIG. 27, the reference current source circuit 10A is characterized by including:

(1) an nMOS-configured power supply circuit 51, in which a temperature characteristic of an output current is determined by an electron mobility;

(2) a pMOS-configured power supply circuit 52, in which a temperature characteristic of an output current is determined by a hole mobility; and (3) a current subtraction circuit 53 for generating an output current $I_n$ based on an output voltage from the nMOS-configured power supply circuit 1, generating an output current $I_p$ based on an output voltage from the pMOS-configured power supply circuit 2, and outputting a reference output current $I_r=I_n-I_p$ obtained by subtraction of them.

In addition, a threshold voltage monitor circuit 1A that constitutes a delay variation correcting circuit is configured to include the reference current source circuit 10A, the current mirror circuit part 21 and the threshold voltage monitor circuit part 20.

Referring to FIG. 27, the nMOS-configured power supply circuit 51 is configured to include pMOSFETs Q21 to Q24 and nMOSFETs Q25 to Q30, and a main current generator transistor is the nMOSFET ($M_{NR}$) Q30. In addition, the pMOS-configured power supply circuit 52 is configured to include nMOSFETs Q31 to Q34 and pMOSFETs Q35 to Q40, and a main current generator transistor is the pMOSFET ($M_{PR}$) Q40. The current subtraction circuit 53 is configured to include pMOSFETs Q21 to Q24 and nMOSFETs Q25 to Q30. In the current subtraction circuit 53, the pMOSFET Q41 constitutes a current mirror circuit to generate the current $I_n$ which corresponds to an output current generated in the nMOS-configured power supply circuit 51 and is substantially the same as it. The nMOSFET Q42 constitutes a current mirror circuit to generate the current $I_p$ which corresponds to an output current generated in the pMOS-configured power supply circuit 52 and is substantially the same as it. The current subtraction circuit 53 generates a difference current $I_r=I_n-I_p$ The current mirror circuit part 21 generates a reference current (minute current) $I_{REF}$ which corresponds to the difference current $I_r$ and is substantially the same as the difference current $I_r$, and supplies the reference current $I_{REF}$ to the threshold voltage monitor circuit part 20 as a bias current.

Generally speaking, temperature dependence of an output current of a reference current source circuit depends on a temperature coefficient m of mobilities of the current generator transistors $M_{NR}$ and $M_{PR}$. As described above, since the temperature coefficients of these output currents are always positive, the current value increases with the temperature rises. In this case, a complementary circuit structure of these circuits is considered. By the complementary circuit structure, it is possible to construct a circuit which refers to a pMOS carrier mobility. With this arrangement, currents based on the carrier mobilities of electrons and holes can be generated, respectively. Since the electrons and holes have temperature coefficients different from each other, temperature dependencies of the currents generated by them are also different from each other. Therefore, as shown in FIG. 27, a reference current source circuit which generates a substantially constant current with respect to the temperature change is constituted.

In this case, a temperature coefficient $TC_{In}$ of the output current $I_n$ of the nMOS-configured power supply circuit 51 and a temperature coefficient $TC_{ip}$ of the output current $I_p$ of the pMOS-configured power supply circuit 52 are expressed by the following equations:

$$TC_{In} = \frac{1}{I_n}\frac{dI_n}{dT} = \frac{2-m_n}{T}, \text{ and} \tag{48}$$

-continued $$TC_{Ip} = \frac{1}{I_p}\frac{dI_p}{dT} = \frac{2-m_p}{T}, \tag{49}$$

where $m_n$ represents the temperature coefficient of the mobility of the nMOSFET, and $m_p$ represents the temperature coefficient of the mobility of the pMOSFET. According to the Equation (48) and the Equation (49), slopes of the output currents with respect to the temperature change are expressed by the following equations, respectively:

$$\frac{dI_n}{dT} = \frac{2-m_n}{T}I_n, \text{ and} \tag{50}$$

$$\frac{dI_p}{dT} = \frac{2-m_p}{T}I_p. \tag{51}$$

As apparent from, the Equation (50) and Equation (51), changes are caused by the current values $I_n$ and $I_p$. The slope of the reference output current $I_{ref}$ obtained by taking a difference between these current values by the current subtraction circuit 53 with respect to the temperature change is expressed by the following equation:

$$\frac{dI_{ref}}{dT} = \frac{2-m_n}{T}I_n - \frac{2-m_p}{T}I_p = \frac{2-m_n}{T}I_n f(T), \tag{52}$$

where f(T) is expressed by the following equation:

$$f(T) = 1 - \frac{2-m_p}{2-m_n}\frac{I_p}{I_n}, \tag{53}$$

In this case, the current values $I_n$ and $I_p$ are determined by the size of the nMOSFET and the size of the pMOSFET, respectively, and therefore, it is possible to generate a current $I_r$ substantially constant against the temperature change by determining and setting f(T) of the Equation (53) by the size of the nMOSFET and the size of the pMOSFET so that f(T) of the Equation (53) becomes constant. Then, based on the generated current $I_r$, the current mirror circuit part 21 generates the reference current (the minute current) $I_{REF}$ which corresponds to the difference current $I_r$ and is substantially the same as the reference current $I_{REF}$, and supplies the same current to the threshold voltage monitor circuit part 20 as a bias current. Therefore, the reference current $I_{REF}$, which scarcely changes with respect to the temperature change can be generated, and the controlled output voltage $V_{REF}$ can be generated.

Seventh Embodiment

Figure 28:
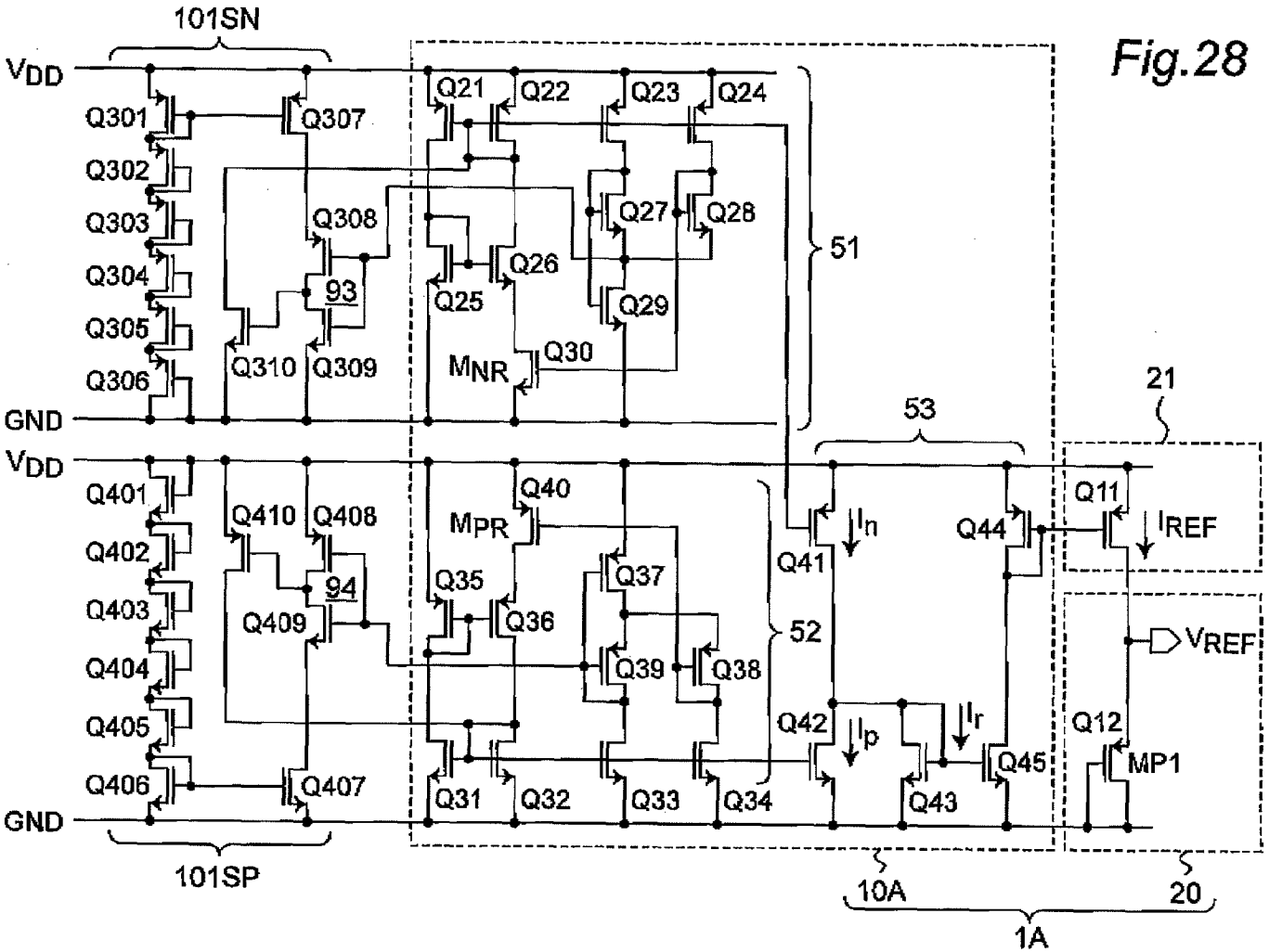
FIG. 28 is a block diagram showing a configuration of a delay variation correcting circuit for a subthreshold digital CMOS circuit according to a seventh embodiment of the present invention.

FIG. 28 is a block diagram showing a configuration of a delay variation correcting circuit for a subthreshold digital CMOS circuit according to the seventh embodiment of the present invention. The reference current source circuit 10A of the delay variation correcting circuit of the seventh embodiment is characterized by further including startup circuits 101SN and 101SP in the reference current source circuit 10A of FIG. 27. The reason why the startup circuits 101SN and 101SP are provided is as follows. There is such a case where gates of all of the nMOSFETs have a voltage of 0 V and gates of all of the pMOSFETs have the power supply voltage $V_{DD}$ in the reference current source circuit 10A. In such case, there is a case of non-operation (referred to as a zero current state time hereinafter) of the circuit 10A where no current flows through the circuit 10A and the circuit 10A does not operate. In order to avoid this, the startup circuits 101SN and 101SP are employed.

Referring to FIG. 28, the startup circuit 101SN is configured to include a plurality of stages of pMOSFETs Q301 to Q306 of diode connection, a pMOSFET Q307 that constitutes a current mirror circuit, a pMOSFET Q308 and an nMOSFET Q309 that constitute an inverter 93, and an nMOSFET Q310 which extracts and applies an operating current. In addition, the startup circuit 101SP is configured to include a plurality of stages of nMOSFETs Q401 to Q406 of diode connection, an nMOSFET Q407 which constitutes a current mirror circuit, a pMOSFET Q408 and an nMOSFET Q409 which constitute an inverter 94, and a pMOSFET Q410 which applies an operating current compulsorily. In this case, the startup circuits 101SN and 101SP operate only in the zero current state time, and do not operate when the circuit is operating at a normal operating point.

In the startup circuit 101SN, the non-operation of the nMOS-configured power supply circuit 51 is detected by monitoring the source voltage of the nMOSFET Q32 by the inverter 93. When the source voltage is 0 V (in the non-operation), an output signal of the inverter 93 becomes high level, and the high-level output signal is applied to a gate of the nMOSFET Q310 so as to turn on the nMOSFET Q310. By this operation, the nMOSFET Q310 extracts a current from the pMOSFET Q48, and this current becomes a starting current of the nMOS-configured power supply circuit 51 to start up the circuit 101N and make it stably operate. When a monitor voltage by the inverter 93 is an operating voltage, the output signal of the inverter 93 becomes low level (0 V), and this low-level output signal is applied to the gate of the nMOSFET Q310, and the nMOSFET Q310 is kept to be turned off. Therefore, no current flows through the nMOSFET Q310. Namely, no influence is exerted on the circuit operation in the normal operating time. A substantially constant minute current is generated by the plurality of stages of the pMOSFETs Q301 to Q306 of diode connection, and the pMOSFET Q307 of the current mirror circuit supplies a minute current corresponding to the generated minute current to the inverter 93 as a bias operating current. By this operation, the current flowing through the inverter 93 is controlled not to become large for a reduction in the power consumption.

The startup circuit 101SP operates in a manner similar to that of the startup circuit 101SN as follows. In the startup circuit 101SP, the non-operation of the pMOS-configured power supply circuit 52 is detected by monitoring the source voltage of the pMOSFET Q52 by the inverter 94. When the source voltage is high level (power supply voltage $V_{DD}$) (in the non-operation), an output signal of the inverter 94 becomes low level, and the low-level output signal is applied to a gate of the pMOSFET Q410 so as to turn on the pMOSFET Q410. By this operation, the pMOSFET Q410 applies a current compulsorily to the nMOSFET Q61, and this current becomes a starting current of the pMOS-configured power supply circuit 52 to start up the circuit 101P and make it stably operate. When a monitor voltage by the inverter 94 is 0 V, the output signal of the inverter 94 becomes high level, and this high-level output signal is applied to the gate of the pMOSFET Q410, and the pMOSFET Q410 is kept to be turned off. Therefore, no current flows through the pMOSFET. Namely, no influence is exerted on the circuit operation in the normal operating time. A substantially constant minute current is generated by the plurality of stages of nMOSFETs Q401 to Q406 of diode connection, and the nMOSFET Q407 of the current mirror circuit supplies a minute current corresponding to the generated minute current to the inverter 94 as a bias operating current. By this operation, the current flowing through the inverter 94 is controlled not to become large for a reduction in the power consumption.

Figure 29:
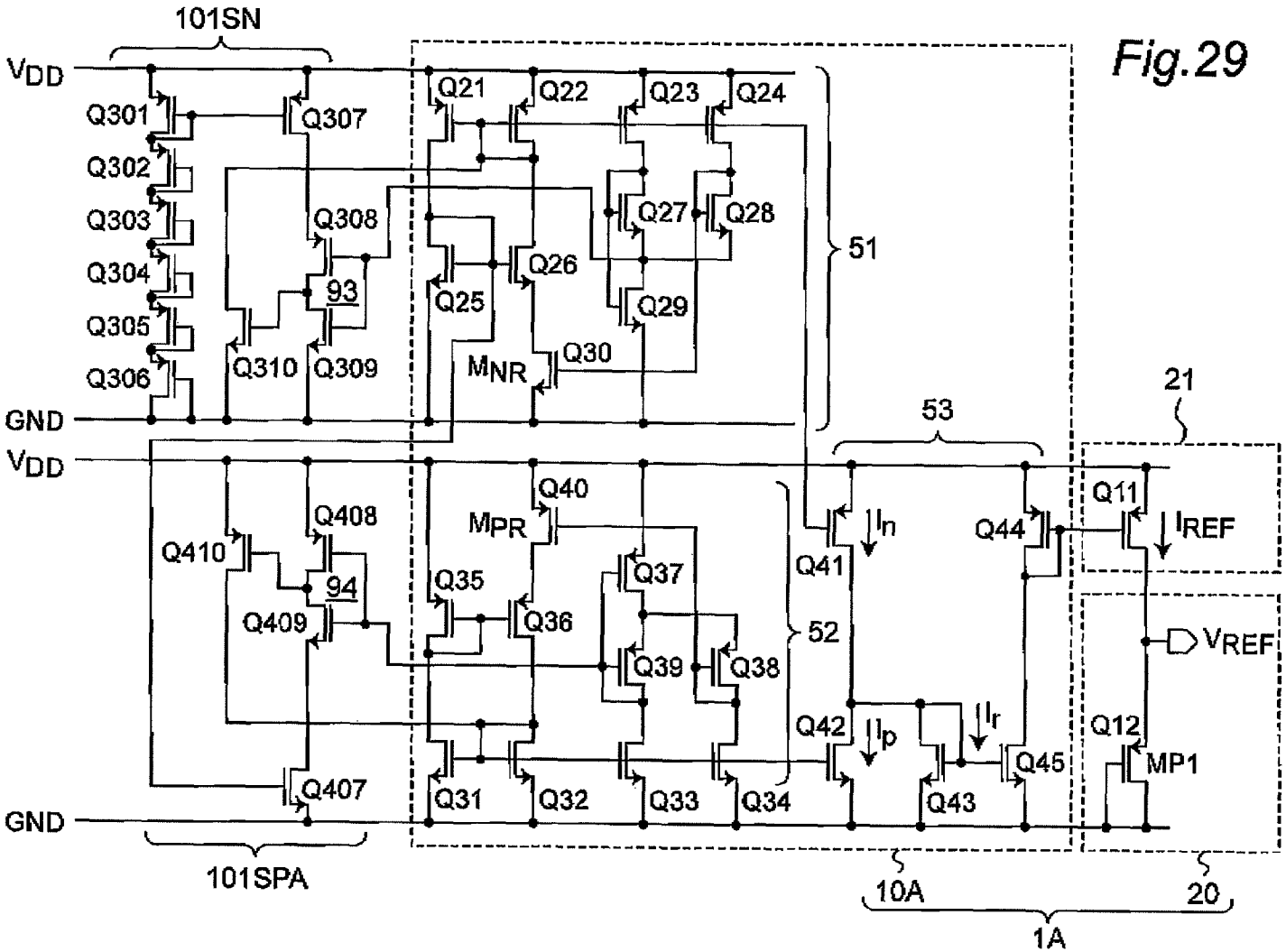
FIG. 29 is a block diagram showing a configuration of a delay variation correcting circuit for a subthreshold digital CMOS circuit according to a first modified embodiment of the seventh embodiment of the present invention.

FIG. 29 is a block diagram showing a configuration of a delay variation correcting circuit for a subthreshold digital CMOS circuit according to a first modified embodiment of the seventh embodiment of the present invention. The reference current source circuit 10A of the delay variation correcting circuit according to the first modified embodiment of the seventh embodiment is different from the reference current source circuit 10A of FIG. 28 in the following points.

(1) A startup circuit 101SPA is provided instead of the startup circuit 101SP. In this case, as compared with the startup circuit 101SP, the startup circuit 101SPA is characterized in that it does not employ the plurality of stages of the nMOSFETs Q401 to Q406 of diode connection but generates a current corresponding to the current (concretely speaking, for example, source current of the nMOSFET Q34) of the reference current source circuit 101N by the nMOSFET Q407 of the current mirror circuit, and uses the current as the bias current of the inverter 94. This arrangement has such an effect that the circuit size can be reduced since the plurality of stages of the nMOSFETs Q401 to Q406 of diode connection are not employed.

Figure 30:
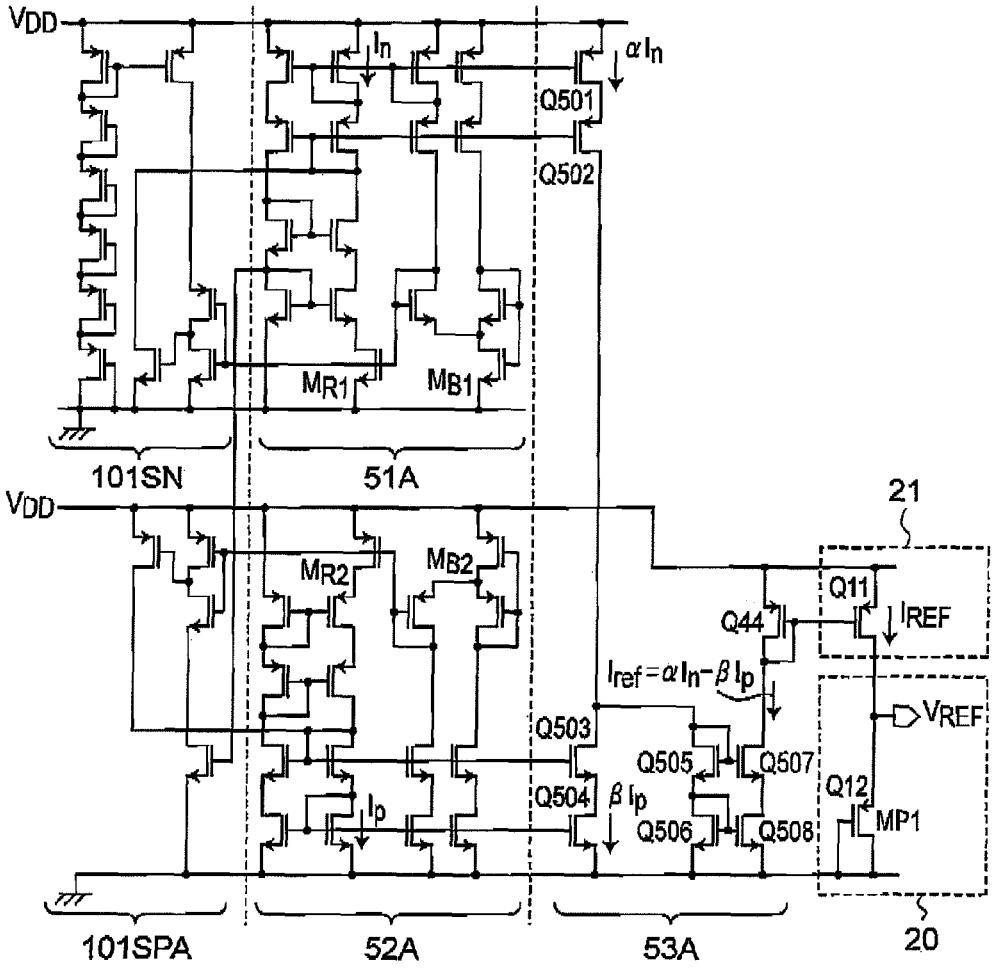
FIG. 30 is a block diagram showing a configuration of a delay variation correcting circuit for a subthreshold digital CMOS circuit according to a second modified embodiment of the seventh embodiment of the present invention.

FIG. 30 is a block diagram showing a configuration of a delay variation correcting circuit for a subthreshold digital CMOS circuit according to a second modified embodiment of the seventh embodiment of the present invention. The delay variation correcting circuit of the second modified embodiment of the seventh embodiment is configured to include startup circuits 101SN and 101PA, an nMOS-configured power supply circuit 51A corresponding to the nMOS-configured power supply circuit 51 of FIG. 29, a pMOS-configured power supply circuit 52A corresponding to the pMOS-configured power supply circuit 52 of FIG. 29, a current subtraction circuit 53A corresponding to the current subtraction circuit 29 of FIG. 29, the current mirror part 21, and the threshold voltage monitor circuit part 20. In this case, the current subtraction circuit 53A is configured to include pMOSFETs Q44, Q501 and Q502 and nMOSFETs Q503 to Q508. In addition, $M_{R1}$ and $M_{R2}$ are main current generator transistors, and $M_{B1}$ and $M_{B2}$ are main bias current generator transistors.

Referring to FIG. 30, the nMOS-configured power supply circuit 51A outputs an output current $\alpha I_n$, the pMOS-configured power supply circuit 52A outputs an output current $\beta I_p$, and the current subtraction circuit 53A outputs a reference output current $I_{ref}=\alpha I_n-\beta I_p$. The current mirror part 21 outputs the reference output current $I_{REF}$ corresponding to the reference output current $I_{ref}$, and the threshold voltage monitor circuit part 20 generates the controlled output voltage $V_{REF}$ corresponding to the reference output current $I_{REF}$, and outputs the same voltage. In this case, the reference output current $I_{ref}$ can be made constant with respect to the temperature change by changing the coefficients $\alpha$ and $\beta$ by changing the manufacturing process and changing the transistor size or the like.

Figure 31:
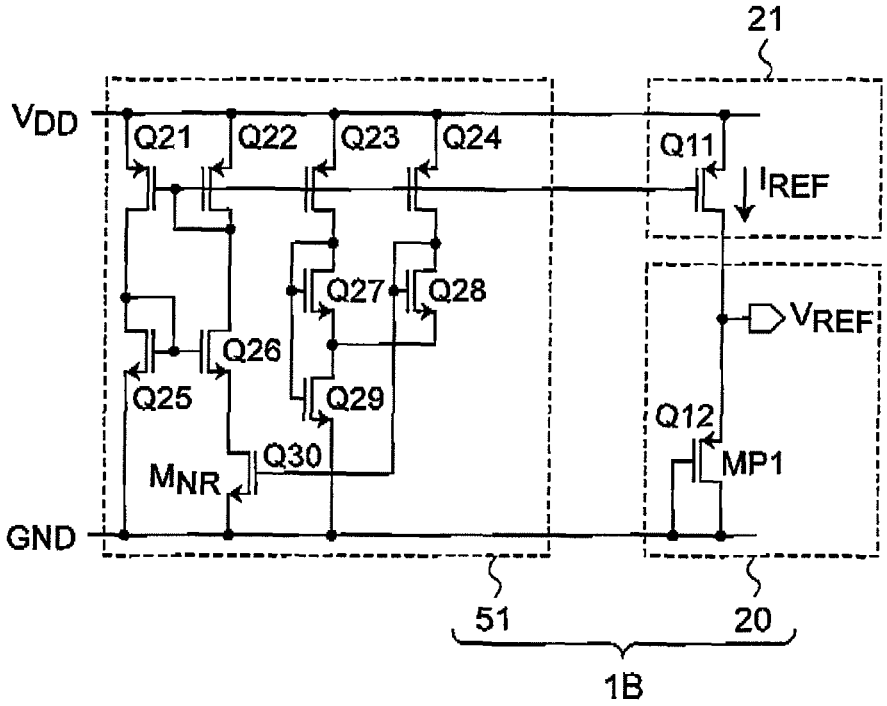
FIG. 31 is a block diagram showing a configuration of a delay variation correcting circuit for a subthreshold digital CMOS circuit according to a third modified embodiment of the seventh embodiment of the present invention.

FIG. 31 is a block diagram showing a configuration of a delay variation correcting circuit for a subthreshold digital CMOS circuit according to a third modified embodiment of the seventh embodiment of the present invention. As shown in FIG. 31, a threshold voltage monitor circuit 1B of the delay variation correcting circuit may be configured to include the nMOS-configured power supply circuit 51, the current mirror part 21, and a threshold voltage monitor circuit part 20.

Figure 32:
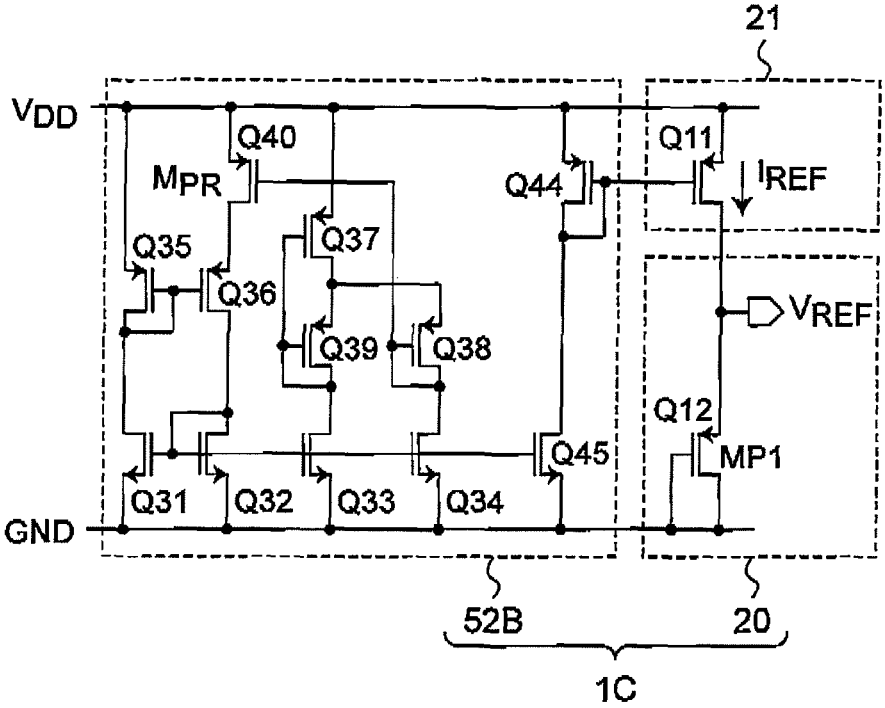
FIG. 32 is a block diagram showing a configuration of a delay variation correcting circuit for a subthreshold digital CMOS circuit according to a fourth modified embodiment of the seventh embodiment of the present invention.

FIG. 32 is a block diagram showing a configuration of a delay variation correcting circuit for a subthreshold digital CMOS circuit according to a fourth modified embodiment of the seventh embodiment of the present invention. As shown in FIG. 32, a threshold voltage monitor circuit 1C of the delay variation correcting circuit may be configured to include a pMOS-configured power supply circuit 52B, the current mirror part 21, and the threshold voltage monitor circuit part 20.

Figure 33:
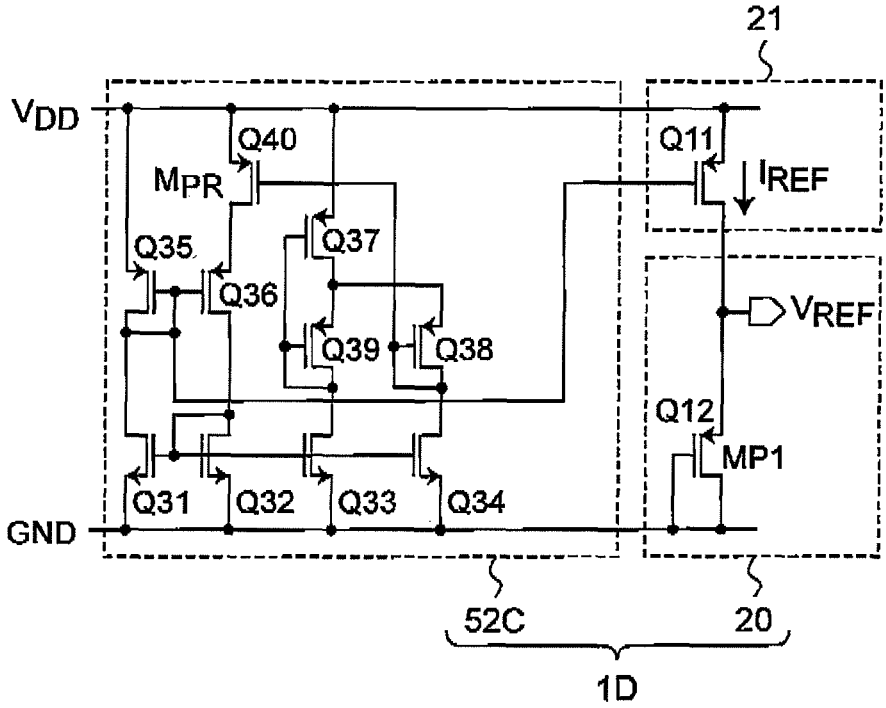
FIG. 33 is a block diagram showing a configuration of a delay variation correcting circuit for a subthreshold digital CMOS circuit according to a fifth modified embodiment of the seventh embodiment of the present invention.

FIG. 33 is a block diagram showing a configuration of a delay variation correcting circuit for a subthreshold digital CMOS circuit according to a fifth modified embodiment of the seventh embodiment of the present invention. As shown in FIG. 33, a threshold voltage monitor circuit 1D of the delay variation correcting circuit may be configured to include a pMOS-configured power supply circuit 52C, the current mirror part 21 and, the threshold voltage monitor circuit part 20.

As described above, the current source circuits of the following two types can be employed as a reference current source circuit to be used as a minute current generator circuit.

(A) The so-called current source circuit of Oguey et al. (for example, the current source circuit part 10 of FIG. 6)

Since the threshold voltage is not included in the equation of the output current, the process variation is suppressed to some degree. It is considered that there is little problem since the temperature dependence scarcely changes although the temperature dependence remains.

(B) A reference current source (using an electron mobility dependent current and a hole mobility dependent current. See FIGS. 29 and 30, for example).

The output current is stable against the process variation. In addition, the current also has little temperature dependence. However, the current characteristic changes with respect to the temperature change due to the electrical characteristic of the subthreshold digital CMOS circuit 2. Namely, a certain temperature characteristic remains even if biased using a reference current.

According to the above facts, the following three types can be employed as the minute current source circuit.

(A) The so-called current source circuit of Oguey et al.

This circuit is an existing current source circuit, and has a concern about the problem of variation, but can be employed.

(B) An electron or hole mobility dependent current source circuit This circuit is an existing current source circuit, but has such an effect that the variation tolerance is improved.

(C) A temperature dependent adjusting type current source circuit obtained by applying the reference current source circuit.

This circuit is an existent current source circuit, which utilizes a current source circuit dependent on the electron mobility and the hole mobility, and has such an effect that the variation tolerance is improved and the temperature characteristic can be also controlled. In this case, the temperature characteristic coefficient becomes positive even if the reference current is used. Conversely speaking, it is required to make the temperature characteristic of the minute current negative in order to make the temperature characteristic constant. In the reference current source circuit that utilizes the currents dependent on the electron mobility and the hole mobility, it is possible to generate a current having a negative dependence by subtracting the current dependent on the hole mobility more than the current dependent on the electron mobility. By taking advantage of this, the temperature characteristic can be made controllable (See the circuit of FIG. 30, for example).

Figure 34:
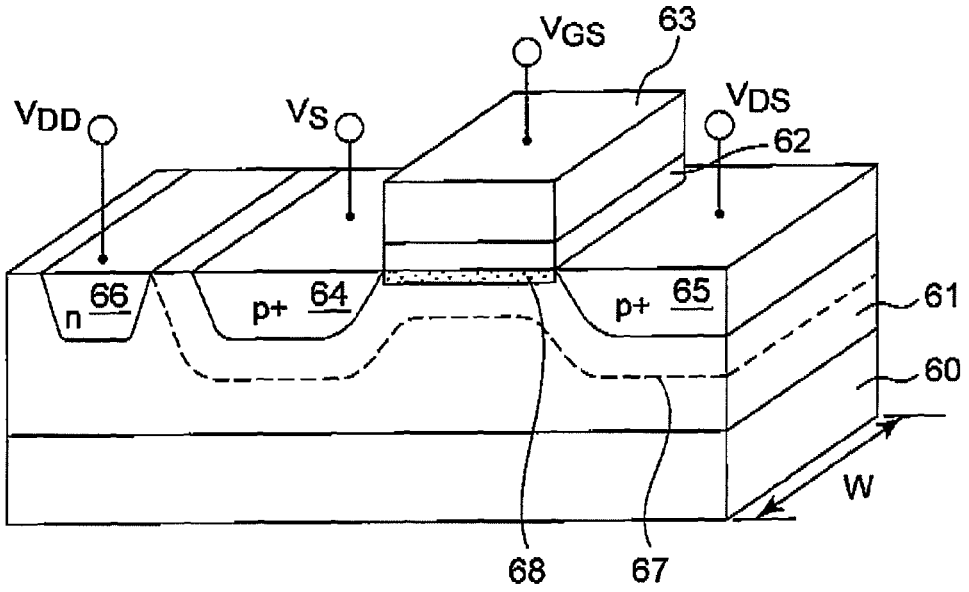
FIG. 34 is a perspective view showing a structure of a pMOSFET for use in the subthreshold digital CMOS circuit employed in each of the embodiments.

FIG. 34 is a perspective view showing a structure of the pMOSFET for use in the subthreshold digital CMOS circuit employed in each embodiment. In this case, the outline of the manufacturing process of the pMOSFET and a threshold voltage setting method are described below. The pMOSFET is described below, however, the nMOSFET can be described in a manner similar to that of the pMOSFET, and therefore, no detailed description is provided for the nMOSFET.

Referring to FIG. 34, after an n-well 61 is formed by injecting an n+ type impurity into a p-type semiconductor substrate 60, a gate oxide film 62 is formed on the n-well 61, and a gate electrode 63 having a gate width W is formed on it. By injecting a high-concentration p+ impurity on both sides of the gate electrode 63, a source electrode 64 and a drain 65 are formed. In addition, an n-type power terminal 66 is formed on the n-well 61. When a predetermined voltage is applied to the electrodes 63 to 65 and the power electrode 66, a depletion layer 67 is formed in the n-well 61 just beneath the electrodes 64 and 65, and an inversion channel 68 is formed just beneath the gate oxide film 62. In this case, the threshold voltage $V_{TH}$ is expressed by the following equation:

$$V_{TH} = V_{fb} + 2\phi_B + \frac{\sqrt{4\varepsilon_{si} q N_a \phi_B}}{C_{OX}}. \tag{54}$$

In this case, $V_{fb}$, is a flat-band voltage, $\phi_B$ is the Fermi level, $\in_{si}$ is a relative permittivity of the dielectric substrate 60 configured to include, for example, a silicon substrate, q is an elementary electric charge amount, Na is an impurity amount of the channel, and $C_{OX}$ is a capacitance of the gate oxide film 62. As apparent from the Equation (54), by changing, for example, the parameters Na, $\in_{si}$ and $C_{OX}$ according to the manufacturing processes, the threshold voltage $V_{TH}$ can be changed and set. In addition, by setting a voltage of the n-well 61, which is a substrate voltage, higher than the source voltage $V_s$, it is possible to change, for example, the Fermi level, and it is possible to change and set the threshold voltage $V_{TH}$. By using the above method, the absolute value of the difference between the threshold voltage of the typical value of the pMOSFET and the threshold voltage of the typical value of the nMOSFET can be set equal to or larger than 0.1 V.

INDUSTRIAL APPLICABILITY

As described above in detail, according to the power supply voltage controlling circuit and method for the subthreshold digital CMOS circuit of the present invention, there are provided a minute current generator circuit for generating a minute current based on a power supply voltage of a power supply unit, and a controlled output voltage generator circuit for generating a controlled output voltage for correcting a variation in the delay time based on a generated minute current, and for supplying the controlled output voltage to the subthreshold digital CMOS circuit as a controlled power supply voltage, the controlled output voltage including a change in the threshold voltage of one of a pMOSFET and an nMOSFET. Therefore, by performing on-chip monitoring of the threshold voltage of a MOSFET and reflecting monitoring results on the power supply voltage of the CMOS circuit, it is possible to correct the delay variation of the subthreshold digital CMOS circuit operating in the subthreshold region, and it is possible to reduce the power consumption of the entire circuit.

REFERENCE NUMERICALS

1, 1-1 to 1-4, 1A, 1B, and 1C . . . threshold voltage monitor circuit (delay variation correcting circuit),

2 . . . subthreshold digital CMOS circuit,
3 . . . voltage buffer circuit,
10 . . . current source circuit part,
10A . . . reference current source circuit,
20 and 20-1 to 20-4 . . . threshold voltage monitor circuit part,
21 . . . current mirror part,
22, 23, 24, and 25 . . . threshold voltage monitor part,
31 to 35 . . . inverter,
41 . . . voltage follower circuit,
42 . . . regulator circuit,
51 and 51A . . . pMOS-configured power supply circuit,
52 and 52A . . . nMOS-configured power supply circuit,
53 and 53A . . . current subtraction circuit,
60 . . . p-type semiconductor substrate,
61 . . . n-well,
62 . . . gate oxide film,
63 . . . gate electrode,
64 . . . source electrode,
65 . . . drain electrode,
66 . . . power electrode,
67 . . . depletion layer,
68 . . . inversion channel,
101SN, 101SP, and 101SPA . . . startup circuit,
201 . . . minute current generator circuit,
A1 . . . operational amplifier,
C510 . . . capacitor,
Q1 to Q510 . . . MOSFET,
MP1 and Q91H . . . p-channel MOSFET (pMOSFET),
MN1 and Q92H . . . n-channel MOSFET (nMOSFET),
T1 to T22 . . . terminal,
p-HVT . . . p-type high threshold voltage device, and
n-HVT . . . n-type high threshold voltage device.

What is claimed is:

1. A power supply voltage controlling circuit for supplying a controlled output voltage to a subthreshold digital CMOS circuit as a controlled power supply voltage, the subthreshold digital CMOS circuit comprising a plurality of CMOS circuits each having a pMOSFET and an nMOSFET and operating in a subthreshold region with a predetermined delay time, wherein, in the subthreshold digital CMOS circuit, an absolute value of a difference between a threshold voltage of a typical value of the pMOSFET and a threshold voltage of a typical value of the nMOSFET is set to a value equal to or larger than a predetermined value so that one of the following conditions is satisfied:

(A) a proportion w of the delay time of the CMOS circuit determined by a rise time of the pMOSFET becomes substantially one, and a proportion (1−w) of the delay time of the CMOS circuit determined by a fall time of the nMOSFET becomes substantially zero; or (B) the proportion w of the delay time of the CMOS circuit determined by the rise time of the pMOSFET becomes substantially zero, and the proportion (1−w) of the delay time of the CMOS circuit determined by the fall time of the nMOSFET becomes substantially one, where w is a weight coefficient, and wherein the power supply voltage controlling circuit comprises:

a first minute current generator circuit for generating a predetermined minute current based on a power supply voltage of a power supply unit; and a controlled output voltage generator circuit for generating a controlled output voltage for correcting a variation in the delay time based on a generated minute current, and for supplying the controlled output voltage to the subthreshold digital CMOS circuit as a controlled power supply voltage, the controlled output voltage including a change in the threshold voltage of one of the pMOSFET and the nMOSFET.

2. The power supply voltage controlling circuit as claimed in claim 1, wherein the subthreshold digital CMOS circuit is set so that the absolute value of the difference between the threshold voltage of the typical value of the pMOSFET and the threshold voltage of the typical value of the nMOSFET is equal to or larger than 0.1 V.

3. The power supply voltage controlling circuit as claimed in claim 1, wherein the first minute current generator circuit comprises:

a current source circuit for generating the minute current based on the power supply voltage of the power supply unit by using a predetermined current source; and a first current mirror circuit for generating a minute current, which corresponds to the minute current generated by the current source circuit and is substantially the same as the minute current generated by the current source circuit.

4. The power supply voltage controlling circuit as claimed in claim 3, wherein the current source circuit includes a first power supply circuit, which includes a current-generating nMOSFET and generates a first current having a temperature characteristic of an output current which depends on electron mobility.

5. The power supply voltage controlling circuit as claimed in claim 3, wherein the current source circuit comprises a second power supply circuit, which includes a current-generating pMOSFET and generates a second current having a temperature characteristic of an output current which depends on hole mobility.

6. The power supply voltage controlling circuit as claimed in claim 3, wherein the current source circuit comprises:

a first power supply circuit, which includes a current-generating nMOSFET and generates a first current having a temperature characteristic of an output current which depends on electron mobility;

a second power supply circuit, which includes a current-generating pMOSFET and generates a second current having a temperature characteristic of an output current which depends on hole mobility; and a current subtraction circuit for generating a reference current by subtracting the second current from the first current.

7. The power supply voltage controlling circuit as claimed in claim 6, wherein each of the first power supply circuit and the second power supply circuit further comprises a startup circuit, and wherein the startup circuit comprises:

a detector circuit for detecting non-operations of the first power supply circuit and the second power supply circuit; and a startup transistor circuit for starting up the first power supply circuit and the second power supply circuit by applying a predetermined current to the first power supply circuit and the second power supply circuit when the non-operations of the first power supply circuit and the second power supply circuit are detected by the detector circuit.

8. The power supply voltage controlling circuit as claimed in claim 7, wherein each of the startup circuits of the first power supply circuit and the second power supply circuit further comprises a current supply circuit for supplying a bias operating current to the detector circuit, and wherein the current supply circuit comprises:

a second minute current generator circuit for generating a predetermined minute current from a power supply voltage; and a second current mirror circuit for generating a minute current corresponding to the minute current generated by the second minute current generator circuit as the bias operating current supplied by the current supply circuit to the detector circuit.

9. The power supply voltage controlling circuit as claimed in claim 7, wherein the startup circuit of the first power supply circuit further comprises a first current supply circuit for supplying a bias operating current to the detector circuit, wherein the first current supply circuit comprises:

a second minute current generator circuit for generating a predetermined minute current from a power supply voltage; and a second current mirror circuit for generating a minute current corresponding to the minute current generated by the second minute current generator circuit as the bias operating current supplied by the first current supply circuit to the detector circuit, wherein the startup circuit of the second power supply circuit further comprises a second current supply circuit for supplying a bias operating current to the detector circuit, and wherein the second current supply circuit comprises:

a third current mirror circuit for generating a current corresponding to an operating current after startup of the second power supply circuit as the bias operating current supplied by the second current supply circuit to the detector circuit.

10. The power supply voltage controlling circuit as claimed in claim 1, wherein, the threshold voltage of the typical value of the pMOSFET of the subthreshold digital CMOS circuit is higher than the threshold voltage of the typical value of the nMOSFET of the subthreshold digital CMOS circuit, and wherein the controlled output voltage generator circuit comprises a pMOSFET having a grounded gate, a grounded drain, and a source connected to the first minute current generator circuit.

11. The power supply voltage controlling circuit as claimed in claim 1, wherein, the threshold voltage of the typical value of the nMOSFET of the subthreshold digital CMOS circuit is higher than the threshold voltage of the typical value of the pMOSFET of the subthreshold digital CMOS circuit, and wherein the controlled output voltage generator circuit comprises an nMOSFET having a gate connected to the first minute current generator circuit, a drain connected to the first minute current generator circuit, and a grounded source.

12. The power supply voltage controlling circuit as claimed in claim 1, wherein, the pMOSFET of the subthreshold digital CMOS circuit is a p-type high threshold device, and wherein the controlled output voltage generator circuit comprises a p-type high threshold device having a grounded gate, a grounded drain, and a source connected to the first minute current generator circuit.

13. The power supply voltage controlling circuit as claimed in claim 1, wherein, the nMOSFET of the subthreshold digital CMOS circuit is an n-type high threshold device, and wherein the controlled output voltage generator circuit comprises an n-type high threshold device having a gate connected to the first minute current generator circuit, a drain connected to the first minute current generator circuit, and a grounded source.

14. The power supply voltage controlling circuit as claimed in claim 1, wherein the power supply voltage controlling circuit further comprises:

a voltage buffer circuit, which is inserted between the controlled output voltage generator circuit and the subthreshold digital CMOS circuit, generates a power supply voltage corresponding to the controlled output voltage based on the controlled output voltage, and supplies the power supply voltage to the subthreshold digital CMOS circuit.

15. The power supply voltage controlling circuit as claimed in claim 1, wherein the power supply voltage controlling circuit further comprises:

a regulator circuit, which is inserted between the controlled output voltage generator circuit and the subthreshold digital CMOS circuit, generates a voltage corresponding to the controlled output voltage based on the controlled output voltage, regulates a generated voltage so as to generate a regulated power supply voltage, and supplies the regulated power supply voltage to the subthreshold digital CMOS circuit.

16. The power supply voltage controlling circuit as claimed in claim 1, wherein the subthreshold digital CMOS circuit is set by a manufacturing process so that the absolute value of the difference between the threshold voltage of the typical value of the pMOSFET and the threshold voltage of the typical value of the nMOSFET is equal to or larger than 0.1 V.

17. The power supply voltage controlling circuit as claimed in claim 1, wherein the subthreshold digital CMOS circuit is set by changing a substrate voltage so that the absolute value of the difference between the threshold voltage of the typical value of the pMOSFET and the threshold voltage of the typical value of the nMOSFET is equal to or larger than 0.1 V.

18. A power supply voltage controlling method of supplying a controlled output voltage to a subthreshold digital CMOS circuit as a controlled power supply voltage, the subthreshold digital CMOS circuit comprising a plurality of CMOS circuits each having a pMOSFET and an nMOSFET and operating in a subthreshold region with a predetermined delay time, wherein, in the subthreshold digital CMOS circuit, an absolute value of a difference between a threshold voltage of a typical value of the pMOSFET and a threshold voltage of a typical value of the nMOSFET is set to a value equal to or larger than a predetermined value so that one of the following conditions is satisfied:

(A) a proportion w of the delay time of the CMOS circuit determined by a rise time of the pMOSFET becomes substantially one, and a proportion (1−w) of the delay time of the CMOS circuit determined by a fall time of the nMOSFET becomes substantially zero; or (B) the proportion w of the delay time of the CMOS circuit determined by the rise time of the pMOSFET becomes substantially zero, and the proportion (1−w) of the delay time of the CMOS circuit determined by the fall time of the nMOSFET becomes substantially one, and wherein the power supply voltage controlling method includes:

a step of generating a predetermined minute current based on a power supply voltage of a power supply unit by using a minute current generator circuit; and a step of generating a controlled output voltage for correcting a variation in the delay time based on a generated minute current, and supplying the controlled output voltage to the subthreshold digital CMOS circuit as a controlled power supply voltage, the controlled output voltage including a change in the threshold voltage of one of the pMOSFET and the nMOSFET.

19. The power supply voltage controlling method as claimed in claim 18, wherein the step of generating the minute current includes:

a step of generating the minute current based on the power supply voltage of the power supply unit by using a current source circuit included in the minute current generator circuit; and a step of generating a minute current, which corresponds to the minute current generated by the current source circuit and is substantially the same as the minute current generated by the current source circuit, by using a current mirror circuit included in the minute current generator circuit.

20. The power supply voltage controlling method as claimed in claim 18, wherein, the threshold voltage of the typical value of the pMOSFET of the subthreshold digital CMOS circuit is higher than the threshold voltage of the typical value of the nMOSFET of the subthreshold digital CMOS circuit, and wherein the step of generating the controlled output voltage generates the controlled output voltage by using a pMOSFET having a grounded gate, a grounded drain, and a source connected to the minute current generator circuit.

21. The power supply voltage controlling method as claimed in claim 18, wherein, the threshold voltage of the typical value of the nMOSFET of the subthreshold digital CMOS circuit is higher than the threshold voltage of the typical value of the pMOSFET of the subthreshold digital CMOS circuit, and wherein the step of generating the controlled output voltage generates the controlled output voltage by using an nMOSFET having a gate connected to the minute current generator circuit, a drain connected to the minute current generator circuit, and a grounded source.

22. The power supply voltage controlling method as claimed in claim 18, wherein, the pMOSFET of the subthreshold digital CMOS circuit is a p-type high threshold device, and wherein the step of generating the controlled output voltage generates the controlled output voltage by using a p-type high threshold device having a grounded gate, a grounded drain, and a source connected to the minute current generator circuit.

23. The power supply voltage controlling method as claimed in claim 18, wherein, the nMOSFET of the subthreshold digital CMOS circuit is an n-type high threshold device, and wherein the step of generating the controlled output voltage generates the controlled output voltage by using an n-type high threshold device having a gate connected to the minute current generator circuit, a drain connected to the minute current generator circuit, and a grounded source.

24. The power supply voltage controlling method as claimed in claim 18, wherein the power supply voltage controlling method further includes:

a step of, by using a voltage buffer circuit after the step of generating the controlled output voltage, generating a power supply voltage corresponding to the controlled output voltage based on the controlled output voltage and supplying the power supply voltage to the subthreshold digital CMOS circuit.

25. The power supply voltage controlling method as claimed in claim 18, wherein the power supply voltage controlling method further includes:

a step of, by using a regulator circuit after the step of generating the controlled output voltage, generating a voltage corresponding to the controlled output voltage based on the controlled output voltage, regulating a generated voltage so as to generate a regulated power supply voltage, and supplying the regulated power supply voltage to the subthreshold digital CMOS circuit.

26. The power supply voltage controlling method as claimed in claim 18, wherein the subthreshold digital CMOS circuit is set by a manufacturing process so that the absolute value of the difference between the threshold voltage of the typical value of the pMOSFET and the threshold voltage of the typical value of the nMOSFET is equal to or larger than 0.1 V.

27. The power supply voltage controlling method as claimed in claim 18, wherein the subthreshold digital CMOS circuit is set by changing a substrate voltage so that the absolute value of the difference between the threshold voltage of the typical value of the pMOSFET and the threshold voltage of the typical value of the nMOSFET is equal to or larger than 0.1 V.

* * * * *